US010345060B2

(12) United States Patent
Irvin

(10) Patent No.: US 10,345,060 B2
(45) Date of Patent: Jul. 9, 2019

(54) RECOIL MITIGATION AND BUTTSTOCK FLOATING SYSTEM, METHOD, AND APPARATUS

(71) Applicant: Robert Irvin, Hilliard, OH (US)

(72) Inventor: Robert Irvin, Hilliard, OH (US)

(73) Assignee: Suzhou Superior Industrial Technology Co., Ltd., Suzhou, Jiangsu (CN)

( * ) Notice: Subject to any disclaimer, the term of this patent is extended or adjusted under 35 U.S.C. 154(b) by 128 days.

(21) Appl. No.: 14/662,487

(22) Filed: Mar. 19, 2015

(65) Prior Publication Data

US 2015/0345881 A1 Dec. 3, 2015

Related U.S. Application Data

(60) Provisional application No. 62/117,335, filed on Feb. 17, 2015, provisional application No. 61/955,452, filed on Mar. 19, 2014.

(51) Int. Cl.

| | |
|---|---|
| ***F41C 23/04*** | (2006.01) |
| ***F41A 3/78*** | (2006.01) |
| ***F41C 23/06*** | (2006.01) |
| ***F41C 23/14*** | (2006.01) |
| ***F41C 23/20*** | (2006.01) |

(52) U.S. Cl.

CPC ..... *F41A 3/78* (2013.01); *F41C 23/06* (2013.01); *F41C 23/14* (2013.01); *F41C 23/20* (2013.01)

(58) Field of Classification Search

CPC ..... F41C 23/04; F41C 23/14
USPC ..... 42/71.01, 73, 74
See application file for complete search history.

(56) References Cited

U.S. PATENT DOCUMENTS

| | | | |
|---|---|---|---|
| 1,379,989 | A | 5/1921 | Johnson |
| 3,052,053 | A | 9/1962 | Vartanian |
| 5,827,992 | A | 10/1998 | Harris et al. |
| 7,024,812 | B2 | 4/2006 | Nelson |
| 8,464,458 | B2 | 6/2013 | Chvala |
| 2004/0031118 | A1 | 2/2004 | Bentley |
| 2008/0028663 | A1 | 2/2008 | Abraham et al. |
| 2013/0097911 | A1 | 4/2013 | Larue |
| 2014/0259848 | A1 | 9/2014 | Chvala |

FOREIGN PATENT DOCUMENTS

| | | |
|---|---|---|
| DE | 37 43 092 A1 | 7/1988 |

OTHER PUBLICATIONS

Transmittal; International Search Report; and Written Opinion of the International Searching Authority for International Application No. PCT/US2015/021330 dated Oct. 27, 2015.

*Primary Examiner* — J. Woodrow Eldred
(74) *Attorney, Agent, or Firm* — Taylor Intellectual PLLC; James W. Taylor, II

(57) ABSTRACT

A buffer tube for firearms, including assault rifles, carbines, shotguns, and other rifles is disclosed. The floating buffer tube comprises a recoil mitigation mechanism, including a helical spring or an elastic or viscous energy absorption device, and a buttstock mounting bracket mounted outside the buffer tube. The buttstock mounting bracket can rotate relative to the buffer tube, which changes the axial angle of the buttstock relative to the firearm. The angle can be locked under an expansive force by forcing a bolt or pin into grooves to select the proper axial angle of the buttstock relative to the firearm in the field without the user having to disarm himself to perform the angle change.

17 Claims, 66 Drawing Sheets

200

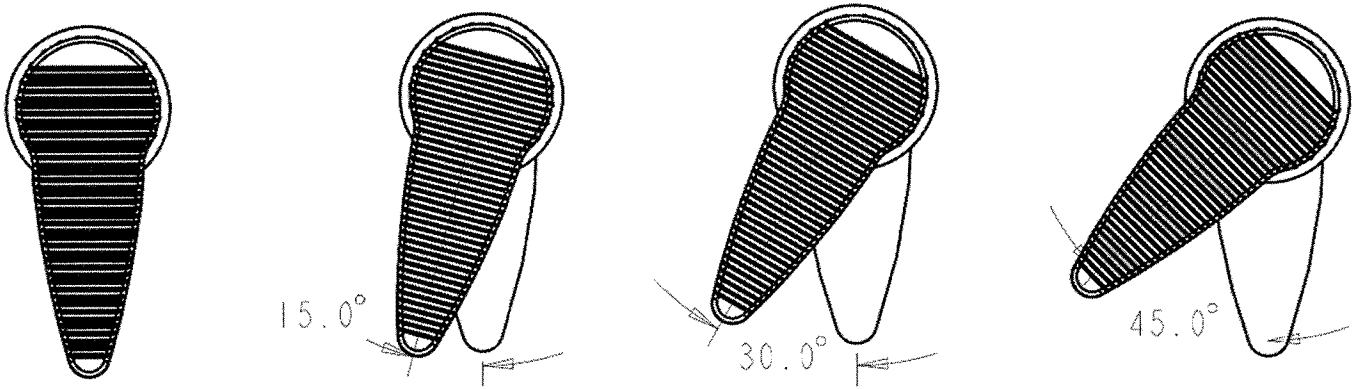
Fig. 14a
Fig. 14b
Fig. 14c
Fig. 14d
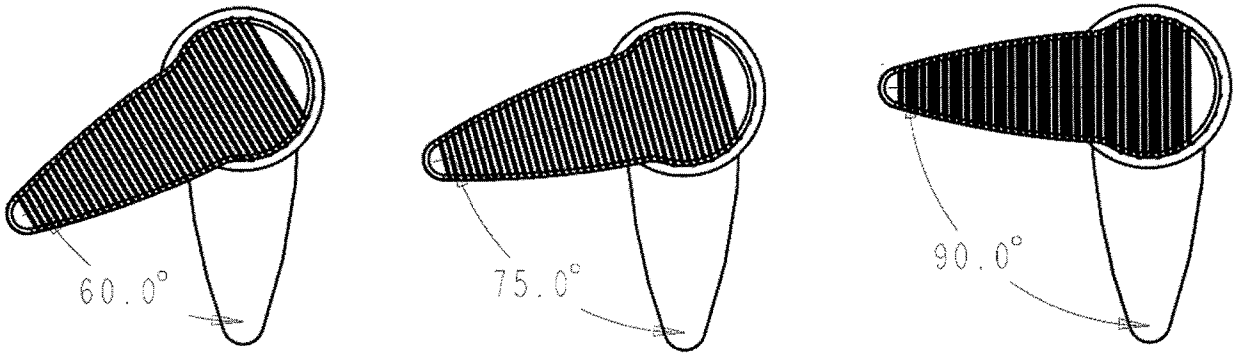
Fig. 14e
Fig. 14f
Fig. 14g

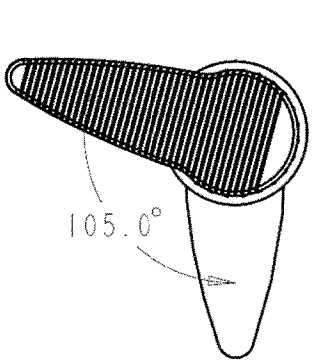
Fig. 14h
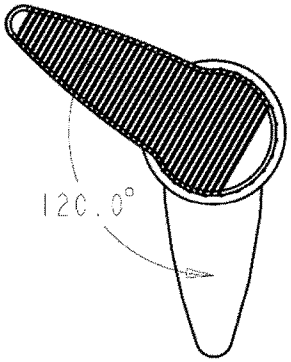
Fig. 14i
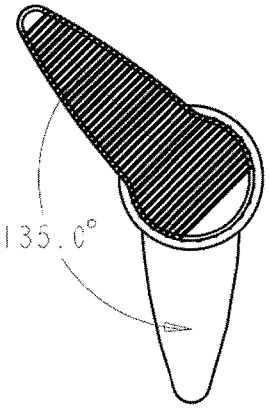
Fig. 14j
Fig. 14k
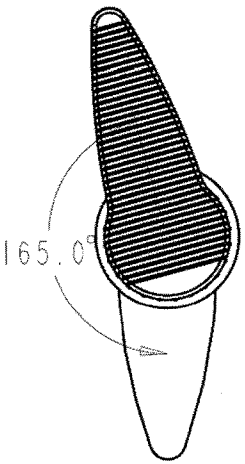
Fig. 14l
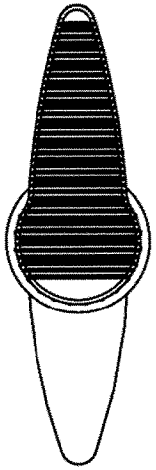
Fig. 14m
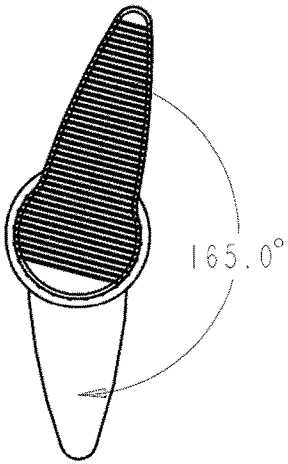
Fig. 14n

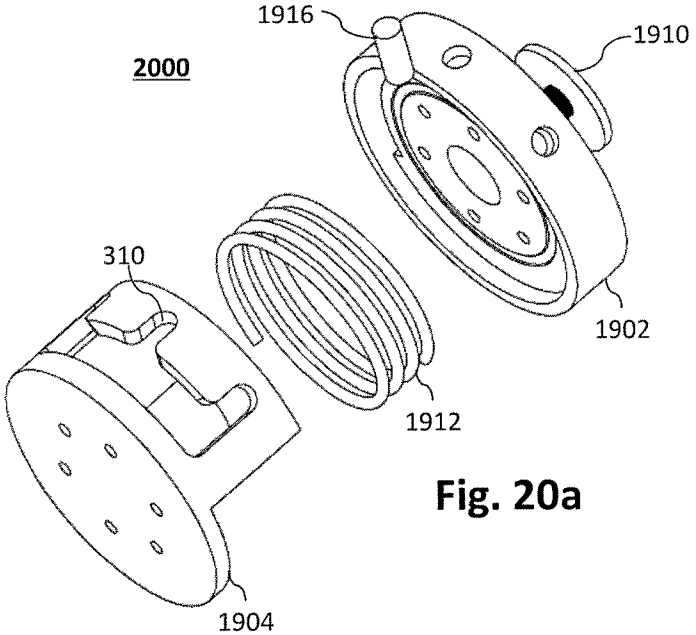
Fig. 20a
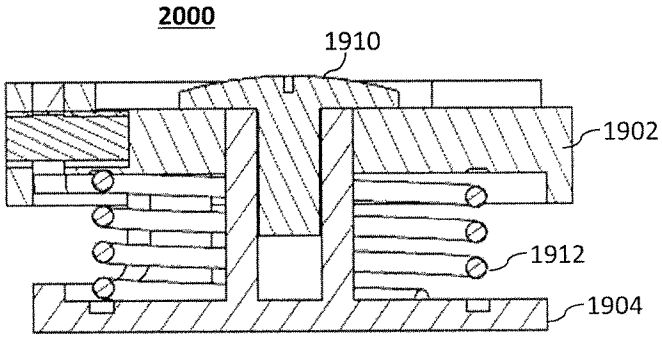
Fig. 20b
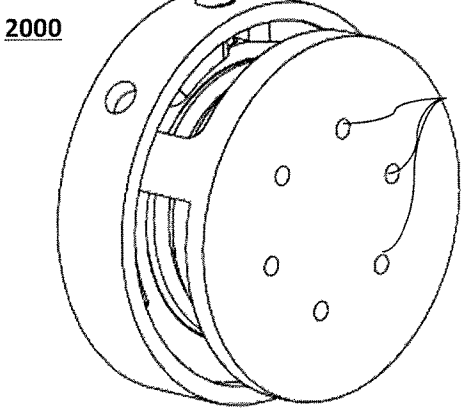
Fig. 20c
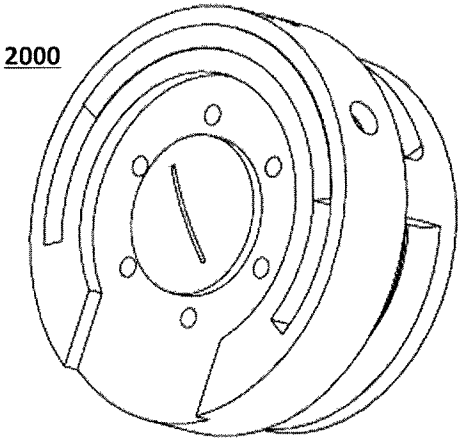
Fig. 20d
Fig. 20e

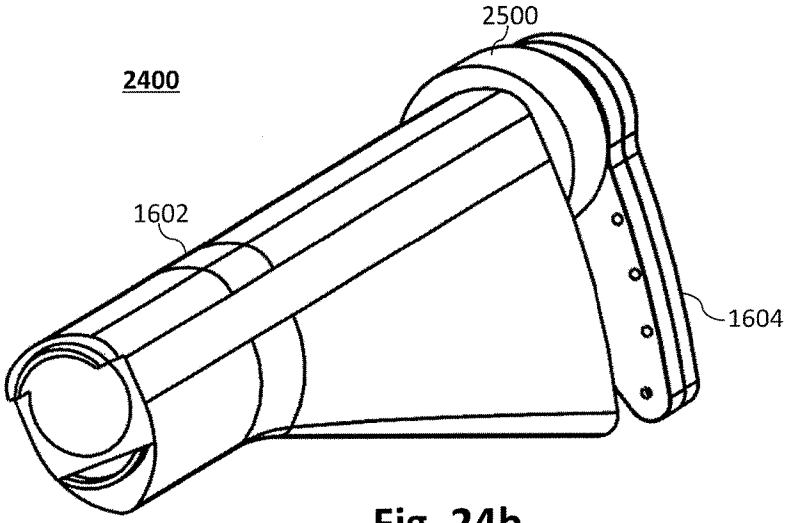
Fig. 24a
Fig. 24b
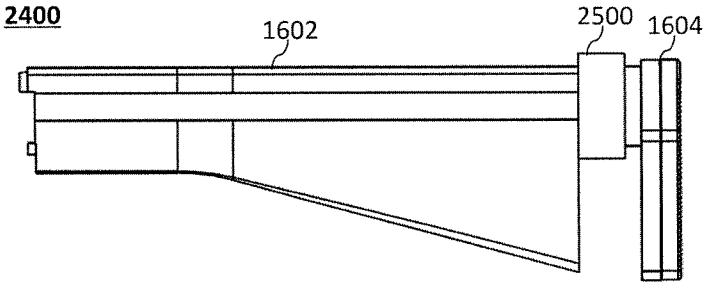
Fig. 24c
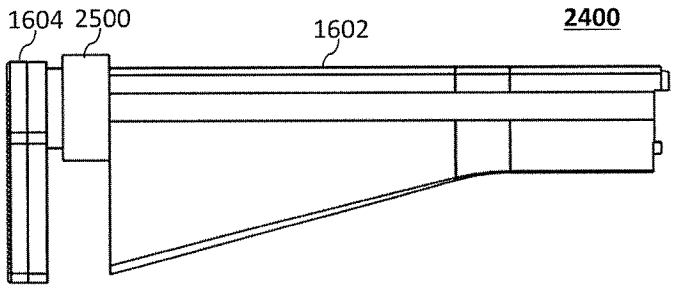
Fig. 24d

RECOIL MITIGATION AND BUTTSTOCK FLOATING SYSTEM, METHOD, AND APPARATUS

CROSS REFERENCE TO RELATED APPLICATIONS

This application claims priority to U.S. Provisional Patent Application No. 61/955,452, filed on Mar. 19, 2014 and entitled "AR Floating Buffer Tube," and U.S. Provisional Patent Application No. 62/117,335, filed on Feb. 17, 2015 and entitled "Recoil Mitigation And Buttstock Floating System, Method, And Apparatus," each by Robert Irvin, each of which are hereby incorporated by reference in its entirety.

FIELD OF THE INVENTION

The invention relates to recoil mitigation and buttstock floating (RMBF) devices and RMBF adapter mechanisms for firearms, such as carbines, shotguns, assault rifles, and rifles as a whole.

BACKGROUND OF THE INVENTION

A buffer tube, such as those for a collapsible buttstock on a rifle (such as the M4), is typically a hollow tube that is closed (or partially closed) at one end, wherein the open end is attached to a receiver coupled to a firearm. A buffer tube serves two general functions: first, it holds the recoil spring and a recoil buffer inside its hollow chamber. The recoil spring and recoil buffer push the firearm bolt forward when the trigger is pulled or the bolt catch is depressed. Additionally, the buffer tube acts as an attachment mount for the firearm's collapsible or non-collapsible buttstock.

Conventional buffer tubes are designed in an axially fixed arrangement intended for "normal" use. That is, when firing, the buttstock properly sets on the user's shoulder when the firearm is held orthogonally to the user's body, with the bottom of the firearm pointing straight down toward the ground. However, when a firearm user is under cover, the firearm must often be held at non-orthogonal and non-ideal angles. For example, when the user is on his stomach in a prone position, the firearm may be held somewhat parallel to the user's body, but at a 45° angle relative to the ground because the ammunition magazine is obstructed by the ground. As a result, the firearm is not in a proper shoulder location.

When the buttstock of the firearm is not positioned in the proper shoulder location, shots are inaccurate due to lack of firearm stability. Further, significant recoil drift exists, thus making several shots in quick succession impractical. Finally, recoil may possibly injure the user. Each of which are undesirable. Several other scenarios exist that force a firearm user with a buttstock configured for normal operation to use an improper shoulder location for the buttstock, such as when firing under a vehicle, firing inside of a vehicle, and firing around a corner. Moreover, some firearms are equipped with two or more scopes (or colored dots) that are set for precision shots at different distances. Only one such scope can be set in one line of sight; in order to use multiple sights, these would be attached to the firearm at different lines of sight offset from the normal line of sight (different firearm axial angles), usually set at 45° from the neutral line of sight. In order to use such different scopes, the firearm should be tilted to allow the operator to line up the scope with the line of sight and take aim at a target, however, this will position the firearm buttstock in a non-ideal position for the operator to take a precision shot or control the firearm recoil. A series of quick, proper shots may be what separates a soldier from life or death in these scenarios and having proper shoulder location is critical towards successful, quick shots.

Historically, changing the axial angle of conventional, collapsible buttstocks relative to the rest of the firearm requires disassembling the components of the firearm and then re-assembling them in a desired configuration. As expected, such an approach is impractical for field use and inconvenient, at best, for enthusiast use. For example, U.S. Pat. No. 7,024,812 by James B. Nelson ("Nelson") discloses a gun stock pivot. More specifically, Nelson describes an accessory that permits the buttstock to rotate to indexed positions about an axis substantially parallel to the axis of the barrel. However, according to the Nelson design, it would be more difficult to quickly and easily switch between positions as Nelson uses locking dowel pins to secure the buttstock in a desired position. Therefore, it is desirable to create a firearm that is capable of changing its buttstock angle quickly, such that it can be properly shouldered when the firearm is not at the standard orthogonal angle relative to its user. More importantly, it is critical to be able to change the buttstock angle while maintaining the target or the potential source of danger in sight.

SUMMARY OF THE INVENTION

The present disclosure is directed to a buffer tube for firearms and a firearm that is capable of changing its buttstock angle, as disclosed herein or in the Detailed Description below.

According to a first aspect, a method of manufacturing a floating buffer tube comprises: attaching a bracket for mounting a buttstock to a tube component that connects to a firearm; wherein the bracket can rotate around the tube component thereby defining an axis of rotation, and wherein the position of the bracket can be locked at a plurality of axial angles.

According to a second aspect, a recoil mitigation and buttstock floating (RMBF) device for a firearm comprises: a tube component configured to attach to a firearm; and a bracket for mounting a buttstock; wherein the bracket is coupled to the bracket (or buttstock) and configured to rotate relative to the tube component, thereby defining an axis of rotation, and wherein the position of the bracket relative to the tube component can be locked at one of a plurality of axial angles.

According to a third aspect, a RMBF adapter mechanism comprises, a first housing, wherein the first housing couples to a movable buttstock portion; a second housing, wherein the second housing couples to a fixed firearm portion; a helical spring disposed between said first housing and said second housing; and a device configured to secure the first housing to the second housing.

According to a fourth aspect, a method of axially rotating components of a firearm comprises: applying a lateral force to a first component of a firearm, said lateral force compressing a helical spring within said firearm; and applying a rotational force to the first component of the firearm relative to a second component, wherein the first component rotates relative to a longitudinal axis of the second component, thereby defining an axis of rotation, and wherein a position of the first component relative to the second component can be locked at one of a plurality of axial angles. In certain aspects, the first component may be a buttstock, and said second component may comprise a firing mechanism.

In certain aspects, the tube component comprises an open end and a closed end, wherein the open end comprises a connecting component to secure it to a firearm.

In certain aspects, the RMBF device further comprises a recoil spring and a recoil buffer weight, wherein the recoil spring is inside of the tube component and is in contact with the closed end and the recoil buffer weight is attached to the other end of the recoil spring.

In certain aspects, a buttstock is coupled to the bracket. The bracket may comprise an annular ring at a first end of the bracket that goes around the tube component to secure the bracket to the tube component, wherein the tube component is inside of the annular ring.

In certain aspects, the bracket comprises a bolt hole on a second end of the bracket; the tube component comprises a bolt hole in the center of a closed end of the tube; and a first bolt engages the bracket's bolt hole and the tube component's bolt hole to secure the components together and define the axis of rotation around the first bolt.

In certain aspects, the RMBF device further comprises an expansive component that applies expansive force to push the bracket away from the tube down the first bolt until the bolt catches to create a maximum extension of the RMBF device.

In certain aspects, the expansive component is a helical spring.

In certain aspects, the RMBF device further comprises: a second bolt connected to the bracket; and an extension of the tube component that comprises a cutout that is shaped to receive the second bolt; wherein the cutout has several grooves such that, at rest, the expansive component pushes the second bolt into one of said grooves locking the rotation of the bracket relative to the tube component.

In certain aspects, compressive force can be applied to the RMBF device to compress the expansive component thereby freeing the bolt from the grooves, such that the bracket can be rotated around the tube and such that the second bolt can engage a different groove when the compressive force is removed.

In certain aspects, the RMBF device further comprises an expansive component that applies expansive force to push the bracket away from the tube down the axis of rotation until a first bolt catches to create a maximum extension of the RMBF device.

In certain aspects, the RMBF device further comprises: a second bolt connected to the bracket; and an extension of the tube component that comprises a cutout that is shaped to receive the second bolt; wherein the cutout has several grooves such that, at rest, the expansive component pushes the second bolt into one of said grooves locking the rotation of the bracket around the tube component; and wherein compressive force can be applied to the RMBF device to compress the expansive component thereby freeing the second bolt from the grooves, such that the bracket can be rotated around the tube and such the bolt can engage a different groove when the compressive force is removed.

In certain aspects, the floating buffer tube further comprises a cutout in the tube component or an attached component that comprises grooves that engage with the bracket.

BRIEF DESCRIPTION OF THE DRAWINGS

The features of the present invention will best be understood from a detailed description of the invention and a preferred embodiment thereof selected for the purposes of illustration and shown in the accompanying drawings in which:

FIGS. 14*a* through 14*o* illustrate a rear view of a RMBF device mechanism configured in various axial angle positions.

FIG. 20*a* illustrates an assembly view of a second RMBF adapter mechanism.

FIG. 20*b* illustrates a cross-sectional side view of the second RMBF adapter mechanism of FIG. 20*a*.

FIG. 20*c* illustrates a top view of the second example RMBF adapter mechanism of FIG. 20*a*.

FIG. 20*d* illustrates a rear perspective view of the second example RMBF adapter mechanism of FIG. 20*a*.

FIG. 20*e* illustrates a front perspective view of the second example RMBF adapter mechanism of FIG. 20*a*.

FIG. 24*a* illustrates a perspective view of a buttstock having a RMBF adapter mechanism according to a third aspect of the present invention.

FIG. 24*b* illustrates a second perspective view of the buttstock of FIG. 24*a*.

FIG. 24*c* illustrates a first side view of the buttstock of FIG. 24*a*.

FIG. 24*d* illustrates a second side view of the buttstock of FIG. 24*a*.

Figure 28B:
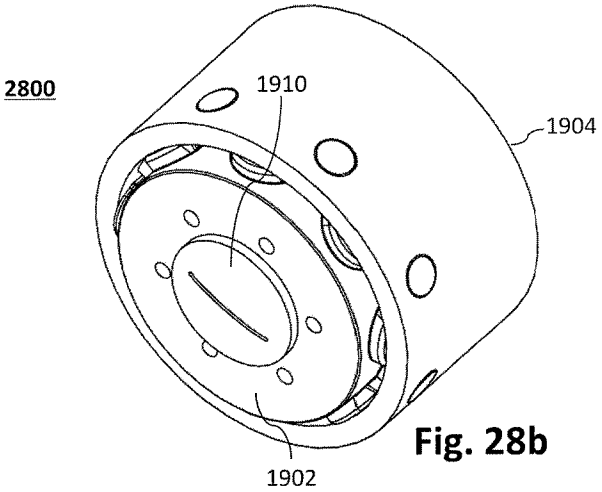
FIG. 28*b* illustrates a rear perspective view of the seventh example RMBF adapter mechanism of FIG. 28*a*.
Figure 28D:
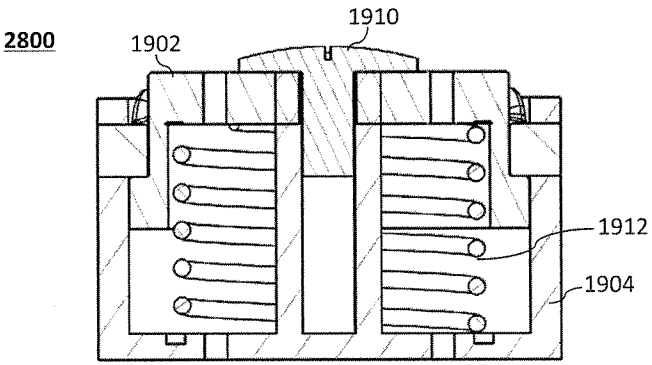
FIG. 28*a* illustrates an assembly view of a seventh example RMBF adapter mechanism.
FIG. 28*c* illustrates a top plan view of the seventh example RMBF adapter mechanism of FIG. 28*a*.
Figure 28A:
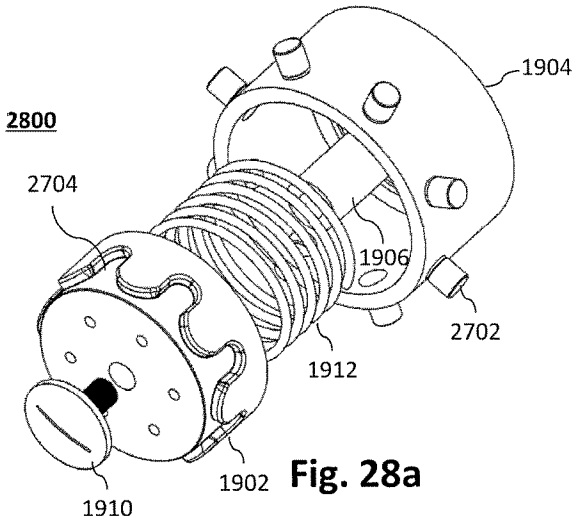
Figure 28C:
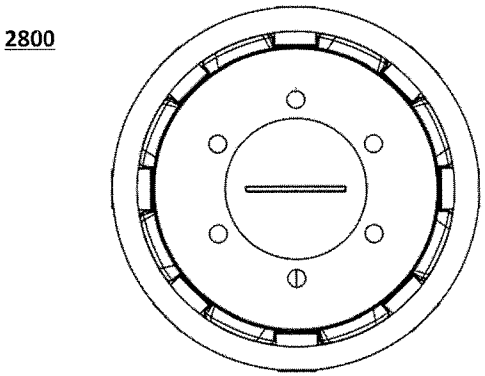

FIG. 28*d* illustrates a cross-sectional side view of the seventh example RMBF adapter mechanism of FIG. 28*a* in an extended position.

Figure 29B:
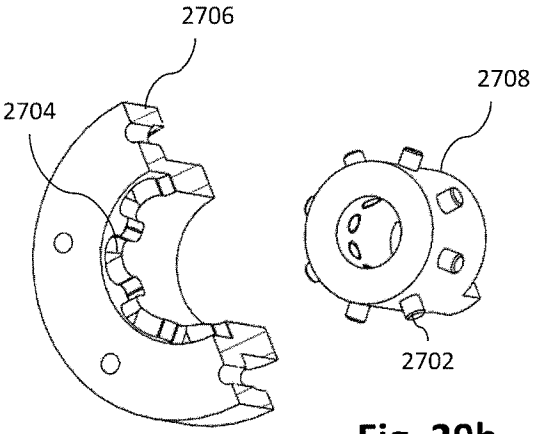
Figure 29A:
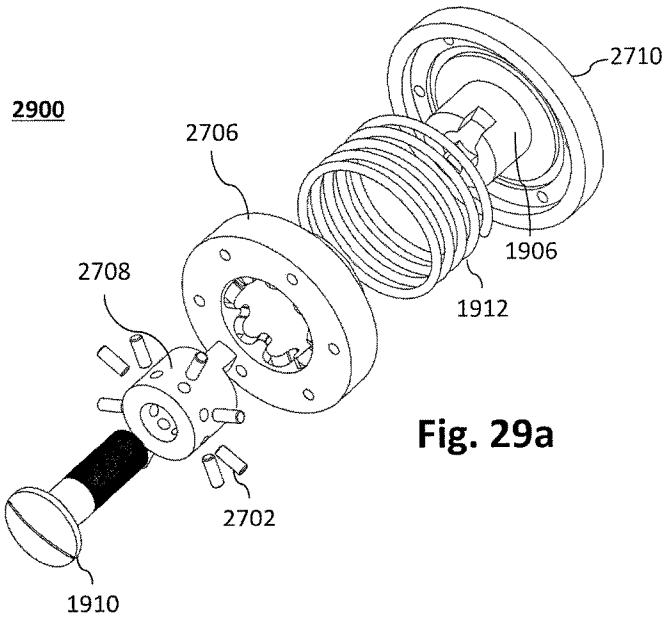

FIG. 29*a* illustrates an assembly view of an eighth example RMBF adapter mechanism.

FIG. 29*b* illustrates a first and second housing of the eighth example RMBF adapter mechanism.

Figure 29E:
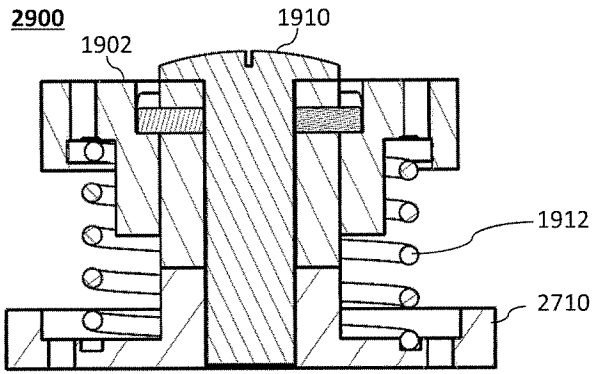
Figure 29D:
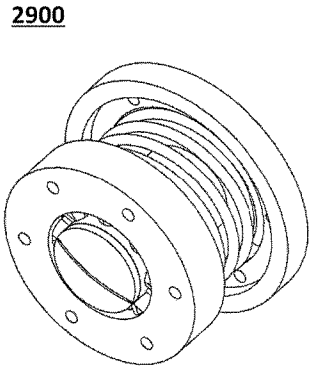
Figure 29C:
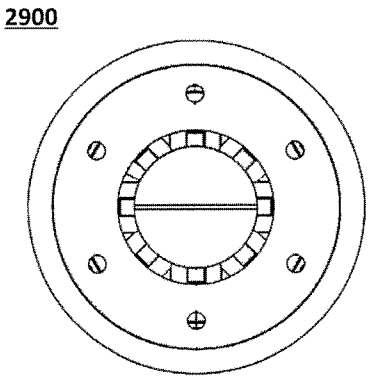

FIG. 29*c* illustrates a top plan view of the eighth example RMBF adapter mechanism of FIG. 29*a*.

FIG. 29*d* illustrates a rear perspective view of the eighth example RMBF adapter mechanism of FIG. 29*a*.

FIG. 29*e* illustrates a cross-sectional side view of the eighth example RMBF adapter mechanism of FIG. 29*a* in an extended position.

Figure 30B:
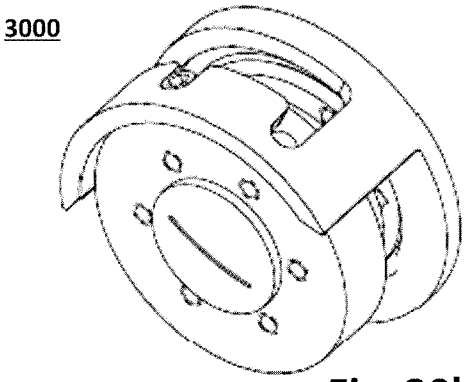
Figure 30D:
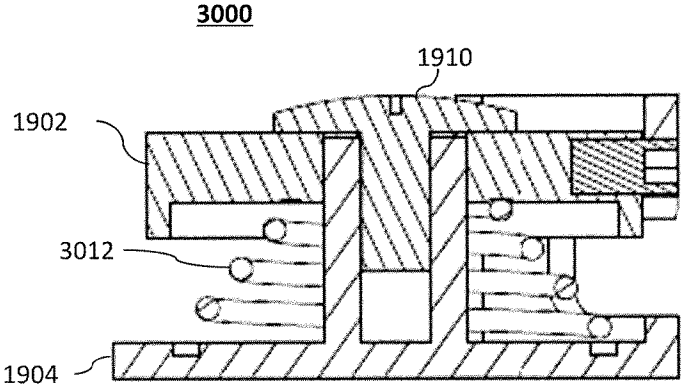
Figure 30A:
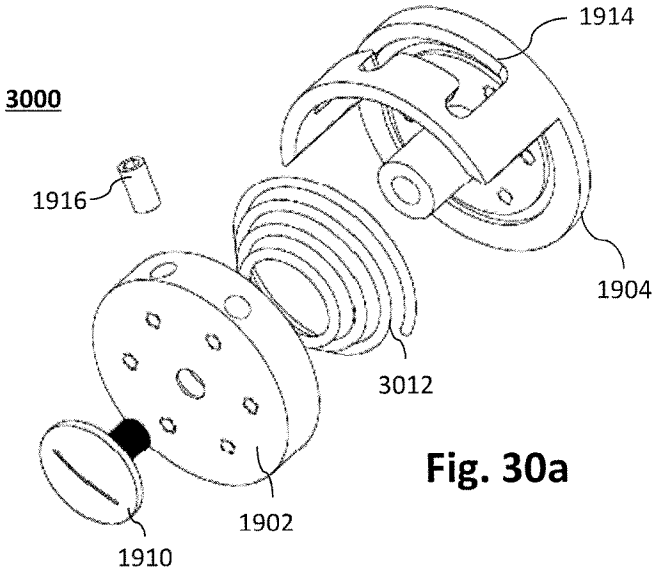

FIG. 30*a* illustrates an assembly view of a ninth example of an RMBF adapter mechanism utilizing a variable rate spring.

FIG. 30*b* illustrates a rear perspective view of the RMBF example utilizing a variable rate spring of FIG. 30*a*.

Figure 30C:
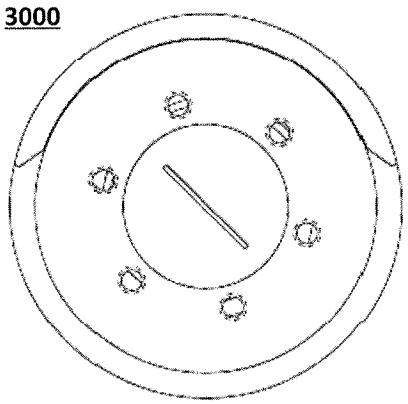

FIG. 30*c* illustrates a top plan view of the RMBF example utilizing a variable rate spring of FIG. 30*a*.

FIG. 30*d* illustrates a cross-sectional side view of the RMBF example utilizing a variable rate spring of FIG. 30*a* in an extended position.

Figure 31B:
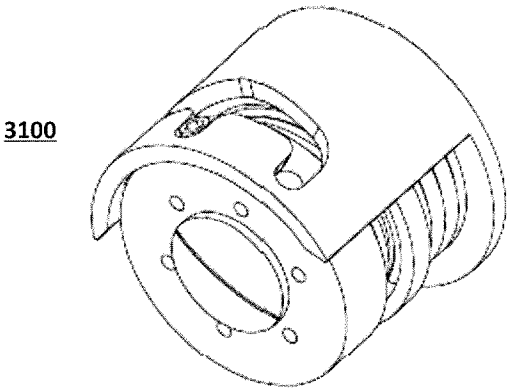
Figure 31D:
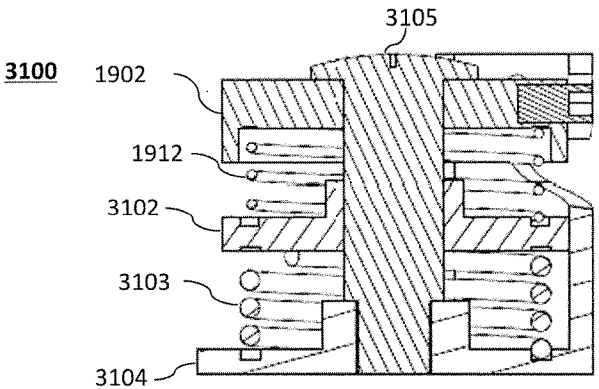
Figure 31A:
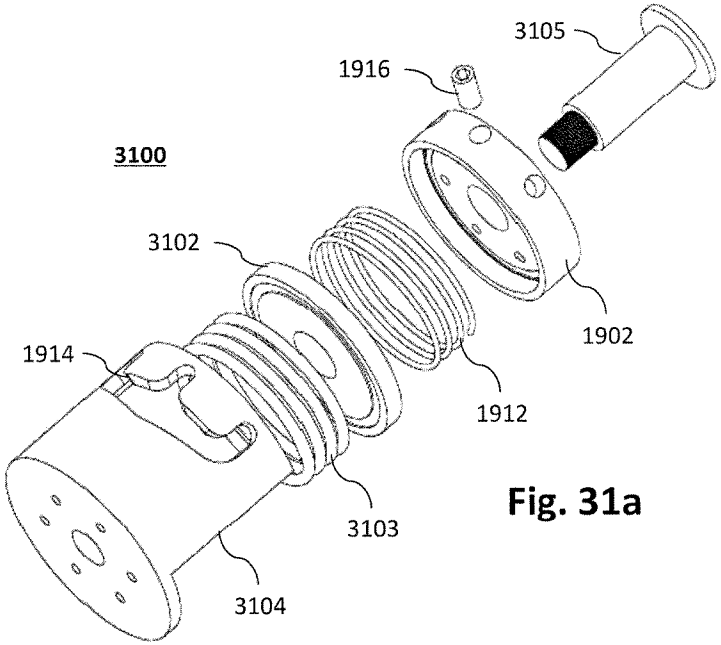

FIG. 31*a* illustrates an assembly view of a tenth example of an RMBF adapter mechanism utilizing two springs, each spring in a separate location.

FIG. 31*b* illustrates a rear perspective view of the RMBF example utilizing two springs each spring in a separate location, of FIG. 31*a*.

Figure 31C:
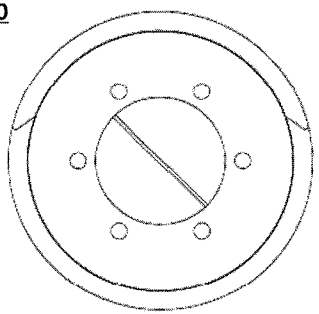

FIG. 31*c* illustrates a top plan view of the RMBF example utilizing two springs two springs each spring in a separate location of FIG. 31*a*.

FIG. 31*d* illustrates a cross-sectional side view of the RMBF example utilizing two springs two springs each spring in a separate location of FIG. 31*a* in an extended position.

Figure 32B:
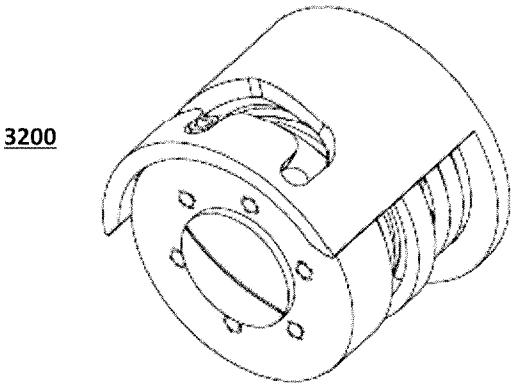
Figure 32D:
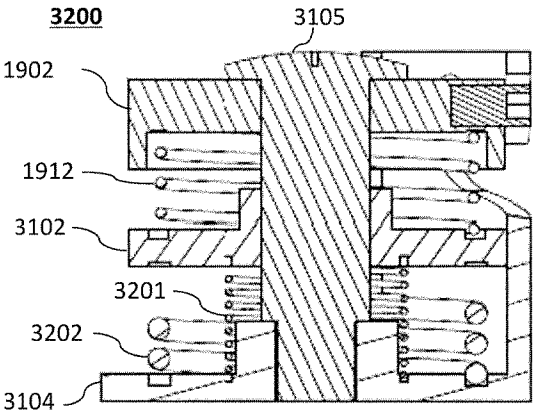
Figure 32A:
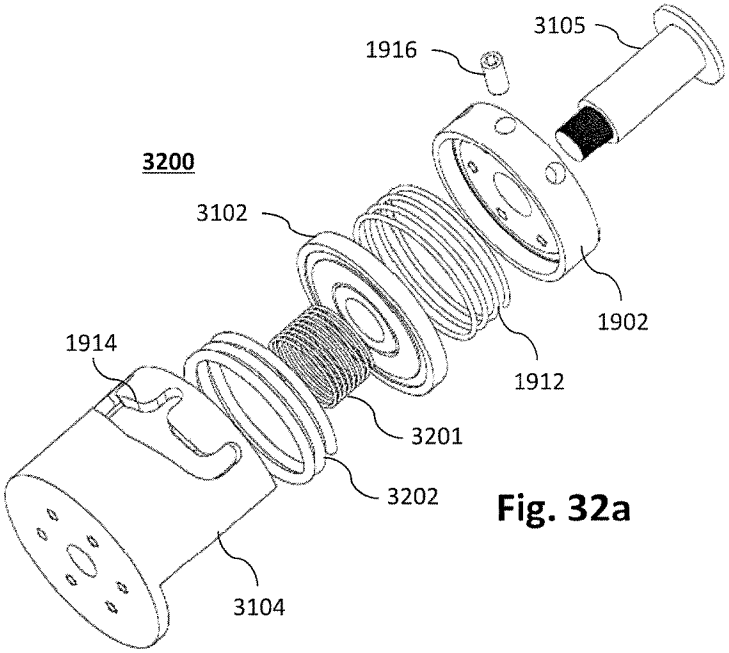

FIG. 32*a* illustrates an assembly view of an eleventh example of an RMBF adapter mechanism utilizing three springs with one spring in one separate location and the other two springs share one location and are concentric to each other.

FIG. 32*b* illustrates a rear perspective view of the RMBF example utilizing three springs with one spring in one separate location and the other two springs share one location and are concentric to each other of FIG. 32*a*.

Figure 32C:
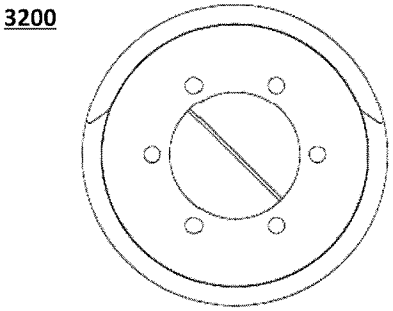

FIG. 32*c* illustrates a top plan view of the RMBF example utilizing three springs with one spring in one separate location and the other two springs share one location and are concentric to each other of FIG. 32*a*

FIG. 32*d* illustrates a cross-sectional side view of the RMBF example utilizing three springs with one spring in one separate location and the other two springs share one location and are concentric to each other of FIG. 32*a*.

Figure 33B:
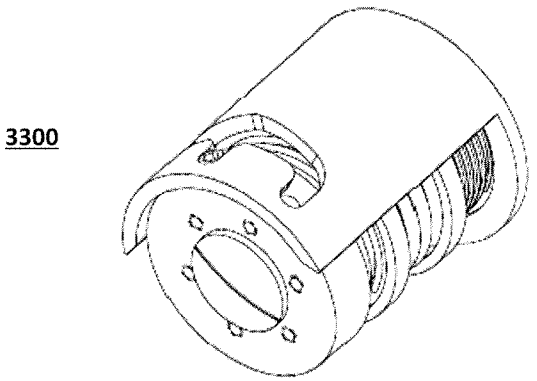
Figure 33D:
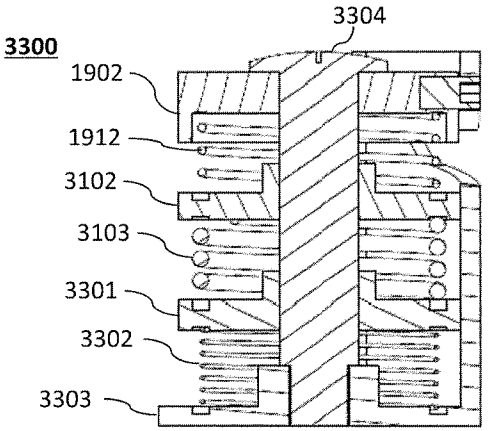
Figure 33A:
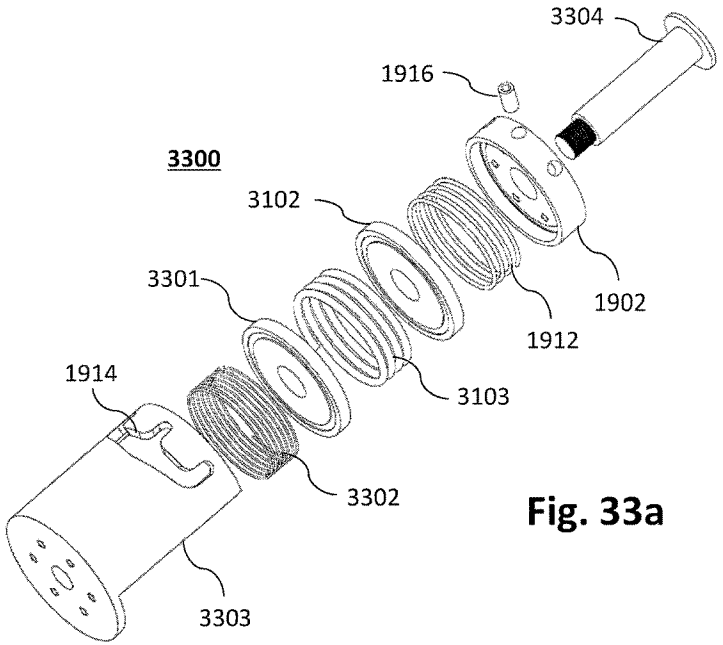

FIG. 33*a* illustrates an assembly view of a twelfth example of an RMBF adapter mechanism utilizing three springs with each spring in a separate location.

FIG. 33*b* illustrates a rear perspective view of the RMBF example utilizing three springs with each spring in a separate location of FIG. 33*a*.

Figure 33C:
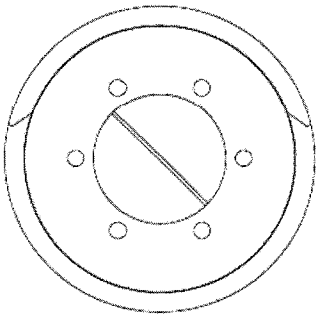

FIG. 33*c* illustrates a top plan view of the RMBF example utilizing three springs with each spring in a separate location of FIG. 33*a*.

FIG. 33*d* illustrates a cross-sectional side view of the RMBF example utilizing three springs with each spring in a separate location of FIG. 33*a*.

Figure 34B:
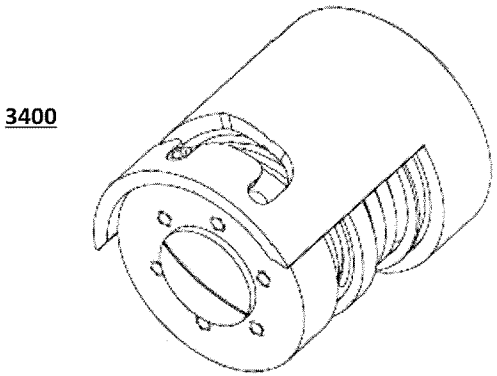
Figure 34D:
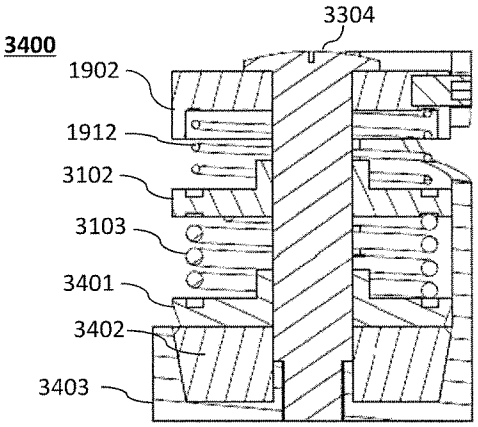
Figure 34A:
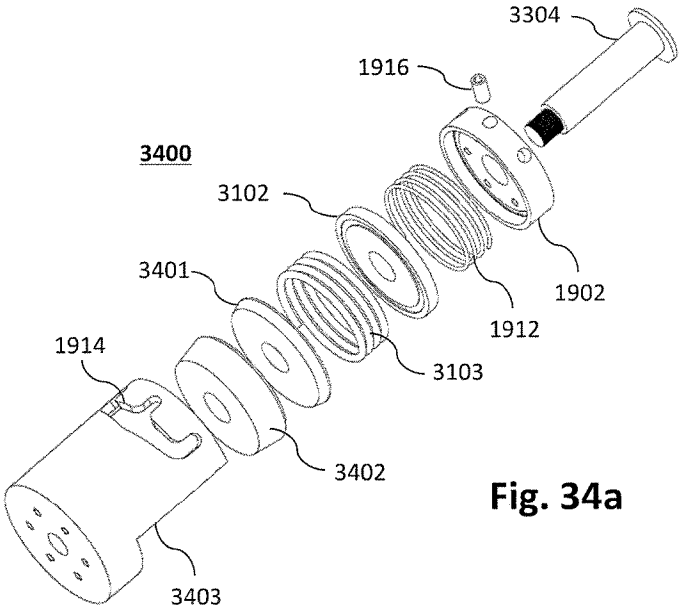

FIG. 34*a* illustrates an assembly view of a thirteenth example of an RMBF adapter mechanism utilizing two springs and a polymer pad with each spring in a separate location and the polymer pad in a separate location in the front of the RMBF.

FIG. 34*b* illustrates a rear perspective view of the RMBF example utilizing two springs and a polymer pad with each spring in a separate location and the polymer pad in a separate location in the front of the RMBF of FIG. 34*a*.

Figure 34C:
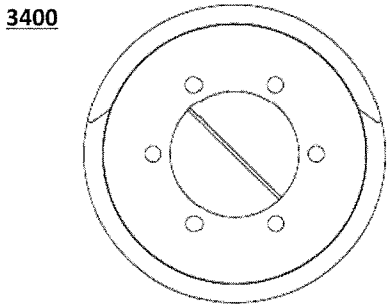

FIG. 34*c* illustrates a top plan view of the RMBF example utilizing two springs and a polymer pad with each spring in a separate location and the polymer pad in a separate location in the front of the RMBF of FIG. 34*a*.

FIG. 34*d* illustrates a cross-sectional side view of the RMBF example utilizing two springs and a polymer pad with each spring in a separate location and the polymer pad in a separate location in the front of the RMBF of FIG. 34*a*.

Figure 35B:
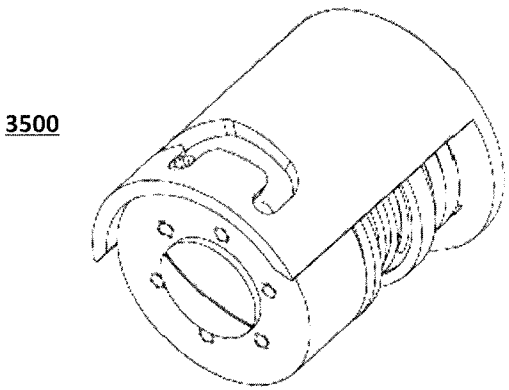
Figure 35D:
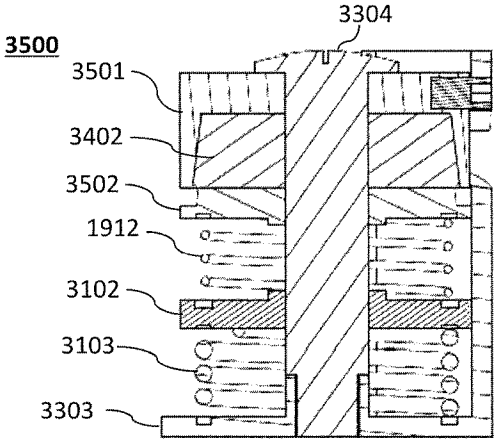
Figure 35A:
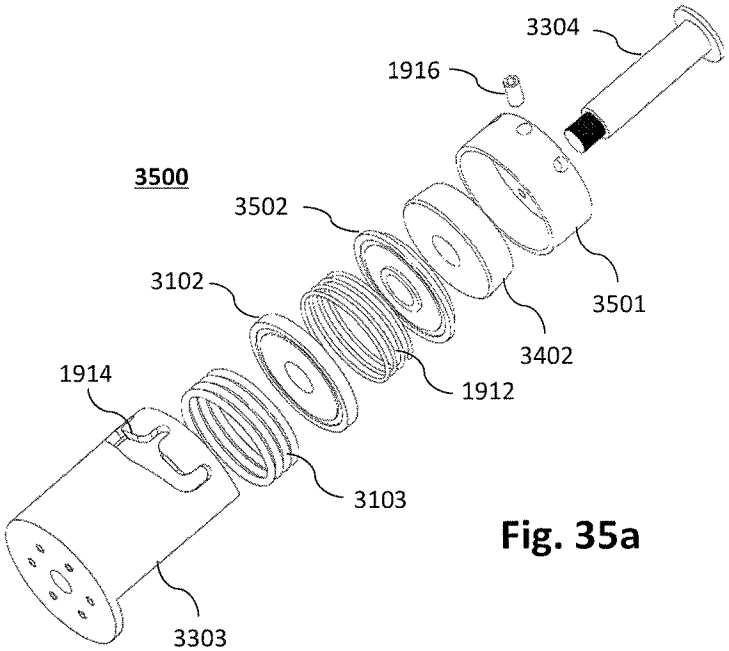

FIG. 35*a* illustrates an assembly view of a fourteenth example of an RMBF adapter mechanism utilizing two springs and a polymer pad with each spring in a separate location and the polymer pad in a separate location in the rear of the RMBF.

FIG. 35*b* illustrates a rear perspective view of the RMBF example utilizing two springs and a polymer pad with each spring in a separate location and the polymer pad in a separate location in the rear of the RMBF of FIG. 35*a*.

Figure 35C:
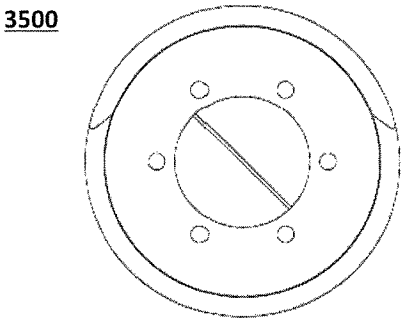

FIG. 35*c* illustrates a top plan view of the RMBF example utilizing two springs and a polymer pad with each spring in a separate location and the polymer pad in a separate location in the rear of the of FIG. 35*a*.

FIG. 35*d* illustrates a cross-sectional side view of the RMBF example utilizing two springs and a polymer pad with each spring in a separate location and the polymer pad in a separate location in the rear of the of FIG. 35*a*.

Figure 36B:
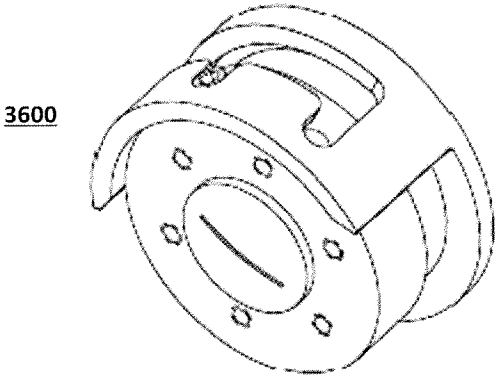
Figure 36D:
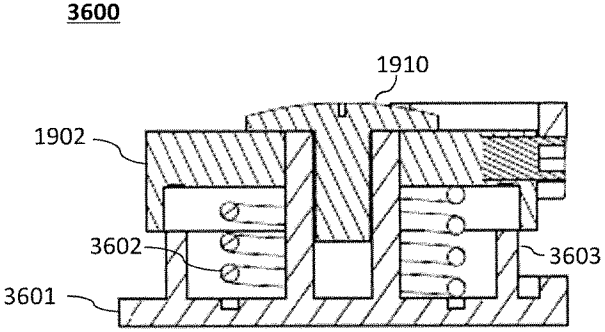
Figure 36A:
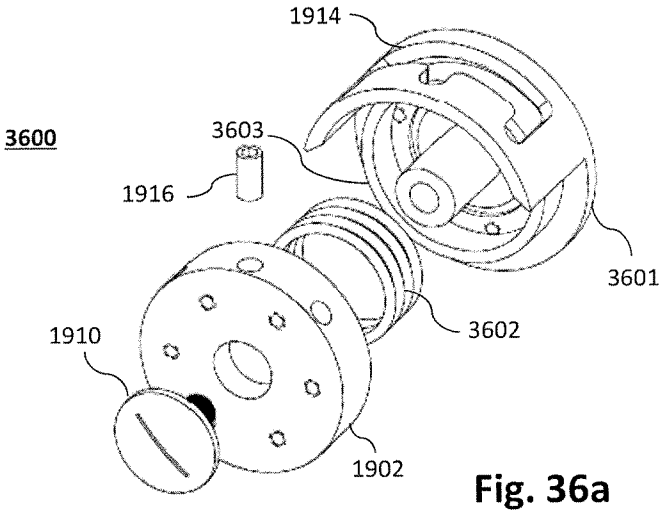

FIG. 36*a* illustrates an assembly view of the fifteenth example RMBF adapter mechanism FIG. 36*b* illustrates a rear perspective view of the RMBF adapter mechanism of FIG. 36*a*.

Figure 36C:
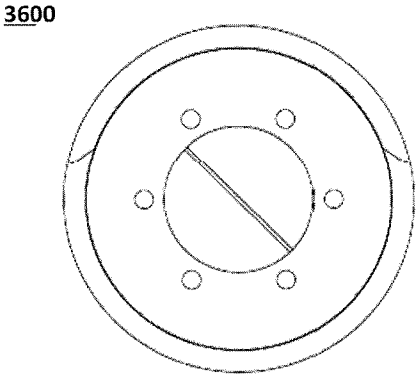

FIG. 36*c* illustrates a top view of the RMBF adapter mechanism of FIG. 36*a*.

FIG. 36*d* illustrates a cross-sectional side view of the RMBF adapter mechanism of FIG. 36*a*

Figure 37A:
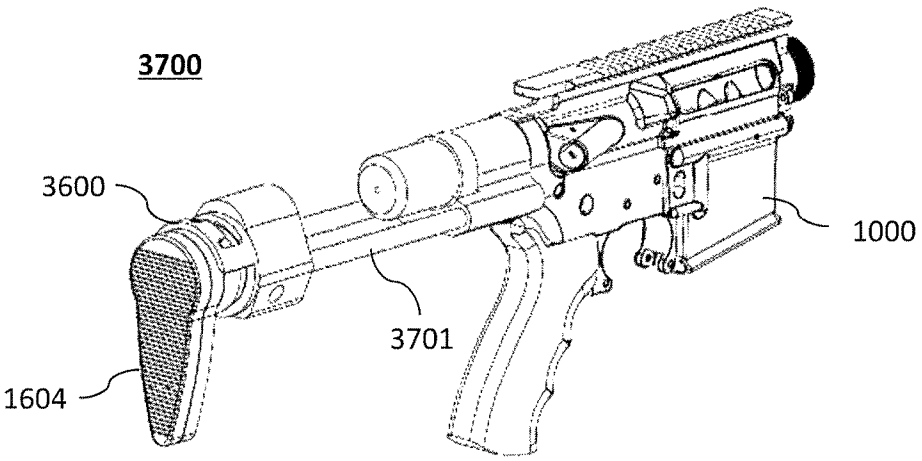

FIG. 37*a* illustrates a perspective view of a firearm with a sliding buttstock with a RMBF adapter mechanism attached to it according to a fifteenth example of the present invention and a rotating buttstock in the default upright position.

Figure 37B:
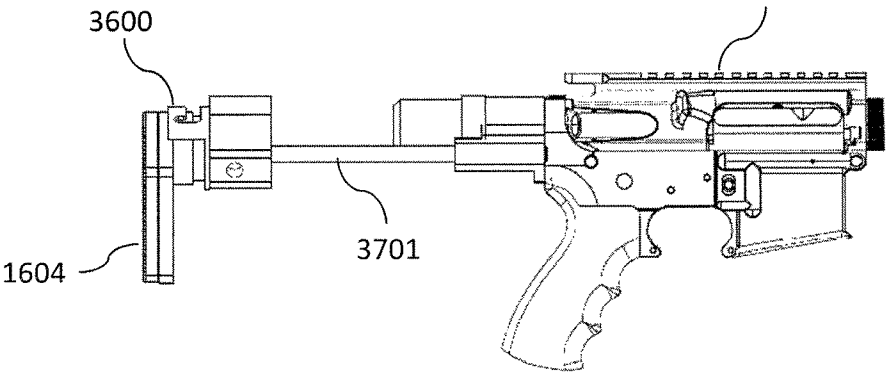

FIG. 37*b* illustrates a side view of the firearm with RMBF of example 15 and buttstock of FIG. 37*a*

Figure 37D:
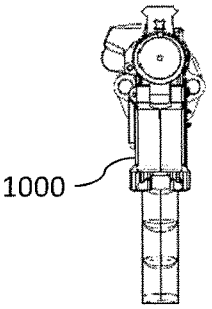
Figure 37C:
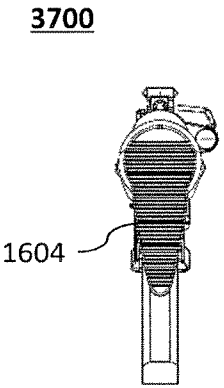

FIG. 37*c* illustrates a back view of the firearm with RMBF of example 15 and buttstock of FIG. 37*a*.

FIG. 37*d* illustrates a front view of the firearm with RMBF of example 15 and buttstock of FIG. 37*a*.

Figure 38A:
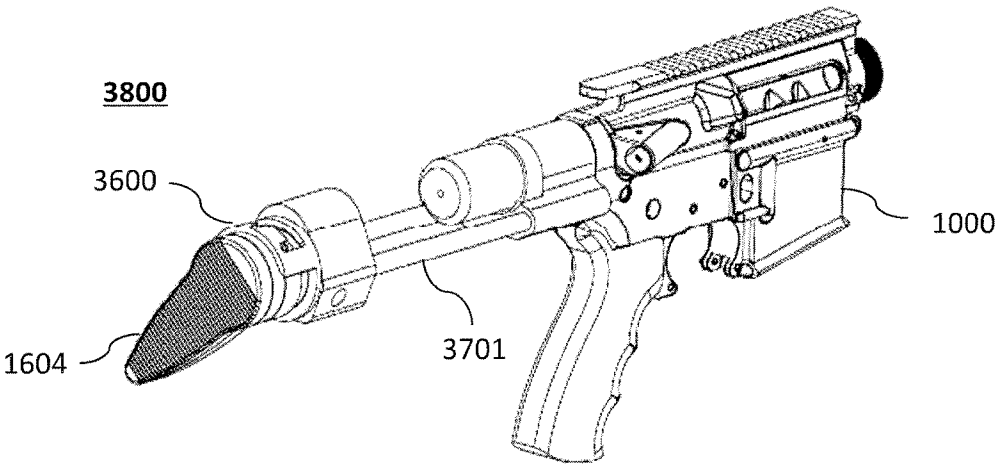

FIG. 38*a* illustrates a perspective view of a firearm with a sliding buttstock and a RMBF adapter mechanism attached to it according to a fifteenth example of the present invention and a rotating buttstock in the second axially rotated position.

Figure 38B:
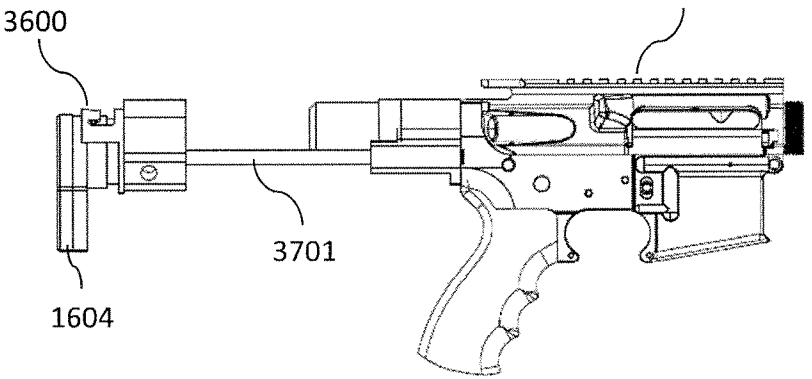

FIG. 38*b* illustrates a side view of the firearm with RMBF of example 15 and buttstock of FIG. 38*a*

Figure 38D:
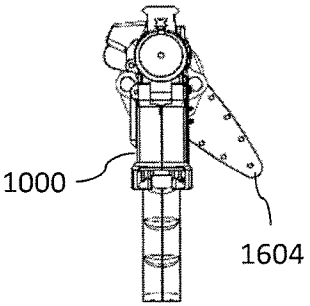
Figure 38C:
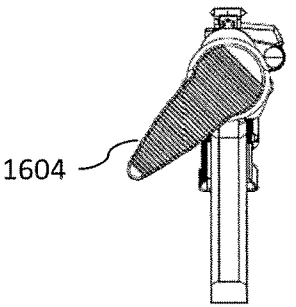

FIG. 38*c* illustrates a back view of the firearm with RMBF of example 15 and buttstock of FIG. 38*a*.

FIG. 38*d* illustrates a front view of the firearm with RMBF of example 15 and buttstock of FIG. 38*a*.

Figure 39A:
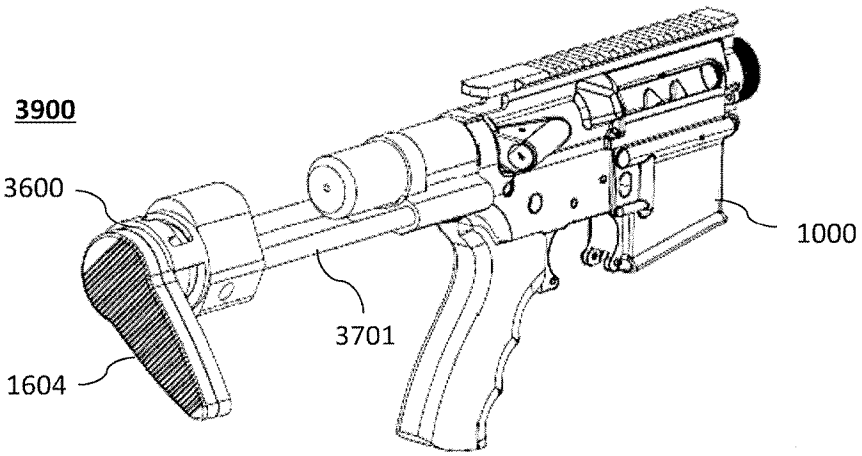

FIG. 39*a* illustrates a perspective view of a firearm with a sliding buttstock and a RMBF adapter mechanism attached to it according to a fifteenth example of the present invention and a rotating buttstock locked in first axially rotated position.

Figure 39B:
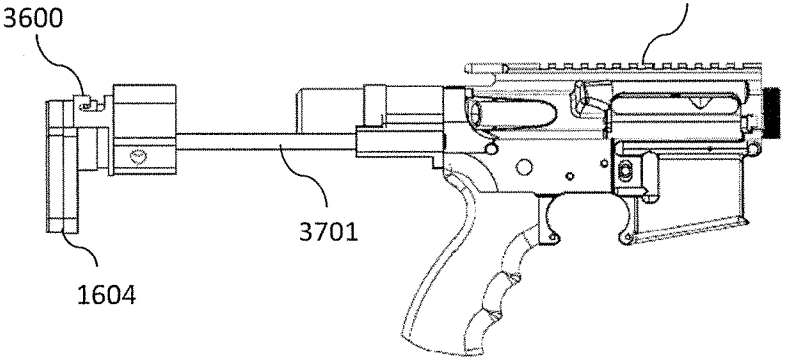

FIG. 39*b* illustrates a side view of the firearm with RMBF of example 15 and buttstock of FIG. 39*a*

Figure 39C:
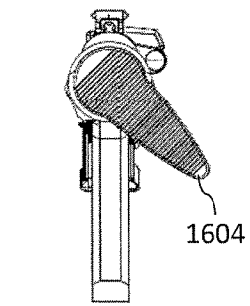

FIG. 39*c* illustrates a back view of the firearm with RMBF of example 15 and buttstock of FIG. 39*a*.

Figure 39D:
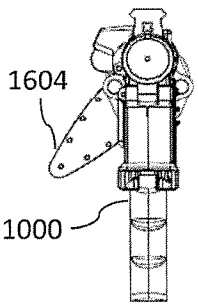

FIG. 39*d* illustrates a front view of the firearm with RMBF of example 15 and buttstock of FIG. 39*a*.

Figure 40A:
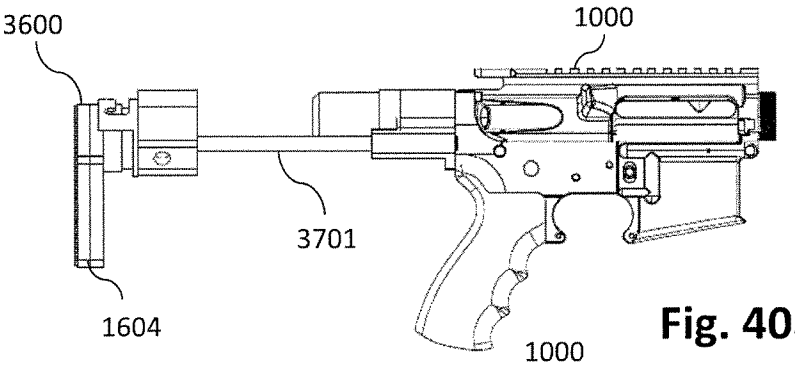

FIG. 40*a* illustrates a side view of a firearm with a sliding buttstock and a RMBF adapter mechanism attached to it according to a fifteenth example of the present invention and a rotating buttstock in the default upright position and the sliding stock is fully extended.

Figure 40B:
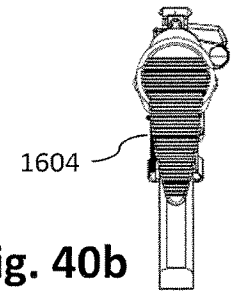

FIG. 40*b* illustrates a side view of a firearm with a sliding buttstock and a RMBF adapter mechanism attached to it according to a fifteenth example of the present invention and a rotating buttstock in the default upright position and the sliding stock is partially extended.

Figure 40C:
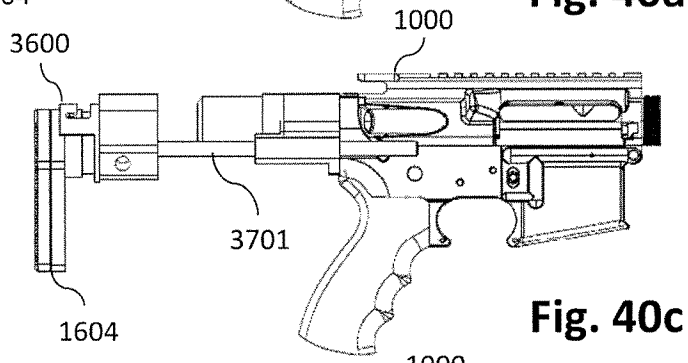
Figure 40D:
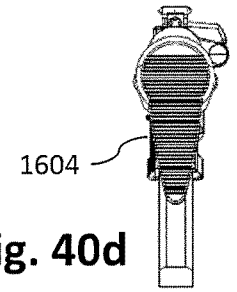
Figure 40E:
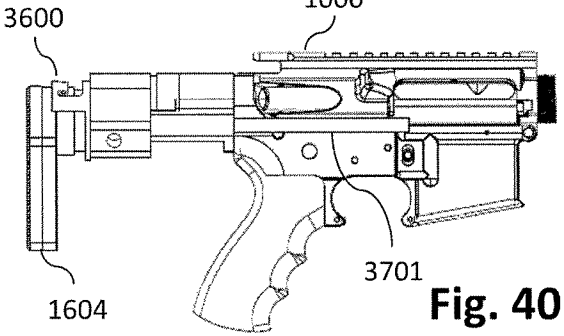
Figure 40F:
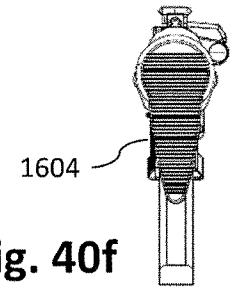

FIG. 40*c* illustrates a side view of a firearm with a sliding buttstock and a RMBF adapter mechanism attached to it according to a fifteenth example of the present invention and a rotating buttstock in the default upright position and the sliding stock is completely collapsed. And, FIGS. 40*d*, 40*e*, and 40*f* illustrate the firearm of FIGS. 40*a*-40*c*, with the buttstock collapsed.

Figure 41B:
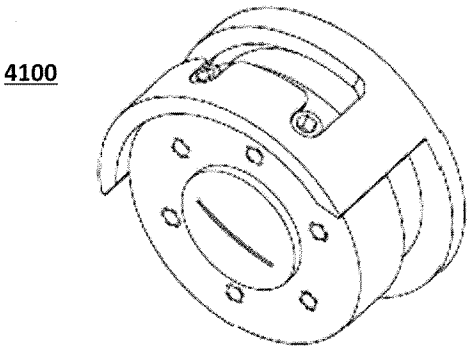
Figure 41D:
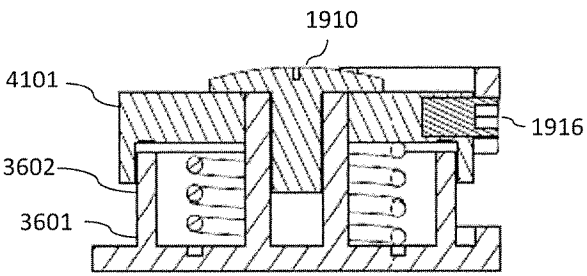
Figure 41A:
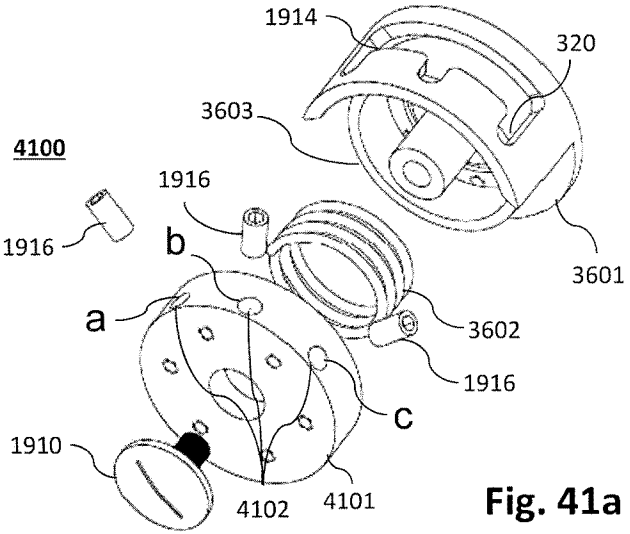

FIG. 41*a* illustrates an assembly view of the sixteenth example RMBF adapter mechanism with a modified first housing to accept one two or three guide pins.

FIG. 41*b* illustrates a rear perspective view of the RMBF adapter mechanism of FIG. 41*a*.

Figure 41C:
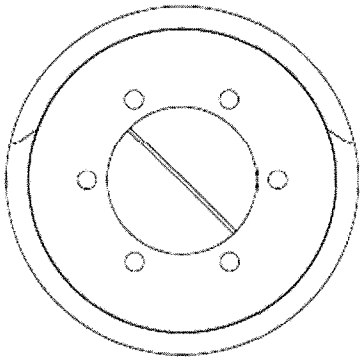

FIG. 41*c* illustrates a top view of the RMBF adapter mechanism of FIG. 41*a*.

FIG. 41*d* illustrates a cross-sectional side view of the RMBF adapter mechanism of FIG. 41*a*

Figures 42A, 42B, 42C, 42D, 42E, 42F, 42G, 42H, 42I:
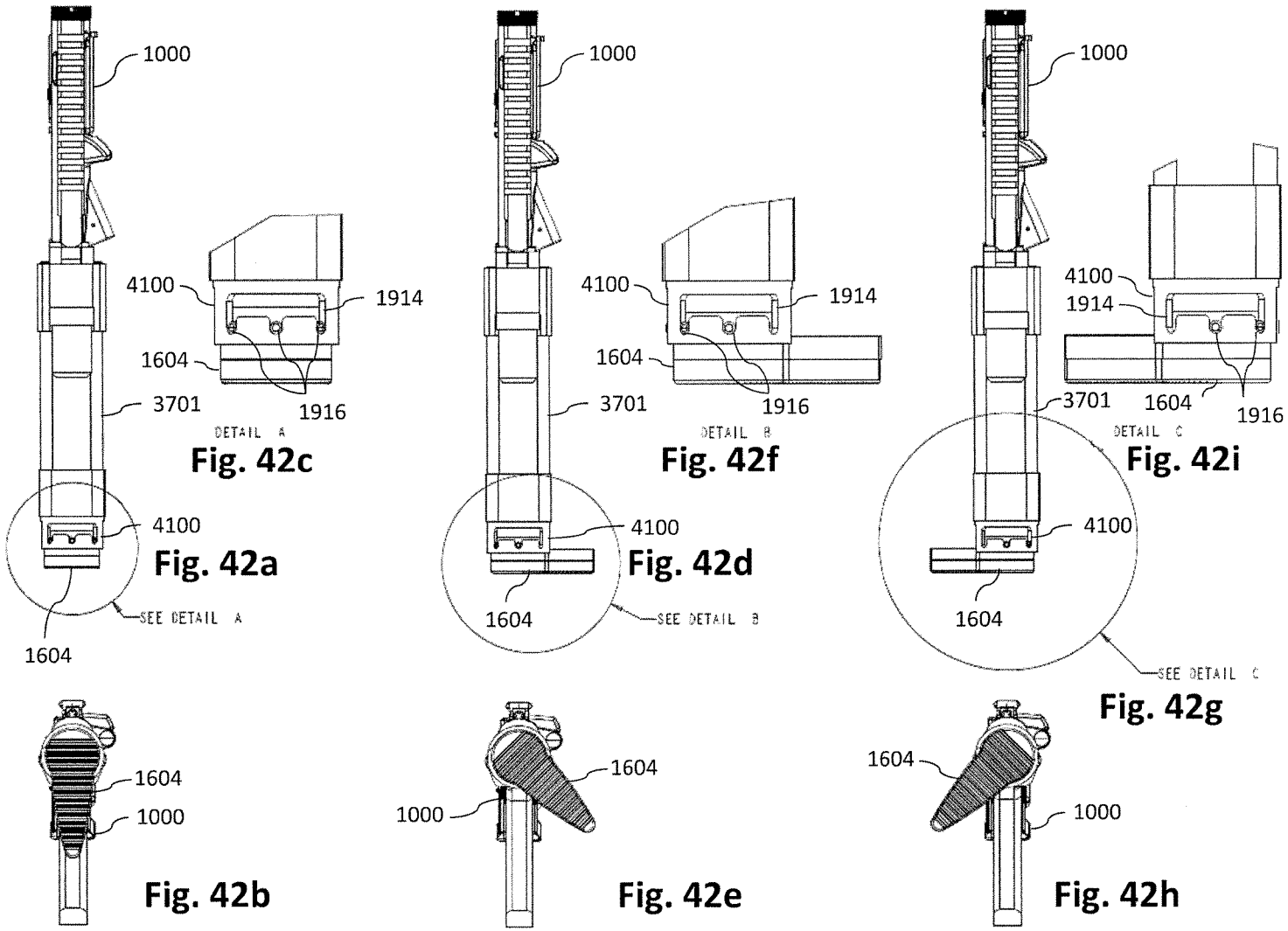

FIG. 42*a* illustrates a top view of a firearm with a sliding buttstock and a RMBF adapter mechanism attached to it according to a sixteenth example utilizing three guide pins to prevent buttstock rotation, buttstock is locked in the default upright position.

FIG. 42*b* illustrates a back view of FIG. 42*a*.

FIG. 42*c* illustrates a detailed view of FIG. 42*a* detailing the RMBF adapter with three guide pins installed in the first housing, FIG. 42*d* illustrates a top view of a firearm with a sliding buttstock and a RMBF adapter mechanism attached to it according to a sixteenth example utilizing two guide pins to allow butt stock to float between two positions, the default upright position and the first axial position, the buttstock is in the first axial position FIG. 42*e* illustrates a back view of FIG. 42*d*.

FIG. 42*f* illustrates a detailed view of FIG. 42*d* detailing the RMBF adapter with two guide pins installed in the first housing FIG. 42*g* illustrates a top view of a firearm with a sliding buttstock and a RMBF adapter mechanism attached to it according to a sixteenth example utilizing two guide pins to allow butt stock to float between two positions, the default upright position and the second axial position the butt stock is in the second axial position FIG. 42*h* illustrates a back view of FIG. 42*g*.

FIG. 42*i* illustrates a detailed view of FIG. 42*g* detailing the RMBF adapter with two guide pins installed in the first housing,

DETAILED DESCRIPTION

The present disclosure is directed to a recoil mitigation and buttstock floating (RMBF) device and RMBF adapter mechanism for firearms. Preferred embodiments of the present invention will be described hereinbelow with reference to the figures of the accompanying drawing. In the following description, well-known functions or constructions are not described in detail, since such descriptions would obscure the invention in unnecessary detail.

For the purpose of promoting an understanding of the principles of the claimed technology and presenting its currently understood, best mode of operation, reference will be now made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

Figure 1A:
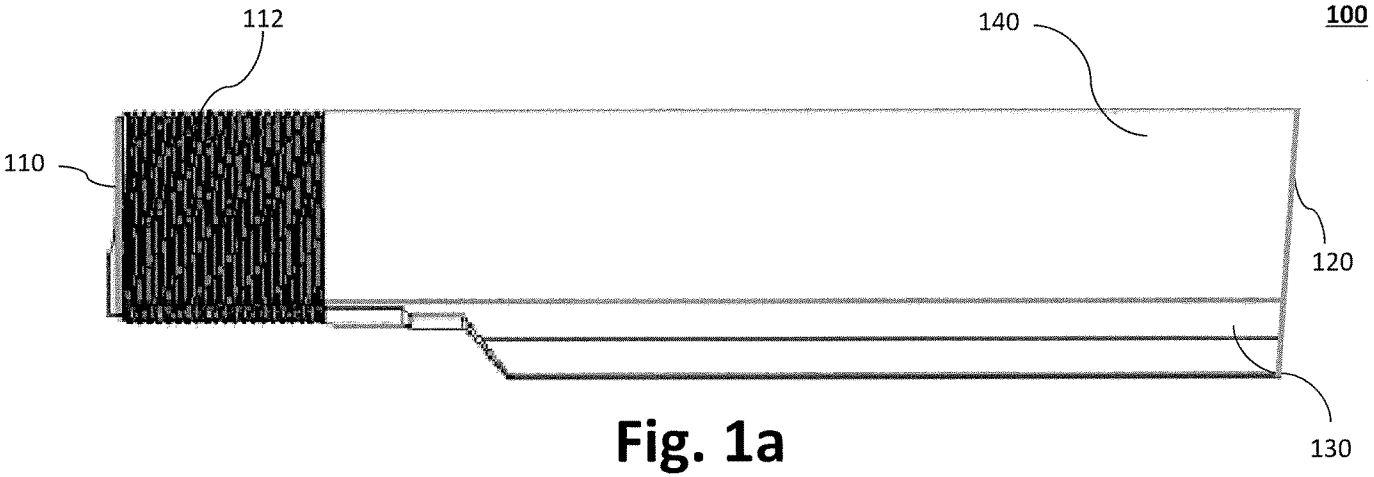
Fig. 1a (prior art)
FIG. 1*a* illustrates a side view of a conventional buffer tube.
Figure 1B:
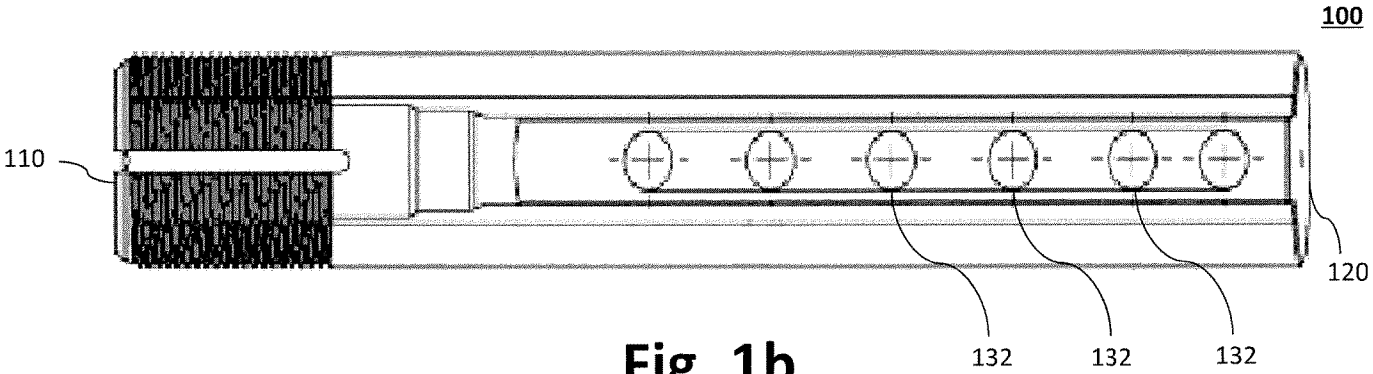
Fig. 1b (prior art)
FIG. 1*b* illustrates a bottom view of a conventional buffer tube.

A conventional buffer tube 100 is illustrated in FIGS. 1*a* and 1*b*. Specifically, FIG. 1*a* illustrates a side view of a conventional buffer tube, while FIG. 1*b* illustrates the bottom view of the buffer tube 100. The buffer tube 100 allows a collapsible buttstock to be attached to the firearm with the collapsible buttstock in an axially fixed arrangement. Buttstock generally refers to the part of a rifle or other firearm, to which the barrel and firing mechanism are attached, that is held against one's shoulder when firing the gun. A collapsible buttstock makes the firearm more compact for storage or transport, but is usually deployed before shooting to enhance control. A collapsible buttstock collapses by telescoping (or sometimes folding) in on itself. As will be discussed below, a collapsible buttstock may employ more than one length setting, allowing the buttstock to be adjusted for different users.

Typically, the buffer tube 100 attaches to the firearm by screwing the buffer tube 100's open end 110 into the firearm via, for example, screw threads 112. When disassembled from the firearm, the open end 110 provides access to a hollow cavity, defined by the tube portion 140 and the closed end 120, which houses a spring. The spring may be secured in place between the closed end 120 and a recoil buffer (e.g., a shaped weight) on the open end 110. Excess gas behind the spring can escape the buffer tube 100 through a gas vent hole. Thus, when a shot is fired and high pressure gas is released from the explosion, the recoil buffer is launched into the buffer tube, thereby compressing the spring and consuming some of the resulting energy via the mechanical compression. However, not all the mechanical energy is consumed by the spring compression. As a result, excess energy is transferred to the body of the firearm, which is then dissipated into the firearm holder at the point of contact between the firearm buttstock and the part of the firearm operator's body (usually the shoulder). This dissipated energy is known as "felt recoil" and typically causes the firearm nozzle to rise instantaneously. As will be appreciated, the degree to which the nozzle rises depends on the skill of the firearm operator and how well the operator can predict and control the felt recoil.

To facilitate collapse, the protruding portion 130 of the tube portion 140 may comprise a plurality of engagement means (illustrated as a plurality of recesses 132 bored into the raised protruding portion 130) that are configured to engage a bolt, pin, or other engagement technique in a buttstock, which would slide over (and along) the said tube portion 140. Upon engagement, the buttstock is locked to a desired telescope depth along the buffer tube 100. Generally a buttstock will have a means to disengage the recesses 132, thus moving the buttstock (e.g., telescoping) on the buffer tube to a user's desired configuration. The protruding portion 130 further functions as a guide by engaging a corresponding channel on the buttstock when the two components are engaged to prevent the buttstock from axially rotating around the buffer tube. Importantly, protruding portion 130 is in a fixed configuration with regard to the tube portion 140.

While buffer tubes are generally known, the inventive RMBF devices, axially and laterally adjustable buttstock, and RMBF adapter mechanisms enable a user to axially rotate the firearm (or buttstock) while constantly maintaining proper shoulder position, a hand on the firearm's grips and trigger, and can even fire while doing so, even if it is a less accurate shot. Notably, it is not required that the user lower the firearm, or even take his or her eyes off of the sight, to adjust the axial angle of the firearm relative to the buttstock. Further, the inventive RMBF devices and RMBF adapter mechanisms and axially and laterally adjustable buttstock also provide added recoil mitigation by absorbing energy imparted during firing through the helical spring. As will be appreciated, the various RMBF mechanisms, such as the RMBF adapter mechanisms, may be used, or adapted, to axially rotate any component of a firearm relative to a longitudinal axis of another component of the firearm. Accordingly, the teachings of the subject specification should not be limited to the specific examples and embodiments disclosed herein.

Figure 2A:
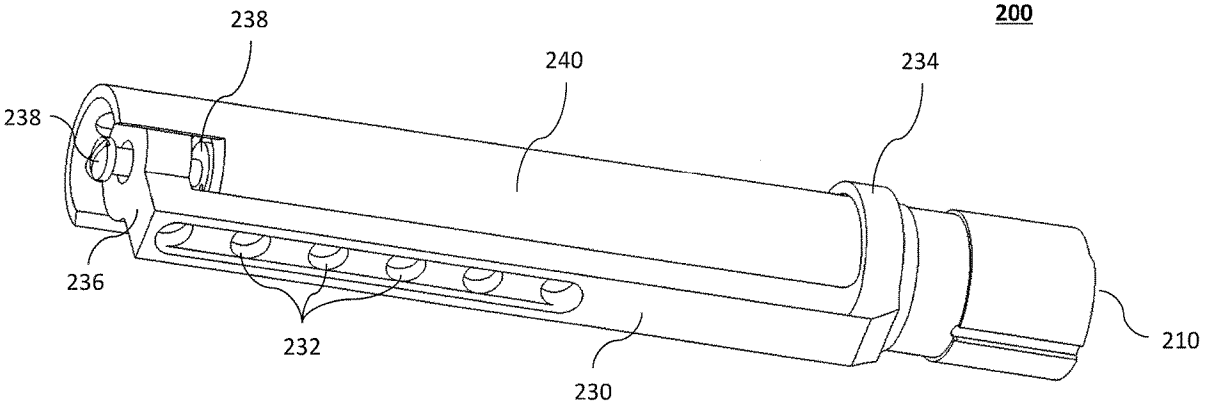
FIG. 2*a* illustrates a perspective view of a recoil mitigation and buttstock floating (RMBF) device in accordance with an aspect of the present invention.
Figure 2B:
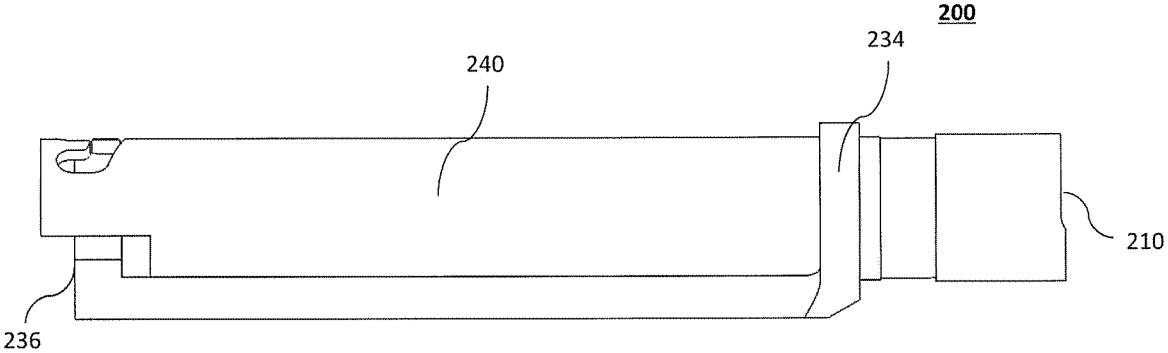
FIG. 2*b* illustrates a side view of the RMBF device of FIG. 2*a*.

Turning to the figures, FIGS. 2*a* and 2*b* illustrate an embodiment of the (Floating buffer tube) RMBF device 200 configured to axially rotate the buttstock securing mechanism 230 (and any buttstock slideably coupled thereto) about the tube portion 240 without modification to the firearms firing mechanism. Such RMBF devices 200 may be axially adjusted while constantly maintaining proper shoulder position. When assembled, the open end 210 couples with a firearm by, for example, threading, or another securing means. The RMBF device 200 may be coupled to AR-15-style firearms without the need to modify the firearm or the collapsible buttstock. However, the buffer tube is not limited in use for AR-15-style firearms; it may be used for several types of carbines, shotguns, and rifles that do not require a buffer tube. The buffer tube is also not limited to use on collapsible buttstocks; it may be used on fixed buttstocks or the like. For example, there are several commercially available adapters that allow buffer tubes to be attached to shotguns or carbines which allow attachment of the buffer tubes to those firearms.

As illustrated, the RMBF device 200 comprises a rotating buttstock securing mechanism 230 (e.g., a protruding guide), which comprises an annular, rotating engagement portion 234 configured to rotate around tube portion 240 and secure the gun side end of the buttstock securing mechanism 230 to the tube portion 240. The rotating engagement portion 234 may be, for example, annular, ring sized, and configured to surround the tube portion 240. Engagement means 232 (e.g., blind holes) may be configured to engage with one or more pins positioned on the buttstock, thereby enabling the buttstock to telescope along the buffer tube, and rotating end portion 236. Bolt 238 secures the rotating end portion 236 (and therefore the entire buttstock securing mechanism 230) to tube portion 240. The protruding feature of the buttstock securing mechanism 230 is sized and configured to fit within a corresponding channel of a buttstock, which prevents axial rotation of the buttstock vis-à-vis the buttstock securing mechanism 230 (but enables axial rotation with respect to tube portion 240). As will be described, a recoil spring and a recoil buffer may be housed within tube portion 240.

The helical spring 340's outside diameter may range in size form 10% to 90% of the buffer tube outside diameter, or in this example, from about 0.115" to 1.035", more preferably, about 0.668". The inside diameter of the helical spring 340 can range from 8% to 88% of the outside diameter of the buffer tube of in this example from 0.092" to 1.012", more preferably about 0.5". The helical spring 340's spring constant can range from 1 lb/in to 350 lb/in, more preferably about 120 lb/in.

The shoulder bolt can range in diameter from 0.02" to 0.9", more preferably about 0.219". The outside diameter of the floating rail pivot can range from 0.08" to 1.00", more preferably about 0.93". The inside diameter of the secondary buffer tube can range from 0.08" to 1.00", more preferably about 0.938". Rotation of floating buffer tube or the included angle the rail can rotate within range from 0° to 180°, and is, more preferably about 90°, the retaining ring outside diameter can range from 105% (1.2075") of the outside diameter of the buffer to 200% (2.3") of the outside diameter of the buffer tube, more preferably about 119% (1.374") of the outside diameter of the buffer tube. The range of axial travel the floating rail can have is 0.125" to 4", more preferably about 0.5", the shoulder screw that sets the angle diameter range is 0.025" to 0.5", more preferably about 0.25".

The various components of the RMBF device 200, and later-described RMBF adapter mechanisms, may be fabricated from, for example, metal/metal alloys (e.g., 7075 T6 aluminum alloy, 4150 chrome-moly steel, 6061 aluminum, 4140 steel, 8620 steel, 4140 steel, stainless steels, tool steel, Brass and Copper alloys, etc., or resins (i.e., high-strength plastic). However, the buttstock may be formed from additional materials, including, for example, wood, fiberglass, carbon fiber, and the like.

Figure 3B:
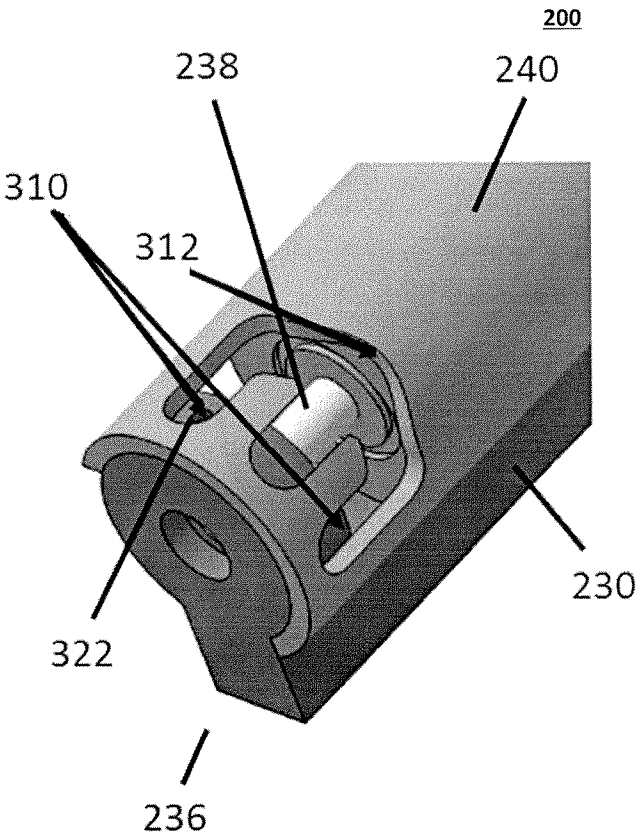
FIG. 3*b* illustrates a perspective view of the RMBF device mechanism.
Figure 3A:
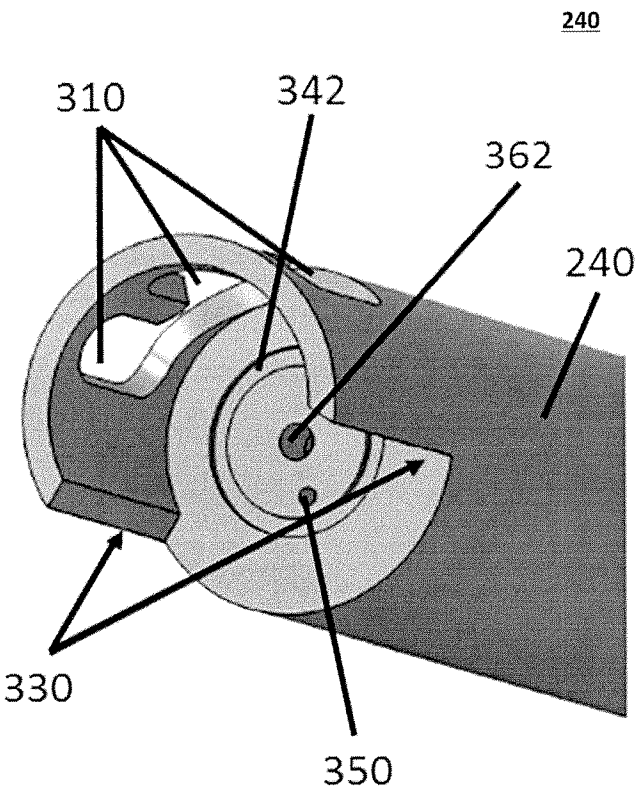
FIG. 3*a* illustrates a perspective view of a RMBF device mechanism's tube portion.
Figure 3D:
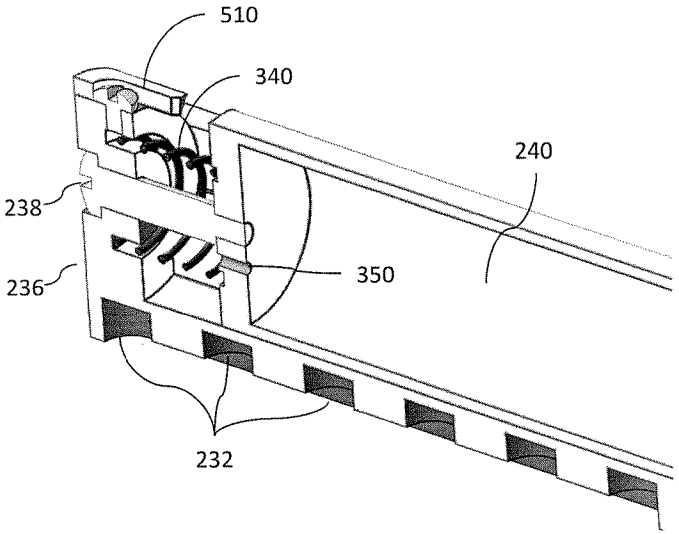
FIG. 3*d* illustrates a second cross-sectional view of the RMBF device mechanism of FIG. 3*b*.
Figure 3C:
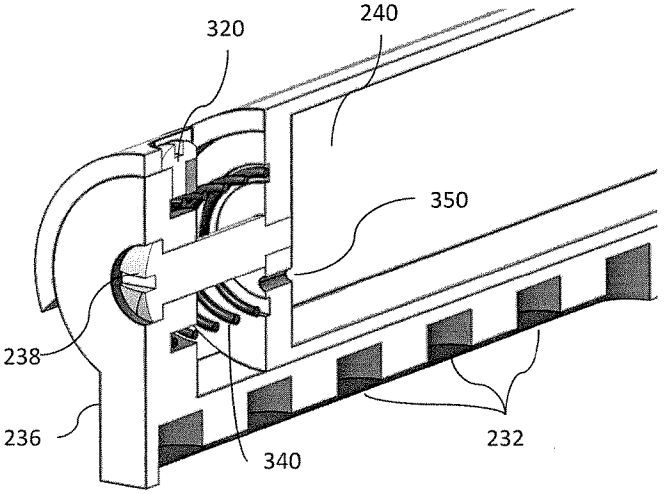
FIG. 3*c* illustrates a first cross-sectional view of the RMBF device mechanism of FIG. 3*b*.
Figure 3F:
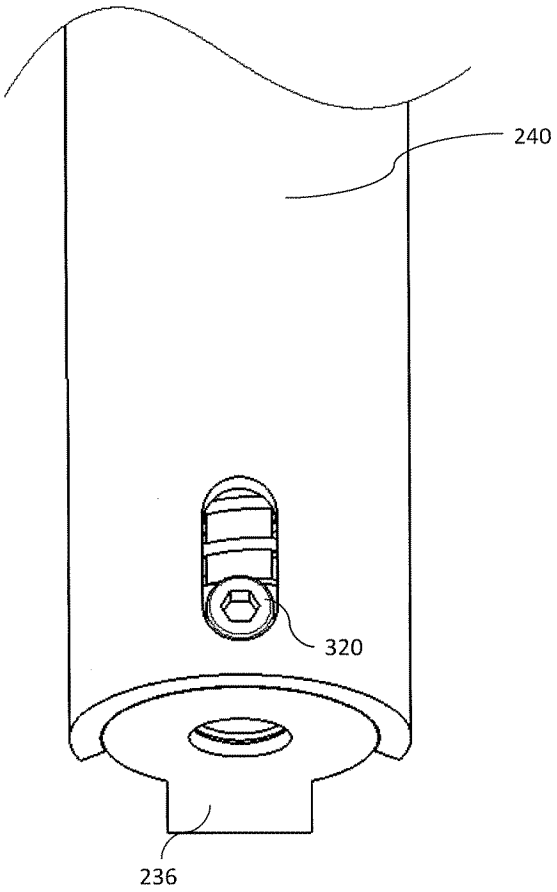
FIG. 3*f* illustrates a top perspective view of the RMBF device mechanism having only a single axial adjustment position.
Figure 3E:
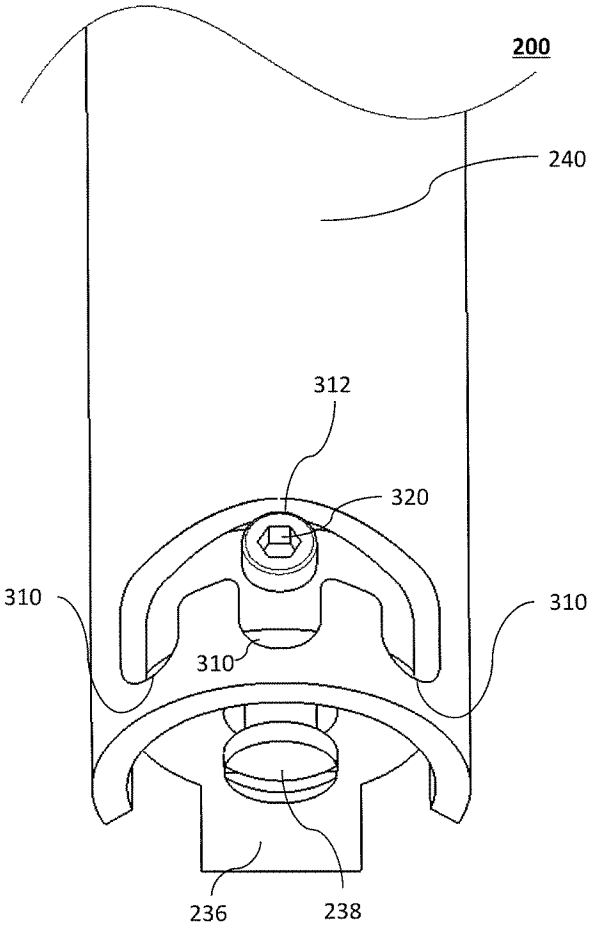
FIG. 3*e* illustrates a top perspective view of the RMBF device mechanism of FIG. 3*b*.

To better understand the relative movement of the buttstock securing mechanism 230 relative to tube portion 240, refer to FIGS. 3*a* through 3*g*. As illustrated in FIG. 3*b* and FIG. 2*a*, the buttstock securing mechanism 230 and the tube portion 240 can move relative to one another in two directions: (i) buttstock securing mechanism 230 can slide along tube portion 240 until either the head of bolt 238 collides with the wall of rotating end portion 236 for a maximum extension (rest), or until helical spring 340 (recoil spring) is at maximum compression (buttstock securing mechanism 230 being "pushed in") and (ii) buttstock securing mechanism 230 can axially rotate relative to tube portion 240 until buttstock securing mechanism 230 collides with tube walls 330, which occurs at maximum counterclockwise and clockwise axial angles.

At rest, helical spring 340 imparts a force to push buttstock securing mechanism 230 away from spring securing groove 342 in the closed end of tube portion 240, which in turn pushes bolt 320 into one of the angle selection grooves 310 of an angle guide selector, thereby fixing the axial angle of the firearm relative to the buttstock. For instance, FIG. 3*b* illustrates a RMBF device 200 having three axial angle positions (and, accordingly, three angle selection grooves 310): a center position; a 45° counterclockwise position; and a 45° clockwise position. However, pulling the firearm toward the user with the buttstock affixed to the user's shoulder compresses helical spring 340 and moves bolt 320 out of the selected angle selection grooves 310 such that the axial angle of the buttstock relative to the firearm can be changed by applying torque on the firearm, thus rotating the buttstock securing mechanism 230 around bolt 238. As will be appreciated, the helical spring 340 can serve at least two functions: first, it provides recoil mitigation by absorbing energy imparted during firing, and second, it imparts a force to ensure that the firearm remains in a designated angle selection groove 310. Tube walls 330 at the closed end of tube portion 240 may serve as limits to the rotation. When the desired angle is achieved, the user can discontinue pulling the firearm into his shoulder to allow the helical spring 340 to expand, thereby causing the bolt 320 to engage with a desired angle selection groove 310 closest to the user's desired axial angle and locking that, or a similar, axial angle in place.

Indeed, helical spring 340 serves the function as a secondary recoil spring, but it should have a high spring constant such that when the firearm is fired (and when recoil pushes the firearm into the user), the helical spring 340 does not compress such that the firearm unintentionally floats (i.e., in this case, changes axial angle positions). Thus, the helical spring 340 should be capable of being compressed (overcome) by the operator so as to adjust the axial angle position. For example, the helical spring 340 is described above, but the range for the non-rotating and impact mitigation only (e.g., FIG. 3*f*) may be higher and may go up to 500 lb/in, especially on larger caliber firearms.

Unintentional floating, whether lateral or axial, can cause confusion, belief of malfunction, and poor accuracy, all of which are undesirable during a gunfight. In some aspects, helical spring 340 may be substituted with a hydraulic buffer, or any elastic material or device capable of deforming when force is applied and restoring its original form when the deforming force is removed.

Figure 3G:
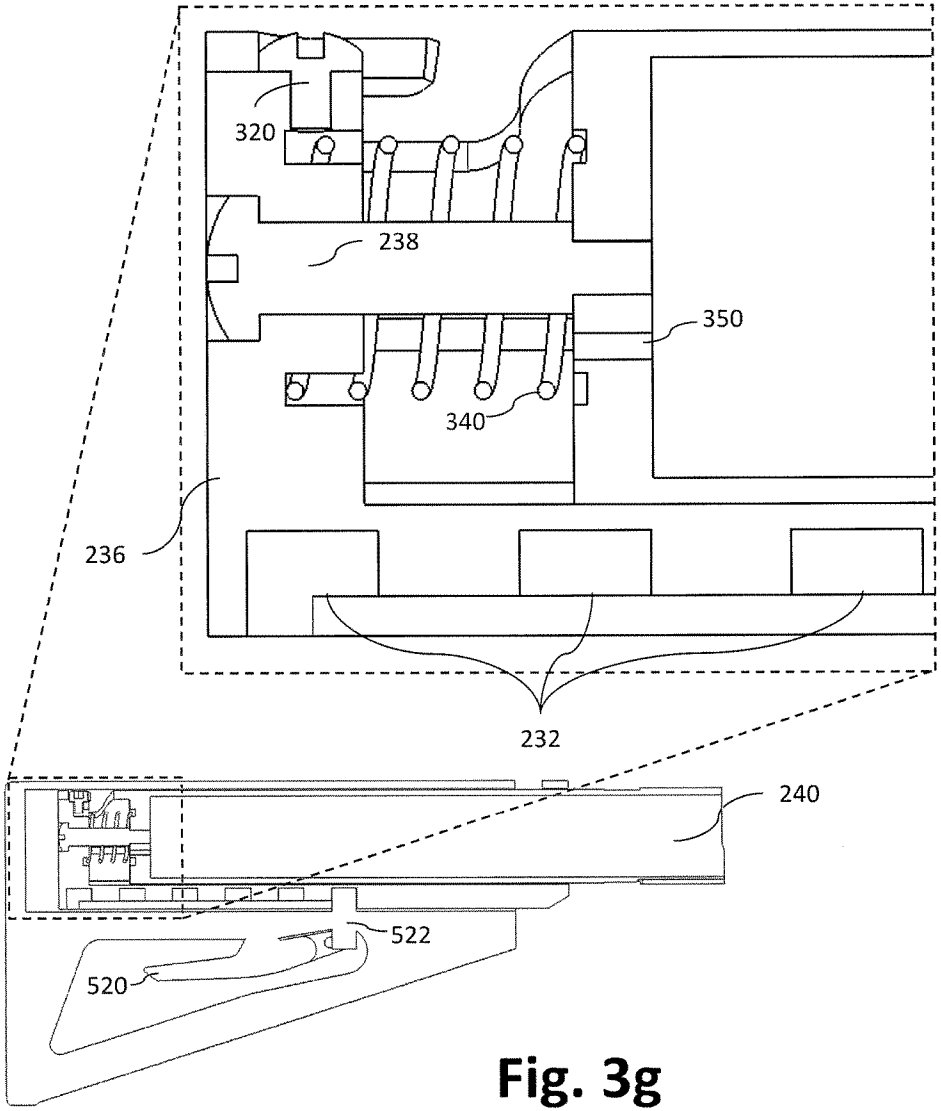
FIG. 3*g* illustrates an exploded cross-sectional view of the RMBF device mechanism of FIG. 3*b*.

The angle selection grooves 310 may be designed such that when the user floats the buttstock (e.g., axially releases the buttstock), the guide naturally brings the buttstock back to the "default" groove (i.e., about 0°), such that the angle would be the same or similar to a normally attached, conventional buttstock. An example guiding mechanism 312 that naturally brings the buttstock back to the "default" groove can be seen in FIG. 3*b* as a curve in the angle guide selector opposite the center groove of said angle selection grooves 310. For clarity, FIG. 3*g* illustrates an exploded, cross-sectional view of the RMBF device (or mechanism) of FIG. 3*b*. While FIGS. 3*a* through 3*d* illustrate an example with multiple angle selection grooves 310, in contrast, FIG.

3*f* illustrates a configuration that provides only recoil mitigation and does not provide angle selection.

Figure 4C:
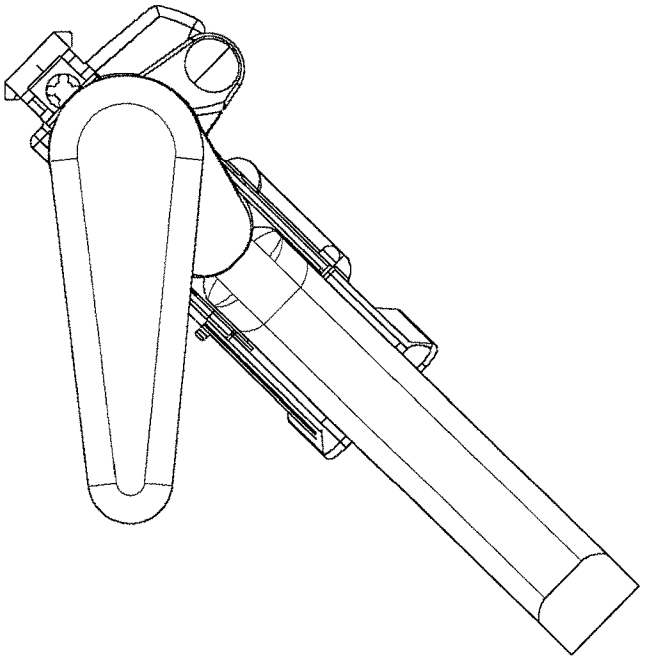
FIG. 4*c* illustrates a rear view of a firearm embodying the RMBF device mechanism of FIGS. 4*a* and 4*b* in a rotated position.
Figure 4B:
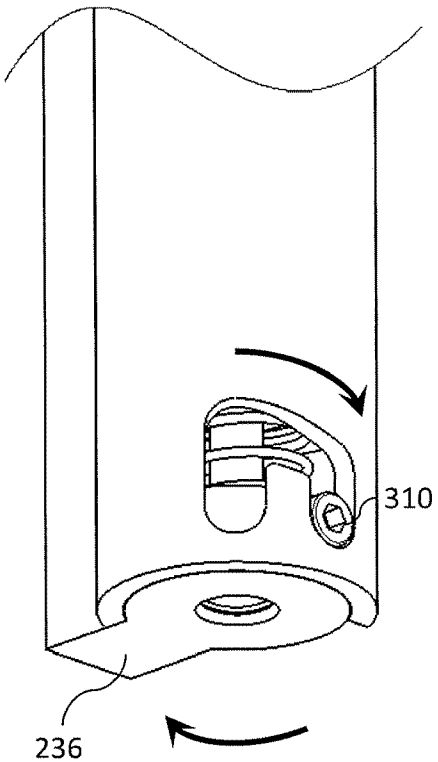
FIGS. 4*a* and 4*b* illustrate a top perspective view of a first RMBF device mechanism having two axial adjustment positions.
Figure 4A:
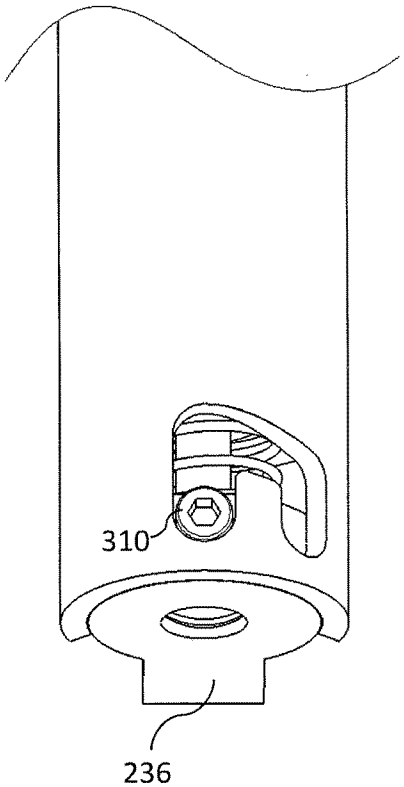
Figure 5C:
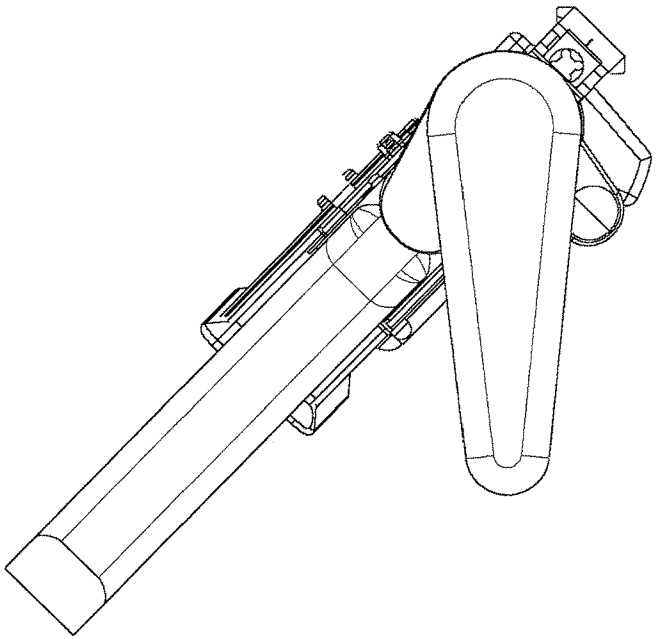
FIG. 5*c* illustrates a rear view of a firearm embodying the RMBF device mechanism of FIGS. 5*a* and 5*b* in a rotated position.
Figure 5B:
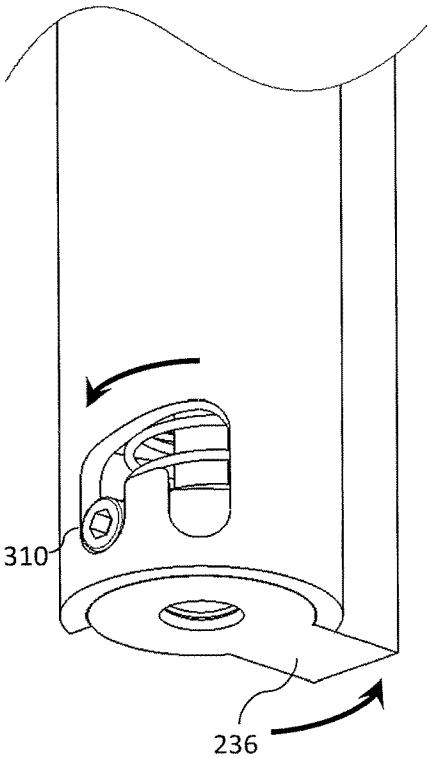
FIGS. 5*a* and 5*b* illustrate a top perspective view of a second RMBF device mechanism having two axial adjustment positions.
Figure 5A:
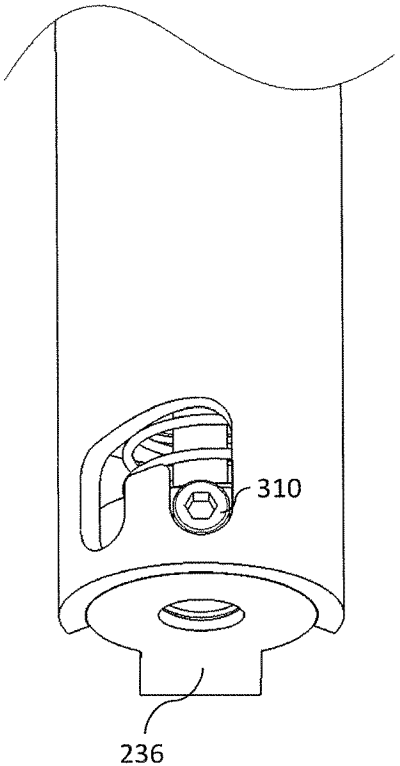

While the RMBF device shows only three angle selection grooves 310, any reasonable number of angle selection grooves can be used, such as two, three, four, five, six, seven, eight, nine, or ten. The placement and size of these grooves determine the angles to which the buttstock can be axially rotated relative to the firearm. For example, FIGS. 4*a* through 4*c* illustrate an embodiment that employs two angle selection grooves 310, where the user may alternate between a vertical position and a 45° clockwise rotation of the firearm, while maintaining the buttstock in the vertical position. Conversely, FIGS. 5*a* through 5*c* illustrate a second embodiment that employs two selection angle selection grooves 310; however, in this configuration, the user may alternate between a vertical position, and a 45° counterclockwise rotation of the firearm, while maintaining the buttstock in the vertical position.

Figure 6B:
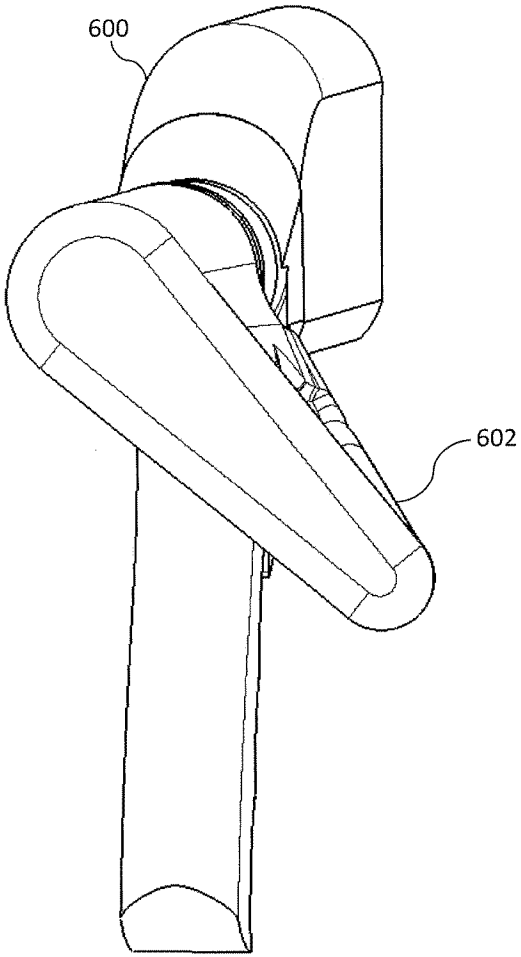
FIG. 6*b* illustrates a rear perspective view of a first firearm embodying the RMBF device mechanism having three axial adjustment positions in the first axially rotated position.
Figure 6A:
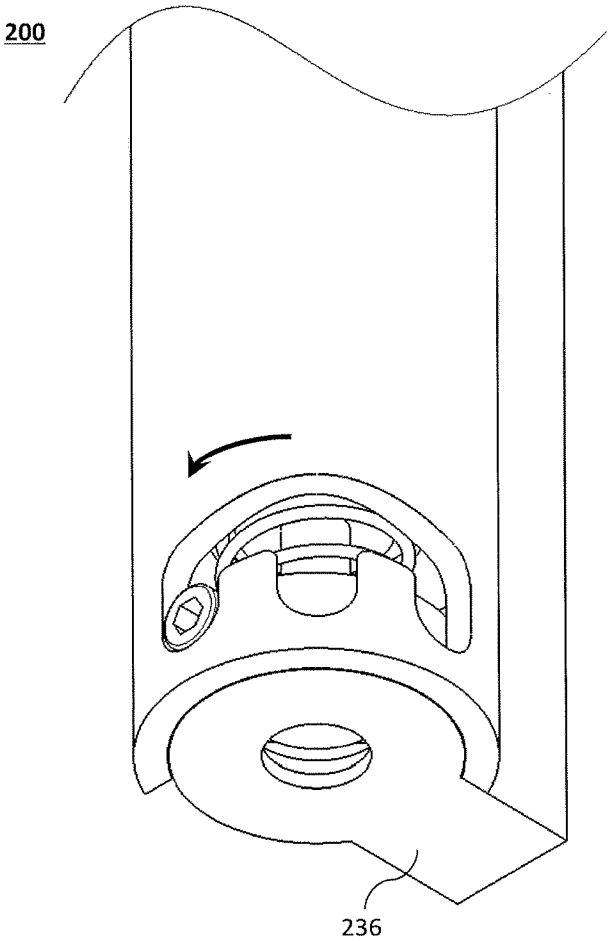
FIG. 6*a* illustrates a top perspective view of a RMBF device mechanism having three axial adjustment positions in a first axially rotated position.

Referring to FIGS. 6*a* through 6*f*, FIGS. 7*a* through 7*f*, and FIGS. 8*a* through 8*f*, several floating angles (axial angles) are illustrated as applied to firearm 600. Specifically, FIG. 6*a* illustrates a top perspective view of a RMBF device 200 having three axial adjustment positions, but set to a first axially rotated position, while FIG. 6*b* illustrates a rear perspective view of the RMBF device 200 in the first axially rotated position coupled with a firearm 600. For example, as illustrated in FIG. 6*d*, the first axially rotated position may be configured such that the buttstock 602's center line (X) is rotated 45° counterclockwise, with reference to the firearm's center line (Y).

Figure 14O:
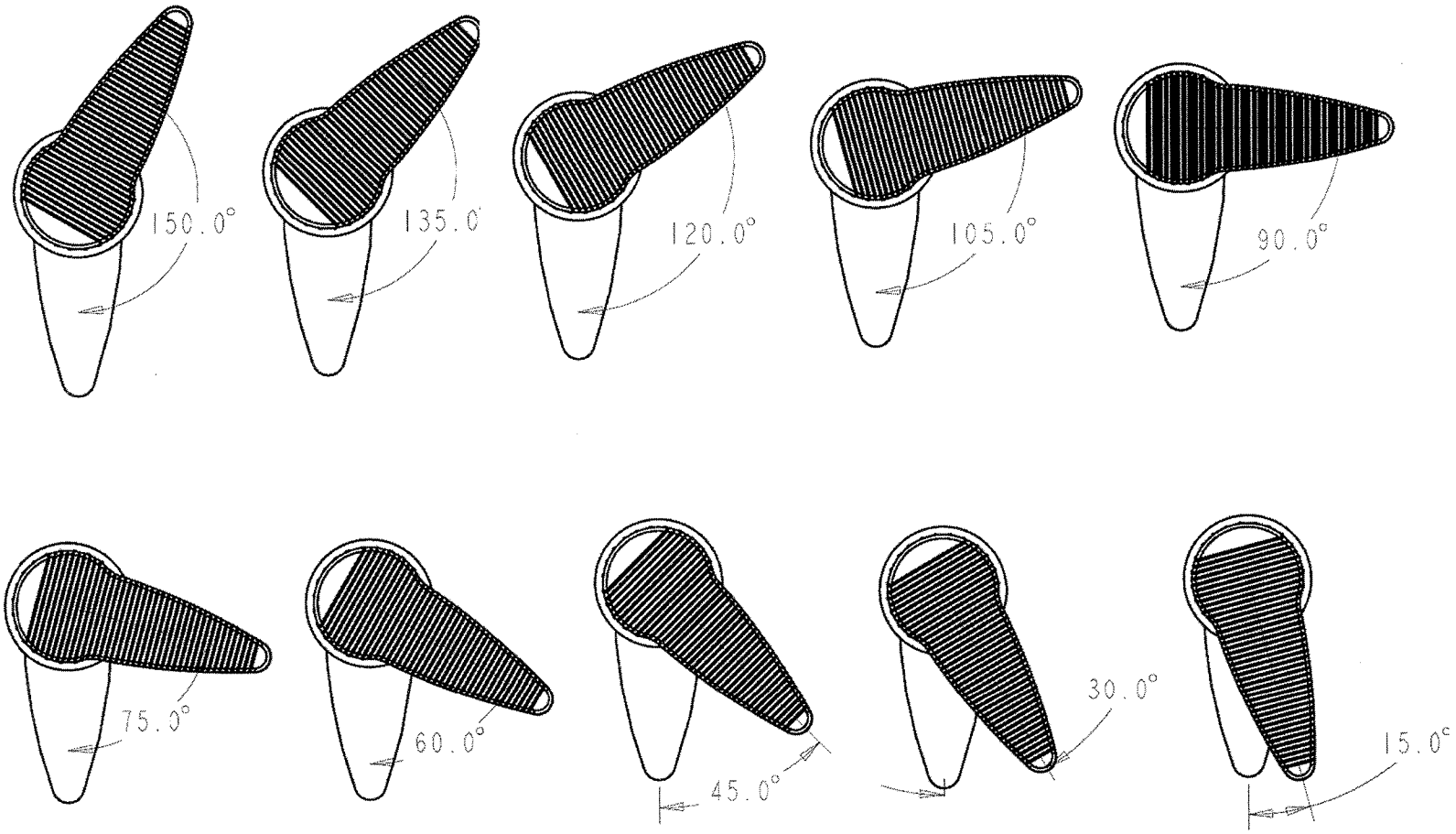

While 45° is used for the various examples, one of skill in the art would recognize that other angles are possible. In fact, as will be discussed with regard to FIGS. 24*a*-24*i* and 25*a*-25*d*, the buttstock 602 may be configured to perform a full rotation (360°); however, a range between 0° and 90° (clockwise and counterclockwise from the firearm's center line) would be suitable for most scenarios. Indeed, FIGS. 14*a* through 14*o* illustrate a rear view of a RMBF device mechanism (or a RMBF adapter mechanism, as will be described below) configured in various axial angle positions. Specifically, FIGS. 14*a* through 14*n* illustrate clockwise axial angle positions of 0° (e.g., a default upright position), 15°, 30°, 45°, 60°, 75°, 90°, 105°, 120°, 135°, 150°, 165°, 180°, 195° (i.e., 165° counterclockwise). While the various axial angle positions of FIGS. 14*a* through 14*n* are illustrated as being rotated in a clockwise rotation, the same may be accomplished in a counterclockwise rotation as illustrated in FIG. 14*o*.

Figure 6D:
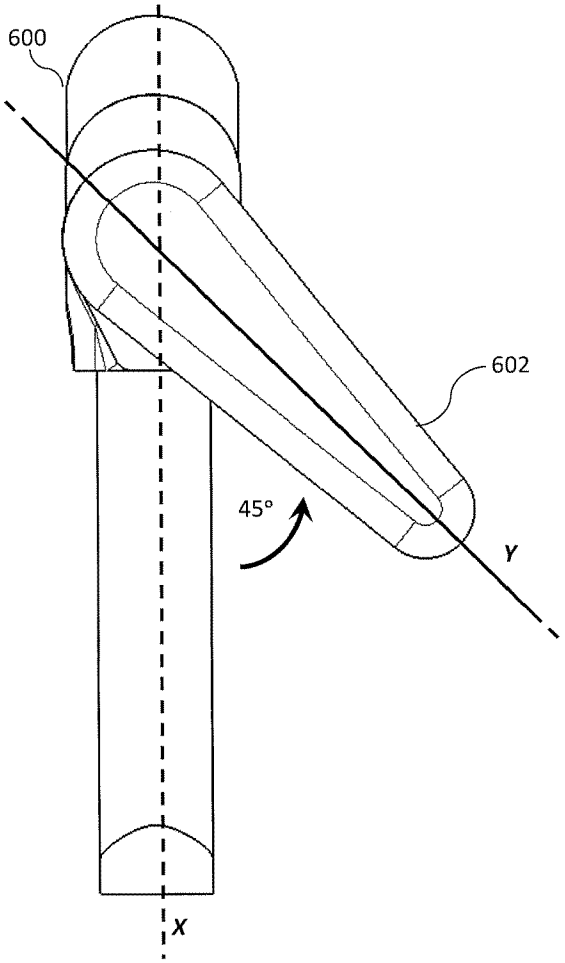
FIG. 6*d* illustrates a rear view of the firearm of FIG. 6*b* with the buttstock installed.
Figure 6C:
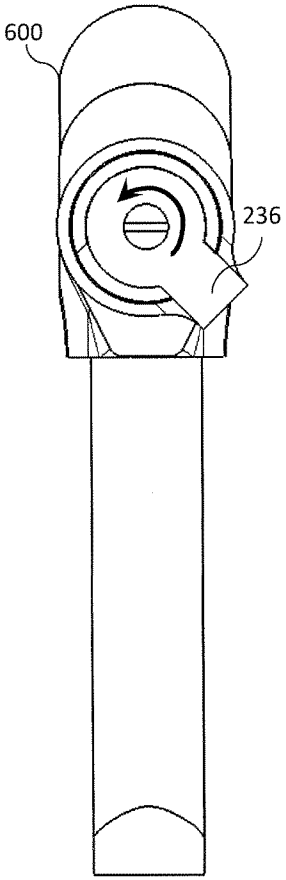
FIG. 6*c* illustrates a rear view of the firearm of FIG. 6*b* with the buttstock removed.
Figure 6E:
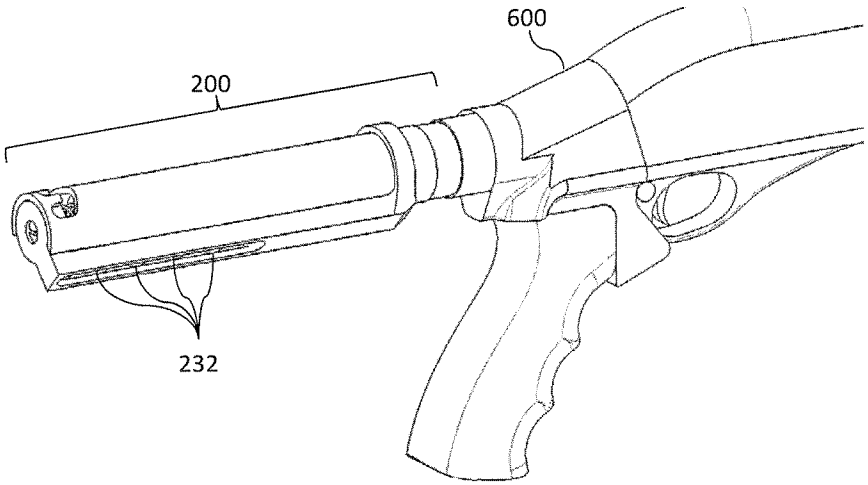
FIG. 6*e* illustrates a side perspective view of the firearm of FIG. 6*b* with the buttstock removed.
Figure 6F:
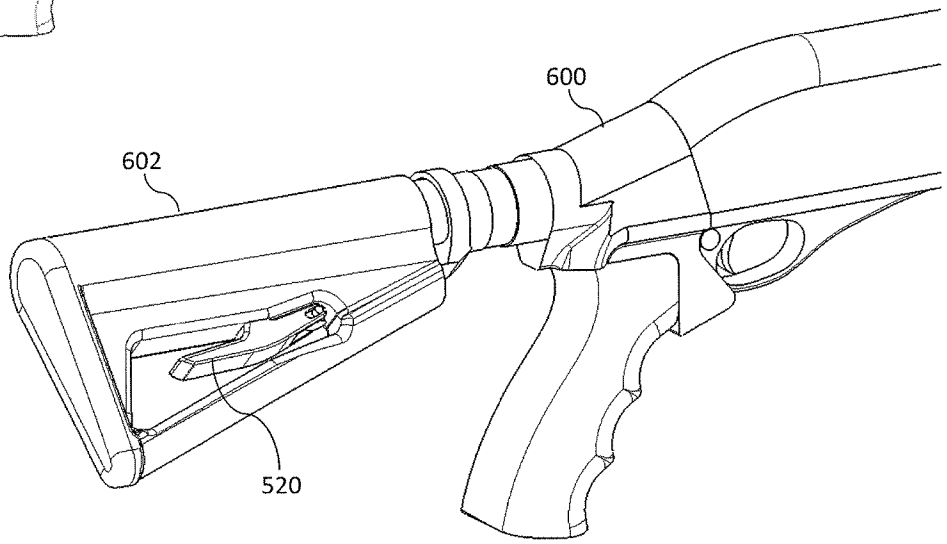
FIG. 6*f* illustrates a side perspective view of the firearm of FIG. 6*b* with the buttstock installed.

For clarity, FIG. 6*c* illustrates a rear view of the firearm 600 with the buttstock 602 removed, while FIG. 6*d* illustrates a rear view of the firearm 600 with the buttstock 602 installed. FIGS. 6*e* and 6*f* illustrate side perspective views of the firearm 600 with the buttstock 602 removed and installed. As best illustrated in FIGS. 6*e* and 6*f*, the buttstock 602 slides over tube portion 240, and, as discussed above, a recoil spring and a recoil buffer may fit within tube portion 240. A plurality of engagement means 232 interact with pin 522. Lever 520 can be pressed to remove pin 522 from engagement means 232, thereby allowing the telescoping portion of the buttstock 602 to slide down the tube portion 240. The lever 520 can then be released such that the bolt then reengages an engagement means 232. A safety may further be provided to prevent accidental rotation of buttstock 602.

Figure 7B:
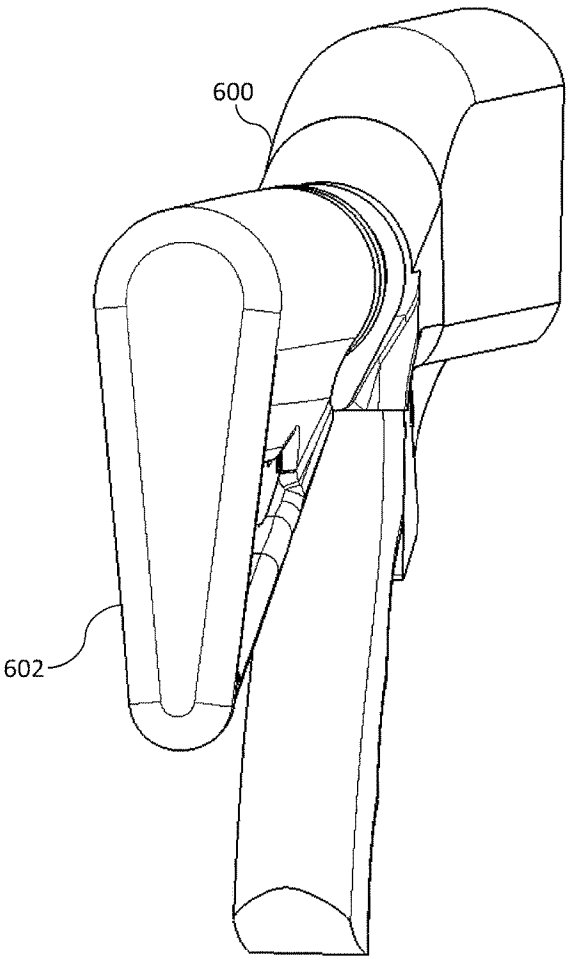
FIG. 7*b* illustrates a rear perspective view of a first firearm embodying the RMBF device mechanism having three axial adjustment positions in the default upright position.
Figure 7A:
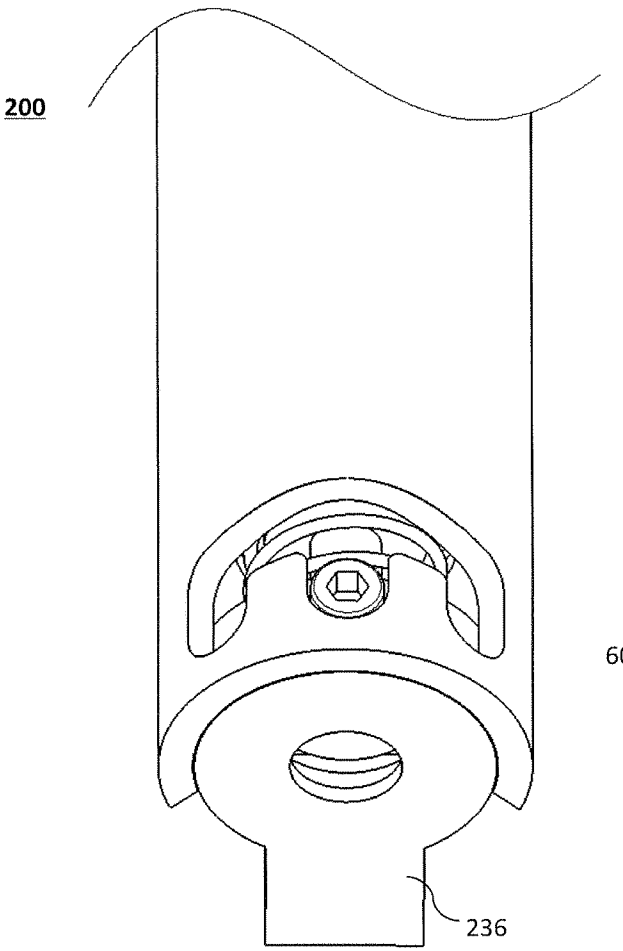
FIG. 7*a* illustrates a top perspective view of the RMBF device mechanism having three axial adjustment positions in a default upright position.
Figure 7D:
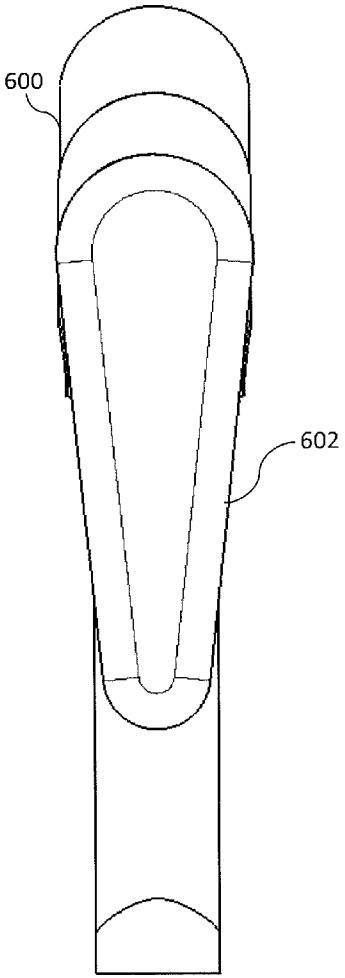
FIG. 7*d* illustrates a rear view of the firearm of FIG. 7*b* with the buttstock installed.
Figure 7C:
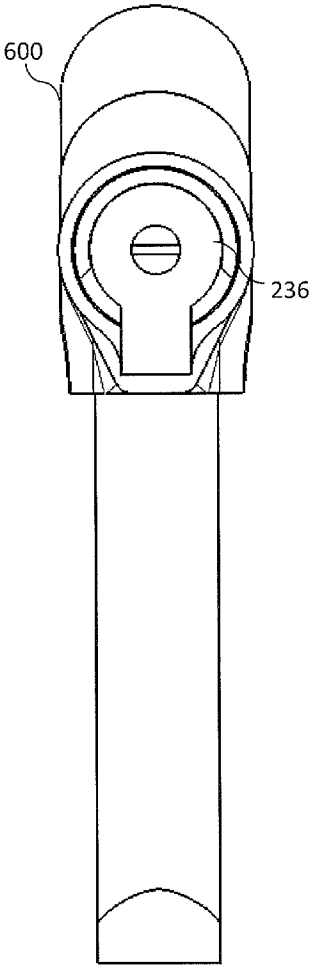
FIG. 7*c* illustrates a rear view of the firearm of FIG. 7*b* with the buttstock removed.
Figure 7E:
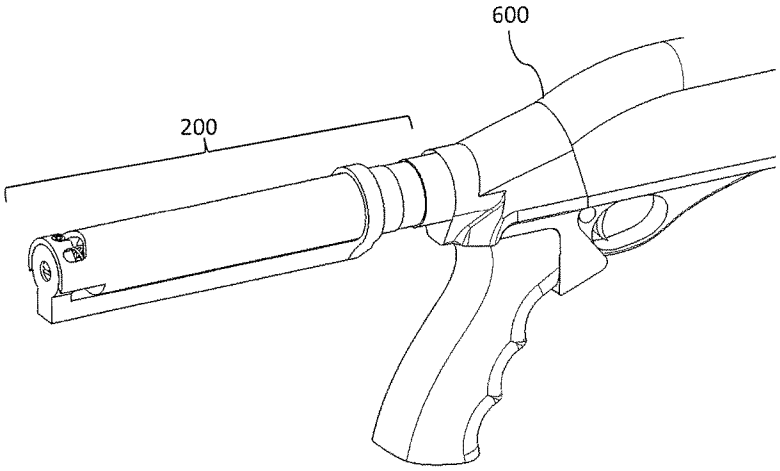
FIG. 7*e* illustrates a side perspective view of the firearm of FIG. 7*b* with the buttstock removed.
Figure 7F:
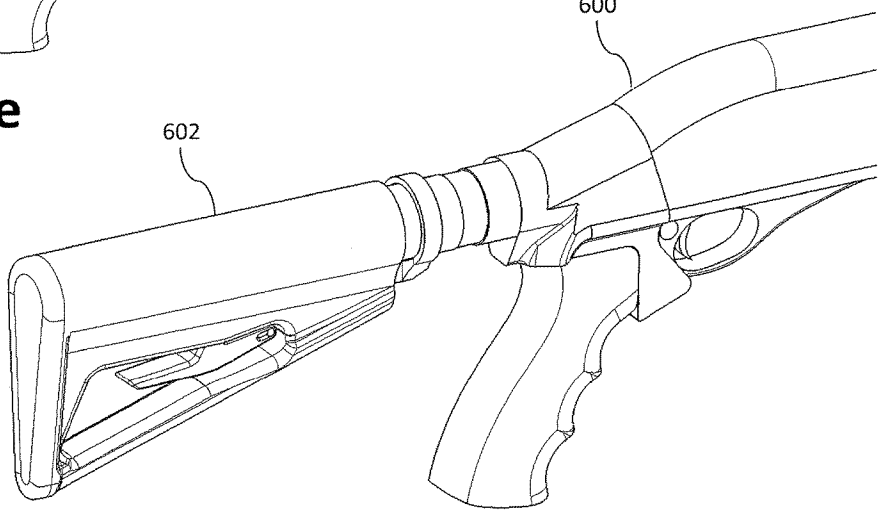
FIG. 7*f* illustrates a side perspective view of the firearm of FIG. 7*b* with the buttstock installed.

FIG. 7*a* illustrates a top perspective view of a RMBF device 200 having three axial adjustment positions, but set to a default upright position, while FIG. 7*b* illustrates a rear perspective view of the RMBF device 200 in the default upright position coupled with a firearm 600. For clarity, FIG. 7*c* illustrates a rear view of the firearm 600 with the buttstock 602 removed, while FIG. 7*d* illustrates a rear view of the firearm 600 with the buttstock 602 installed. FIGS. 7*e* and 7*f* illustrate side perspective views of the firearm 600 with the buttstock 602 removed and installed.

Figure 8B:
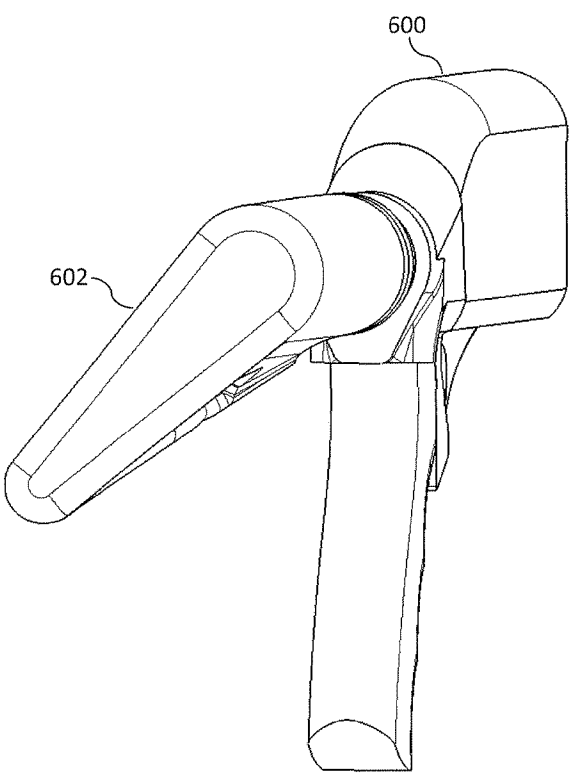
FIG. 8*b* illustrates a rear perspective view of a first firearm embodying the RMBF device mechanism having three axial adjustment positions in the second axially rotated position.
Figure 8A:
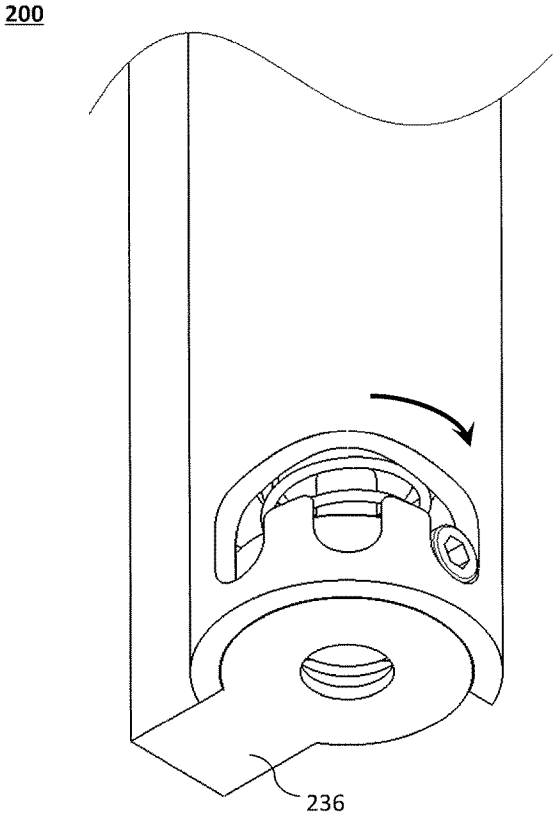
FIG. 8*a* illustrates a top perspective view of a RMBF device mechanism having three axial adjustment positions in a second axially rotated position.
Figure 8D:
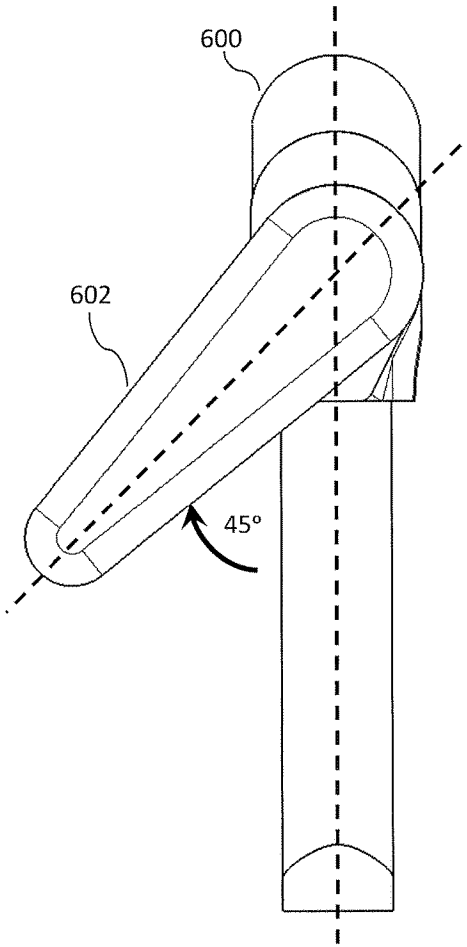
FIG. 8*d* illustrates a rear view of the firearm of FIG. 8*b* with the buttstock installed.
Figure 8C:
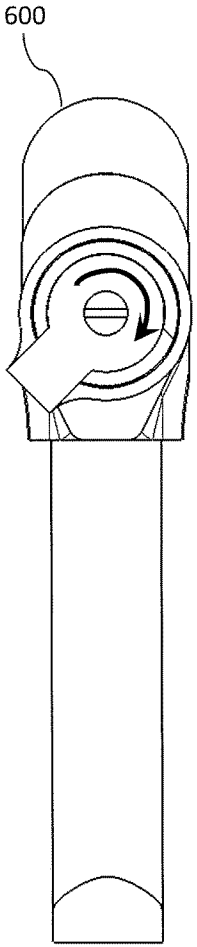
FIG. 8*c* illustrates a rear view of the firearm of FIG. 8*b* with the buttstock removed.
Figure 8E:
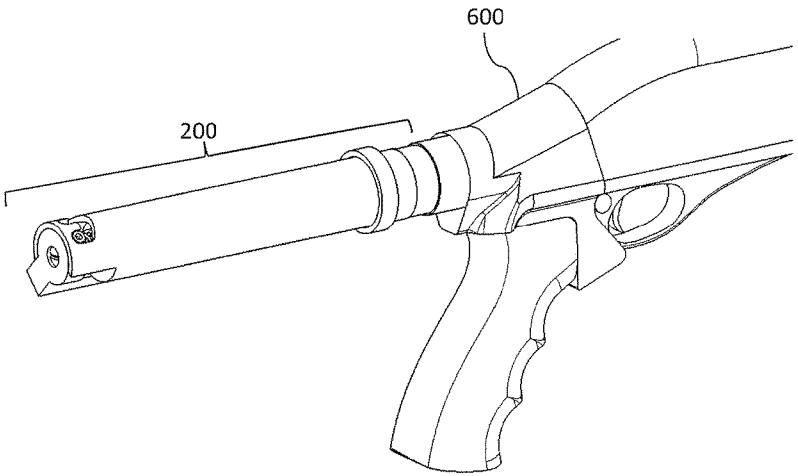
FIG. 8*e* illustrates a side perspective view of the firearm of FIG. 8*b* with the buttstock removed.
Figure 8F:
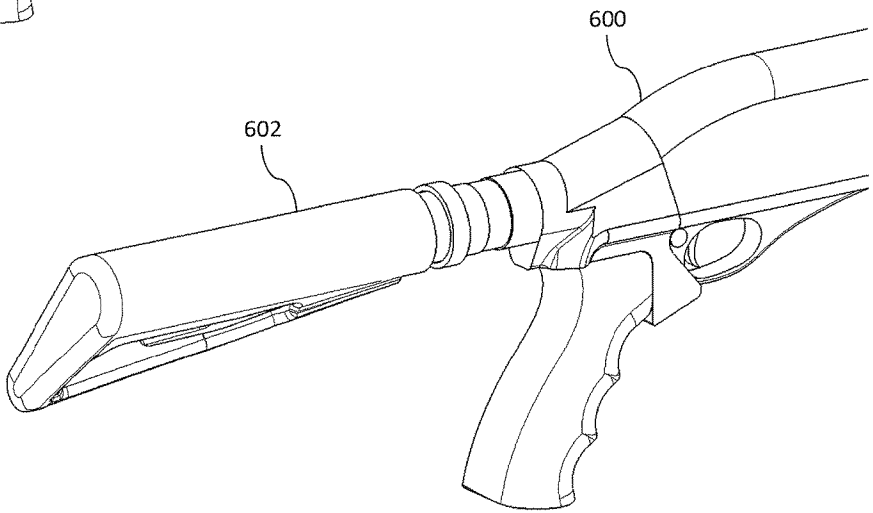
FIG. 8*f* illustrates a side perspective view of the firearm of FIG. 8*b* with the buttstock installed.

FIG. 8*a* illustrates a top perspective view of a RMBF device 200 having three axial adjustment positions, but set to a second axially rotated position, while FIG. 8*b* illustrates a rear perspective view of the RMBF device 200 in the second axially rotated position coupled with a firearm 600. For clarity, FIG. 8*c* illustrates a rear view of the firearm 600 with the buttstock 602 removed, while FIG. 8*d* illustrates a rear view of the firearm 600 with the buttstock 602 installed. FIGS. 8*e* and 8*f* illustrate side perspective views of the firearm 600 with the buttstock 602 removed and installed.

Figure 9A:
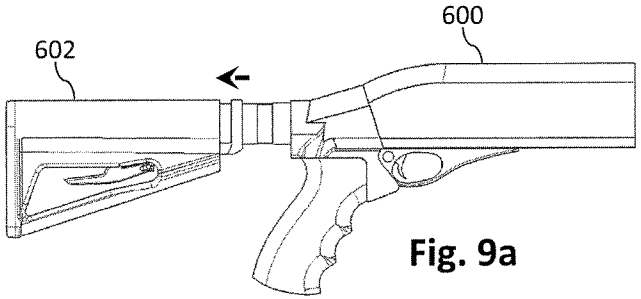
FIGS. 9*a* through 9*f* illustrate side views of the first firearm embodying the RMBF device mechanism during various stages of lateral extension.
Figure 9B:
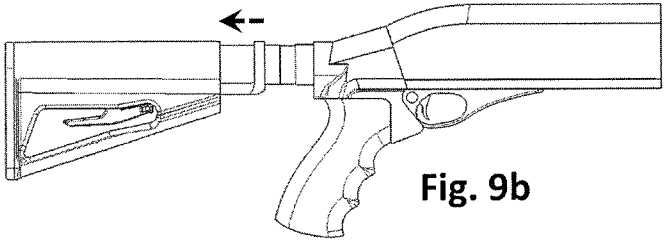
Figure 9C:
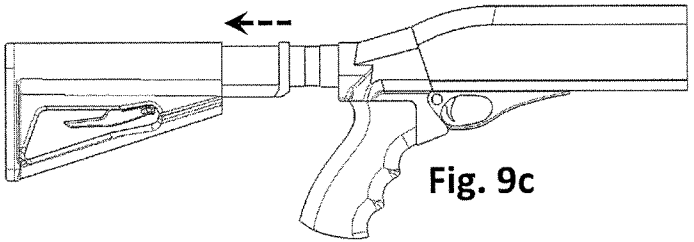
Figure 9D:
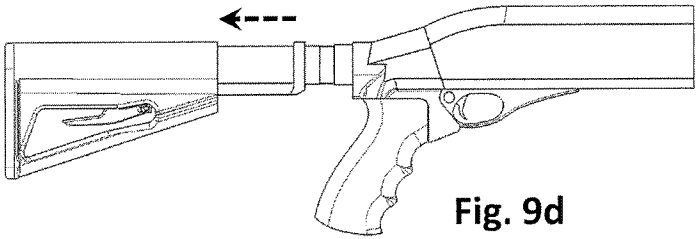
Figure 9E:
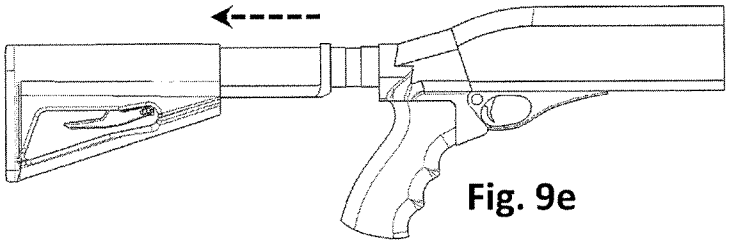
Figure 9F:
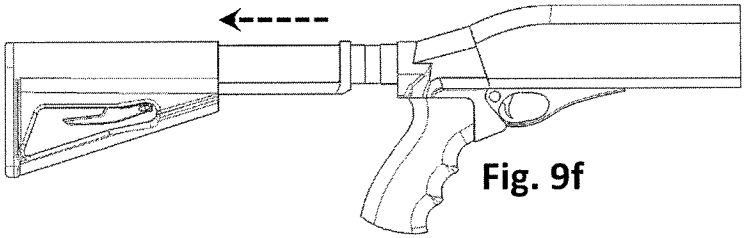

FIGS. 9*a* through 9*f* illustrate side views of the firearm 600 embodying the RMBF device 200 during various stages of lateral extension. As noted above, a collapsible buttstock may employ more than one length setting, thus allowing the buttstock to be adjusted for different users. Specifically, FIG. 9*a* illustrates a compact setting (most collapsed), while FIG. 9*f* illustrates the longest setting (most extended).

Figure 10B:
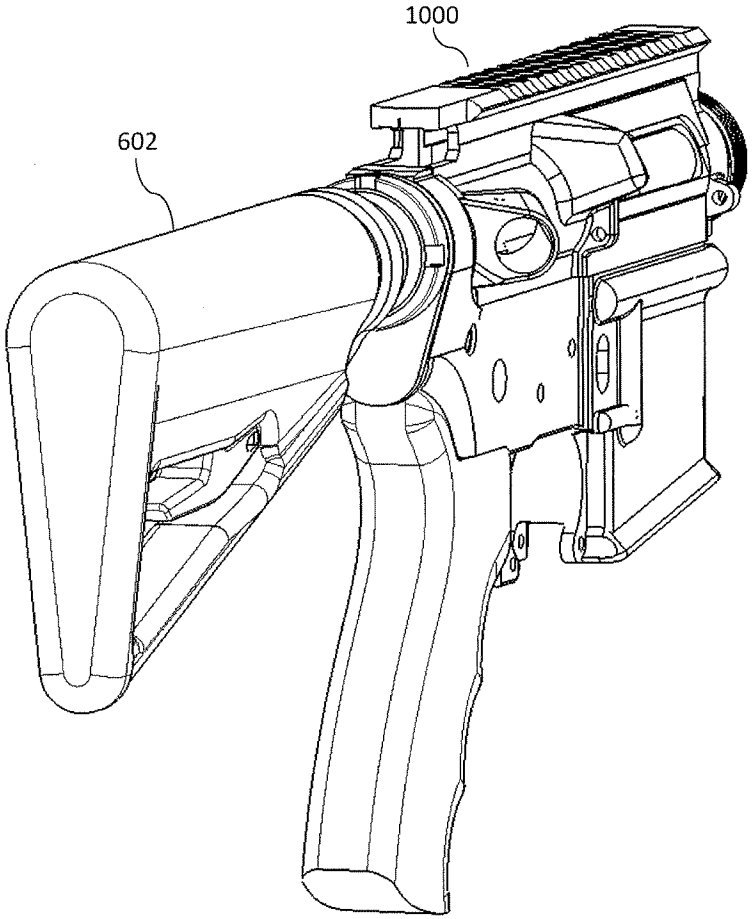
FIG. 10*b* illustrates a rear perspective view of a second firearm embodying the RMBF device mechanism having three axial adjustment positions in the default upright position.
Figure 10A:
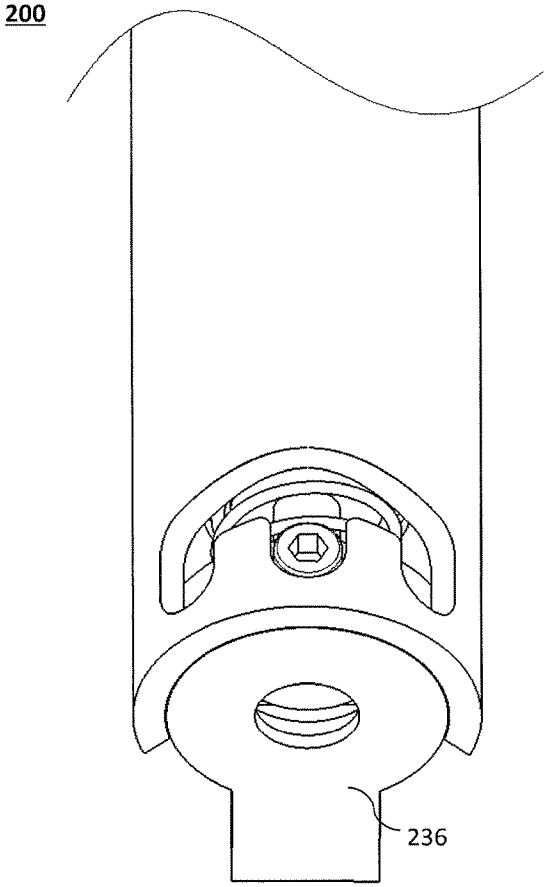
FIG. 10*a* illustrates a top perspective view of a RMBF device mechanism having three axial adjustment positions in a default upright position.
Figure 10D:
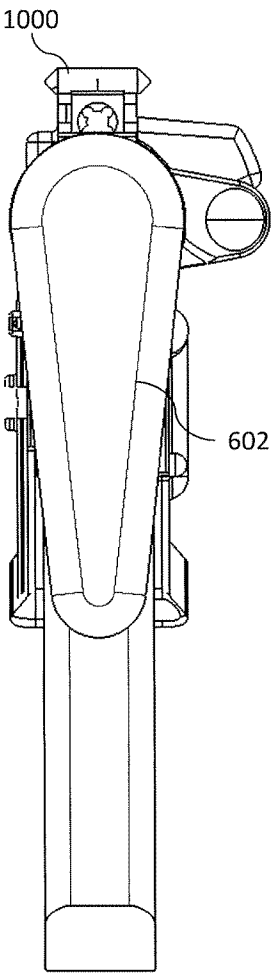
FIG. 10*d* illustrates a rear view of the firearm of FIG. 10*b* with the buttstock installed.
Figure 10C:
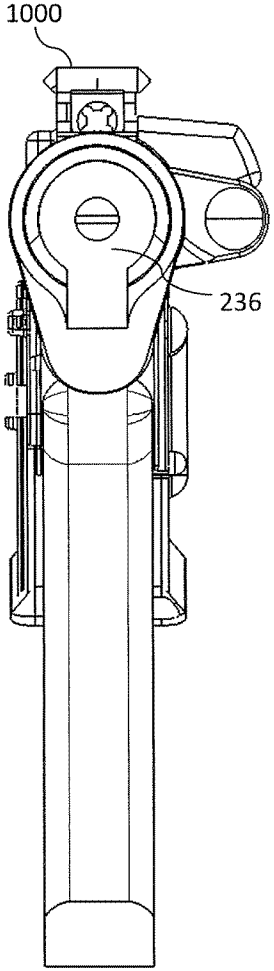
FIG. 10*c* illustrates a rear view of the firearm of FIG. 10*b* with the buttstock removed.
Figure 10E:
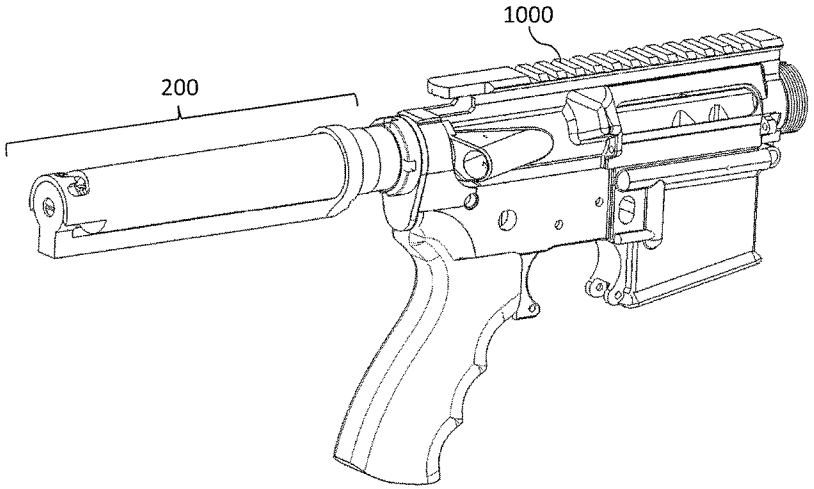
FIG. 10*e* illustrates a side perspective view of the firearm of FIG. 10*b* with the buttstock removed.
Figure 10F:
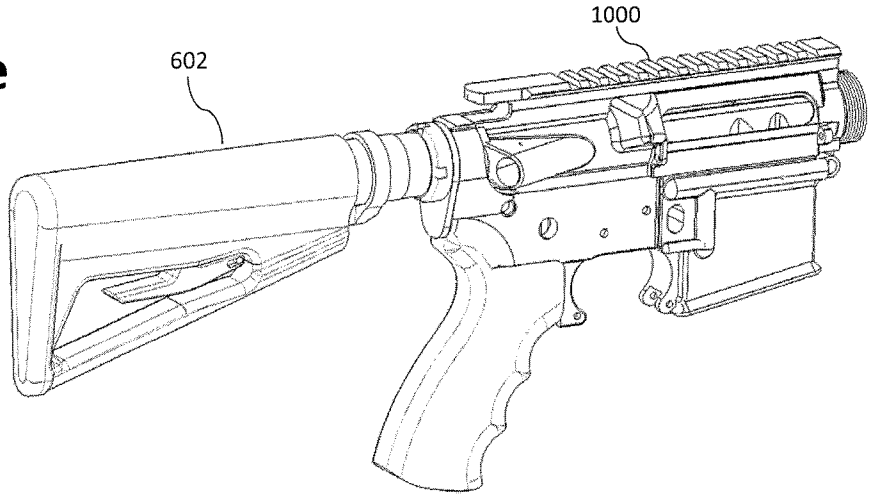
FIG. 10*f* illustrates a side perspective view of the firearm of FIG. 10*b* with the buttstock installed.

Referring to FIGS. 10*a* through 10*f*, FIGS. 11*a* through 11*f*, and FIGS. 12*a* through 12*f*, several floating angles (axial angles) are illustrated as applied to firearm 1000. Specifically, FIG. 10*a* illustrates a top perspective view of a RMBF device 200 having three axial adjustment positions, but set to a default upright position, while FIG. 10*b* illustrates a rear perspective view of the RMBF device 200 in the default upright position coupled with a firearm 1000. For clarity, FIG. 10*c* illustrates a rear view of the firearm 1000 with the buttstock 602 removed, while FIG. 10*d* illustrates a rear view of the firearm 1000 with the buttstock 602 installed. FIGS. 10*e* and 10*f* illustrate side perspective views of the firearm 1000 with the buttstock 602 removed and installed. As best illustrated in FIGS. 10*e* and 10*f*, the buttstock 602 slides over tube portion 240, and, as discussed above, a recoil spring and a recoil buffer may fit within tube portion 240. A plurality of engagement means 232 interact with pin 522. Lever 520 can be pressed to remove pin 522 from engagement means 232, thereby allowing the telescoping portion of the buttstock 602 to slide down the tube portion 240. The lever 520 can then be released such that the bolt then reengages an engagement means 232. A safety may further be provided to prevent accidental axial rotation of buttstock 602.

Figure 11B:
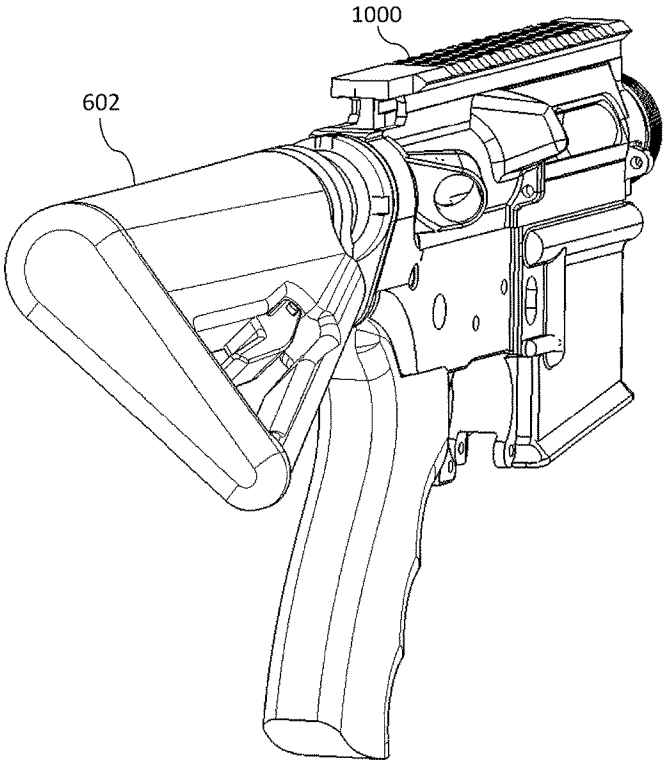
FIG. 11*b* illustrates a rear perspective view of a second firearm embodying the RMBF device mechanism having three axial adjustment positions in the first axially rotated position.
Figure 11A:
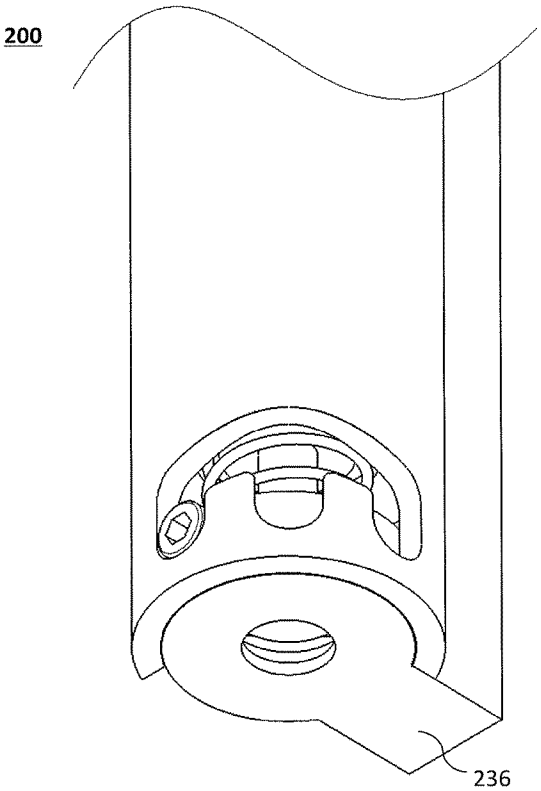
FIG. 11*a* illustrates a top perspective view of the RMBF device mechanism having three axial adjustment positions in a first axially rotated position.
Figure 11D:
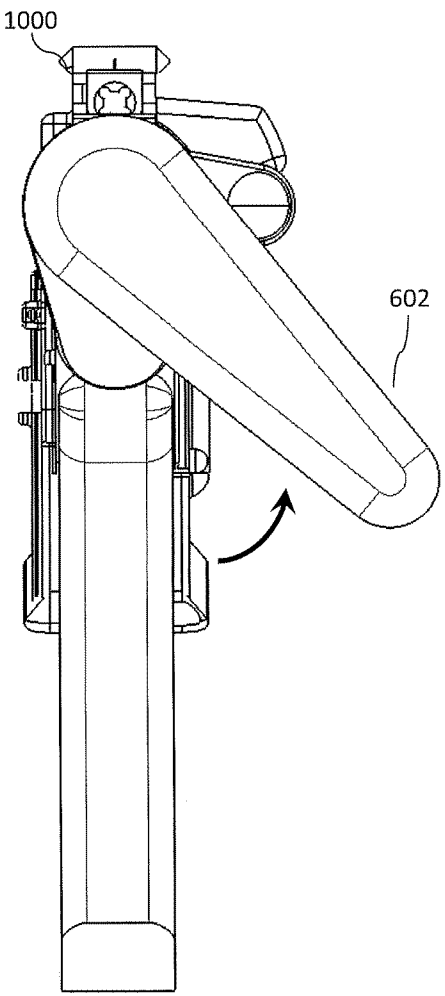
FIG. 11*d* illustrates a rear view of the firearm of FIG. 11*b* with the buttstock installed.
Figure 11C:
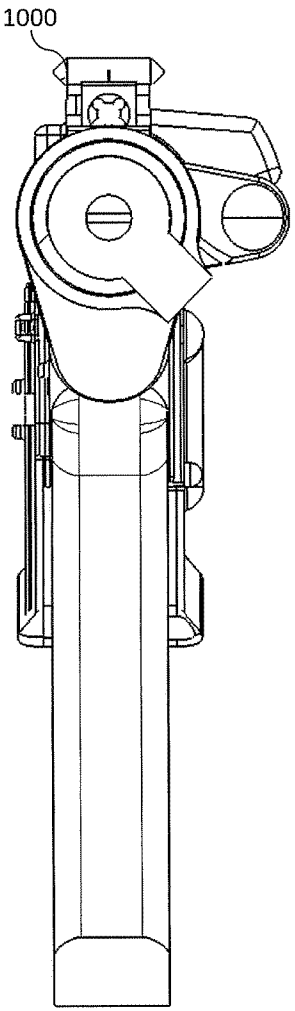
FIG. 11*c* illustrates a rear view of the firearm of FIG. 11*b* with the buttstock removed.
Figure 11E:
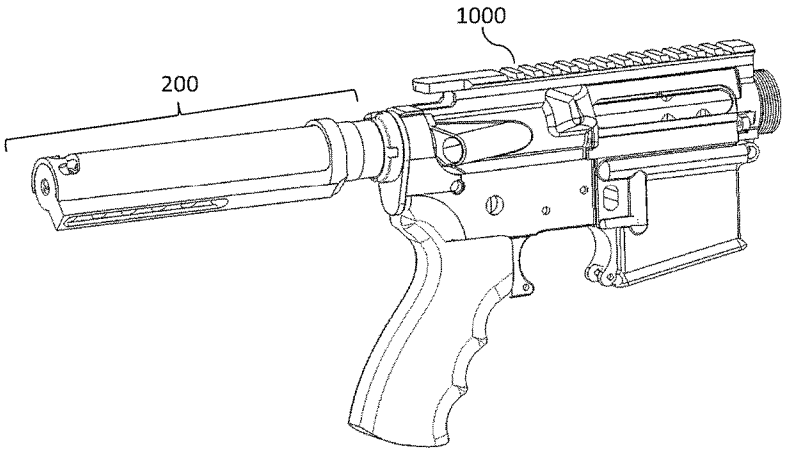
FIG. 11*e* illustrates a side perspective view of the firearm of FIG. 11*b* with the buttstock removed.
Figure 11F:
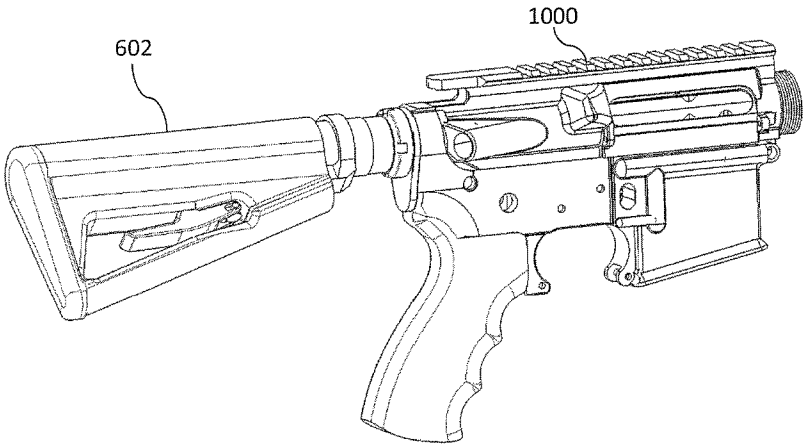
FIG. 11*f* illustrates a side perspective view of the firearm of FIG. 11*b* with the buttstock installed.

FIG. 11*a* illustrates a top perspective view of a RMBF device 200 having three axial adjustment positions, but set to a first axially rotated position, while FIG. 11*b* illustrates a rear perspective view of the RMBF device 200 in the first axially rotated position coupled with a firearm 1000. For clarity, FIG. 11*c* illustrates a rear view of the firearm 1000 with the buttstock 602 removed, while FIG. 11*d* illustrates a rear view of the firearm 1000 with the buttstock 602 installed. FIGS. 11*e* and 11*f* illustrate side perspective views of the firearm 1000 with the buttstock 602 removed and installed.

Figure 12B:
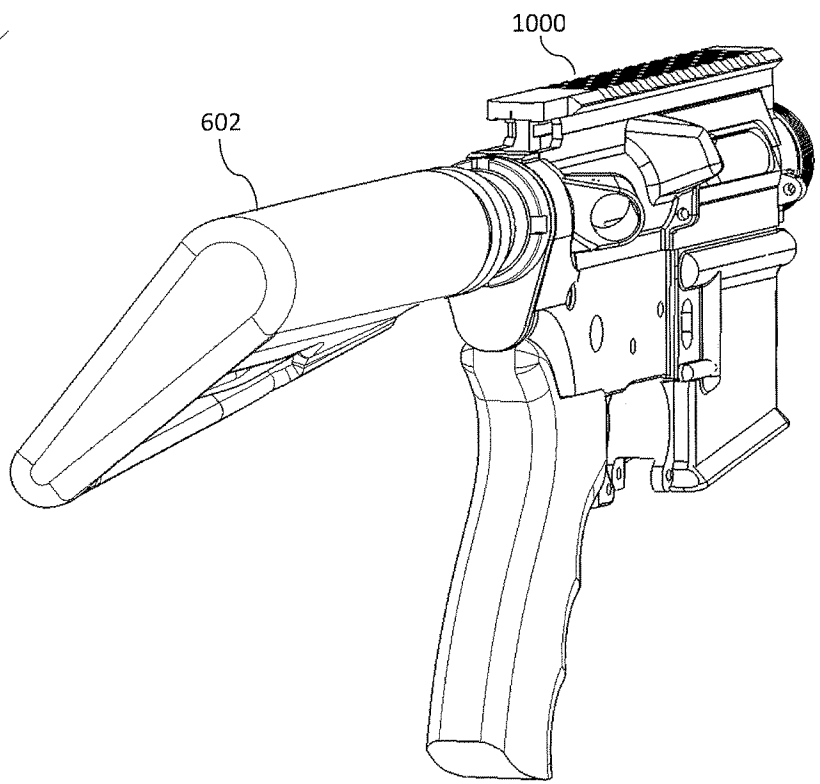
FIG. 12*b* illustrates a rear perspective view of a second firearm embodying the RMBF device mechanism having three axial adjustment positions in the second axially rotated position.
Figure 12A:
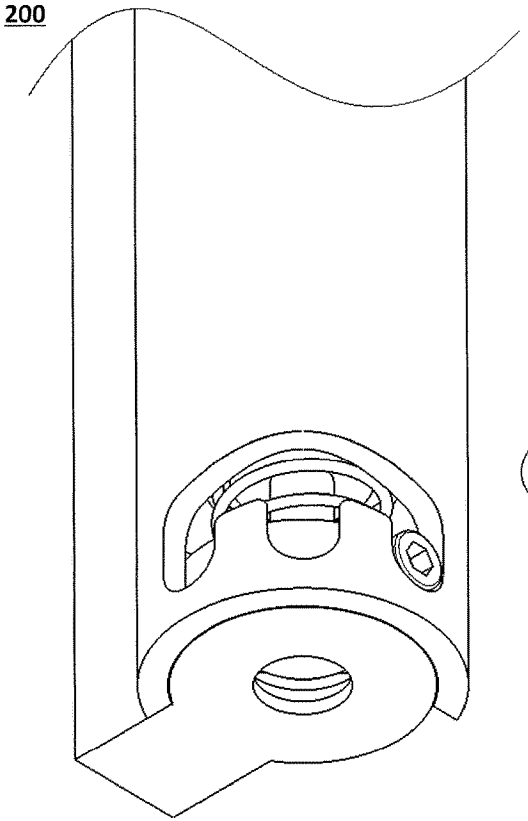
FIG. 12*a* illustrates a top perspective view of a RMBF device mechanism having three axial adjustment positions in a second axially rotated position.
Figure 12D:
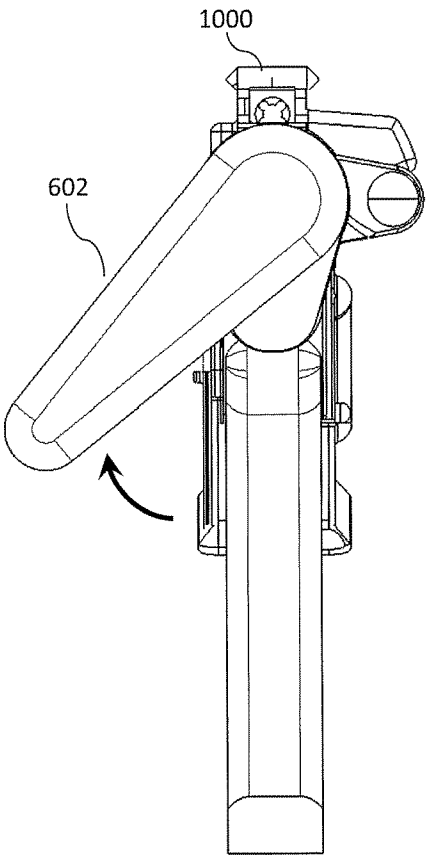
FIG. 12*d* illustrates a rear view of the firearm of FIG. 12*b* with the buttstock installed.
Figure 12C:
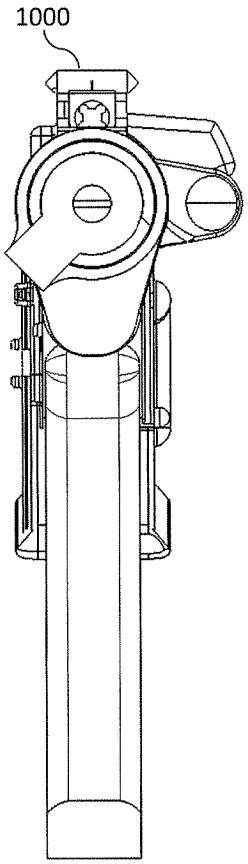
FIG. 12*c* illustrates a rear view of the firearm of FIG. 12*b* with the buttstock removed.
Figure 12E:
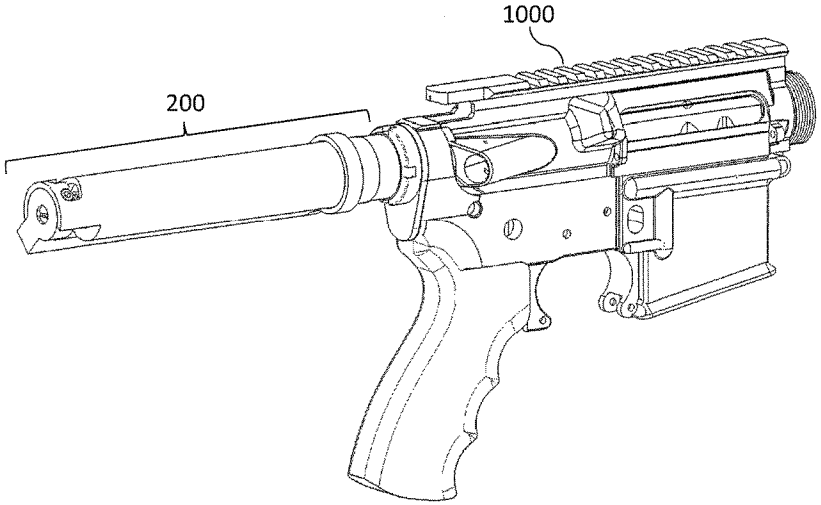
FIG. 12*e* illustrates a side perspective view of the firearm of FIG. 12*b* with the buttstock removed.
Figure 12F:
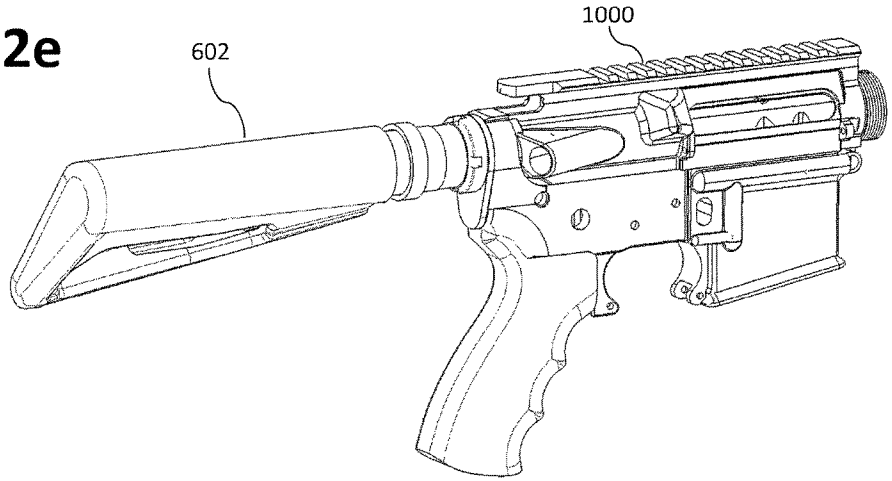
FIG. 12*f* illustrates a side perspective view of the firearm of FIG. 12*b* with the buttstock installed.

FIG. 12*a* illustrates a top perspective view of a RMBF device 200 having three axial adjustment positions, but set to a second axially rotated position, while FIG. 12*b* illustrates a rear perspective view of the RMBF device 200 in the second axially rotated position coupled with a firearm 1000. For clarity, FIG. 12*c* illustrates a rear view of the firearm 1000 with the buttstock 602 removed, while FIG. 12*d* illustrates a rear view of the firearm 1000 with the buttstock 602 installed. FIGS. 12*e* and 12*f* illustrate side perspective views of the firearm 1000 with the buttstock 602 removed and installed.

Figure 13A:
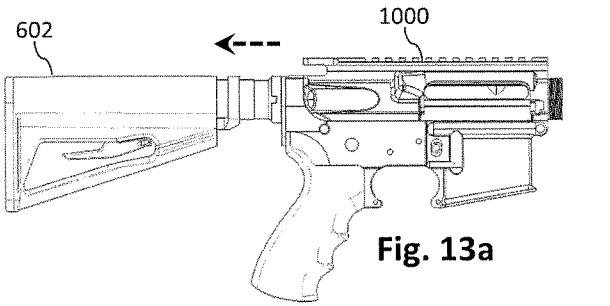
FIGS. 13*a* through 13*f* illustrate a side view of the second firearm embodying the RMBF device mechanism during various stages of lateral extension.
Figure 13B:
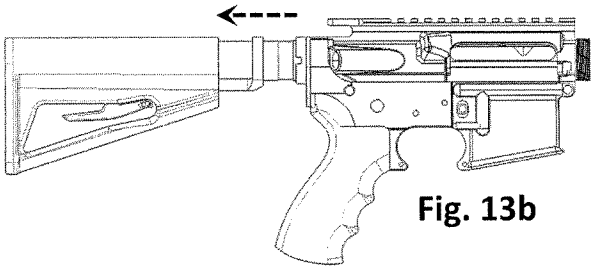
Figure 13C:
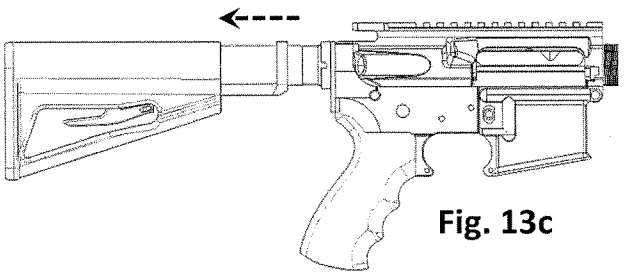
Figure 13D:
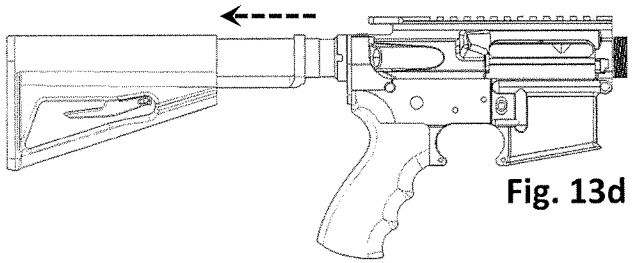
Figure 13E:
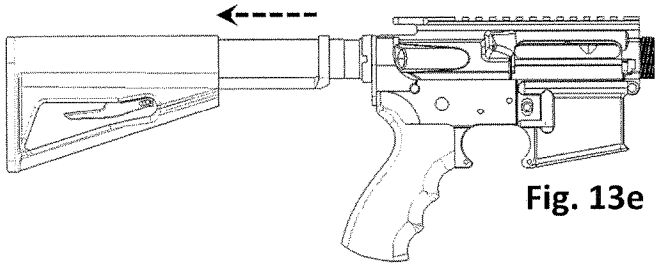
Figure 13F:
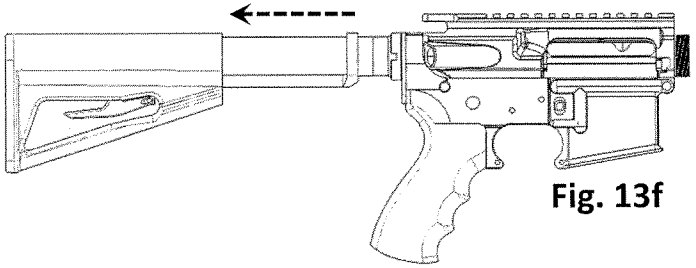

FIGS. 13*a* through 13*f* illustrate side views of the firearm 1000 embodying the RMBF device 200 during various stages of lateral extension. As noted above, a collapsible buttstock may employ more than one length setting, thus allowing the buttstock to be adjusted for different users. Specifically, FIG. 13*a* illustrates a compact setting (most collapsed), while FIG. 13*f* illustrates the longest setting (most extended).

Figure 15A:
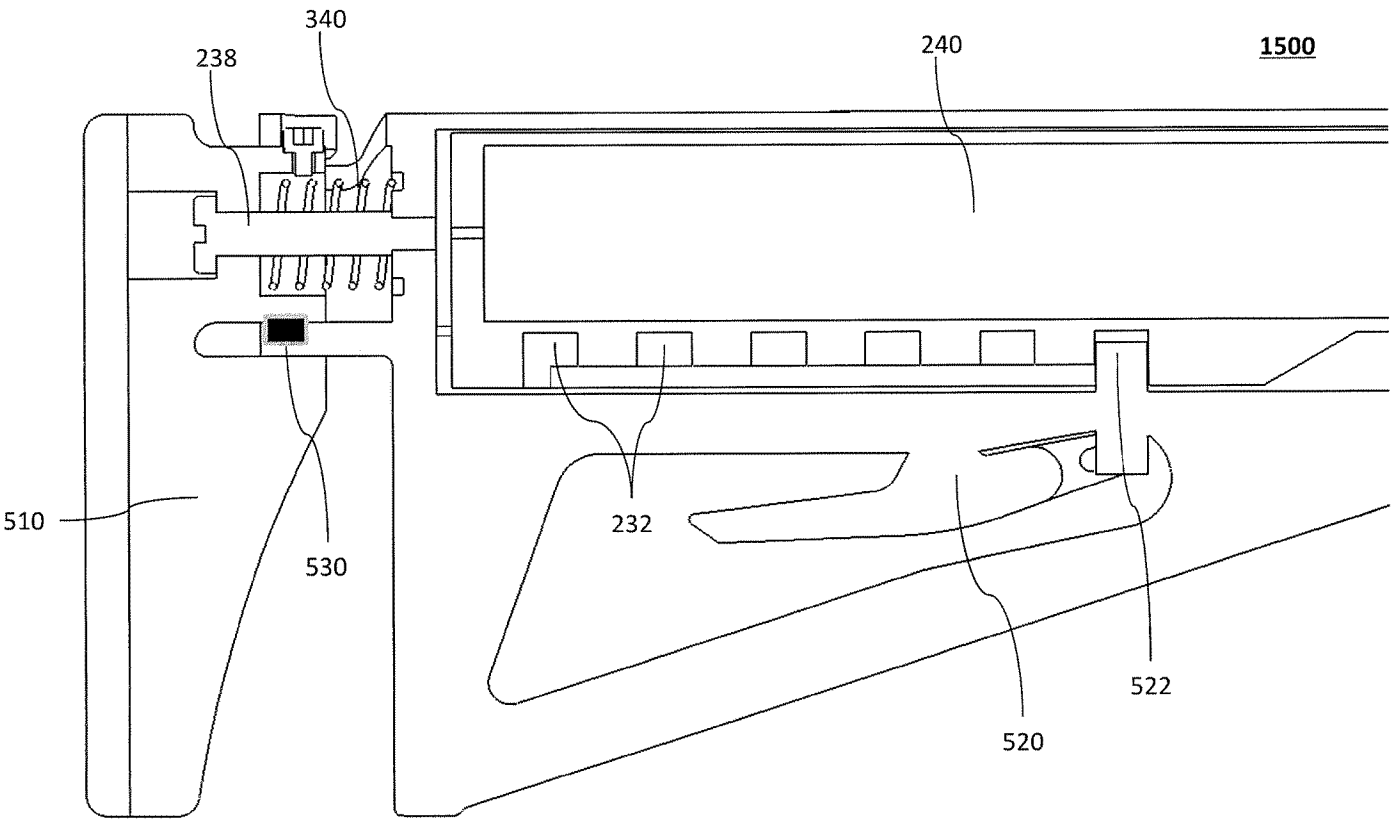
FIG. 15*a* illustrates a cross-sectional view of the RMBF device mechanism in accordance with a second aspect of the present invention.

Although the current floating buffer tube invention does not interfere with the function of the firearm firing mechanism, nevertheless, some firearm owners/operators prefer not to change the buffer tube that came with their original weapon. In order to address such a concern, in one example the inventor has transferred the RMBF mechanism to the fixed portion of the buttstock, thus, avoiding any modification to the buffer tube from its original form. FIG. 15*a* illustrates a RMBF device 1500 according to another aspect. As in the prior configuration, open end of tube portion 240 is attached to a firearm; however, rotating buttstock 510 may be attached and rotated via bolt 238's engagement means. Accordingly, the hollow part of the buttstock slides over tube portion 240, and a recoil spring and a recoil buffer may fit within tube portion 240 as discussed above. Engagement means 232 interact with pin 522. Lever 520 can be pressed to remove pin 522 from engagement means 232 allowing the telescoping portion of the buttstock to slide down the buffer tube. The lever 520 can then be released such that the bolt then reengages an engagement means 232. Safety 530 prevents accidental rotation of rotating buttstock 510.

Figure 15B:
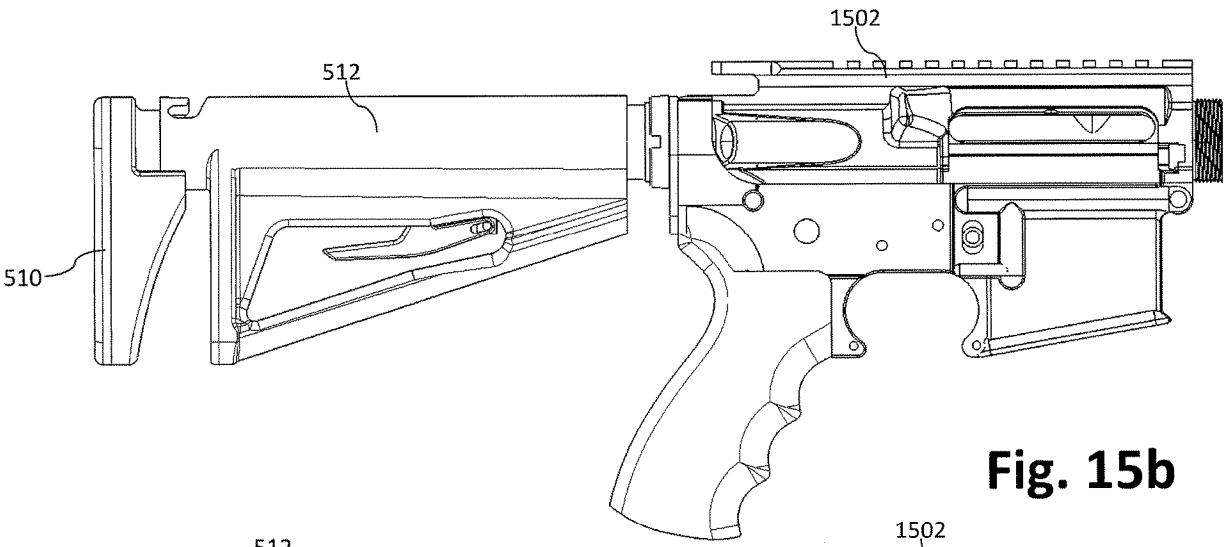
FIG. 15*b* illustrates a side view of a firearm having a RMBF device mechanism according to the second aspect of the present invention.
Figure 15C:
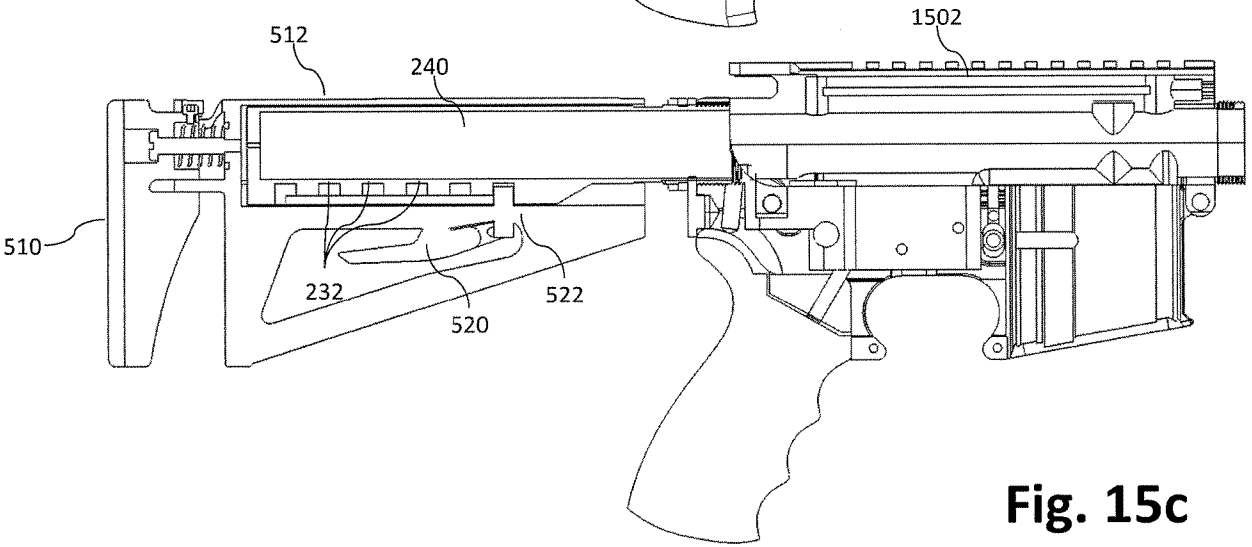
FIG. 15*c* illustrates a cross-sectional side view of the firearm of FIG. 15*b*.
Figure 15D:
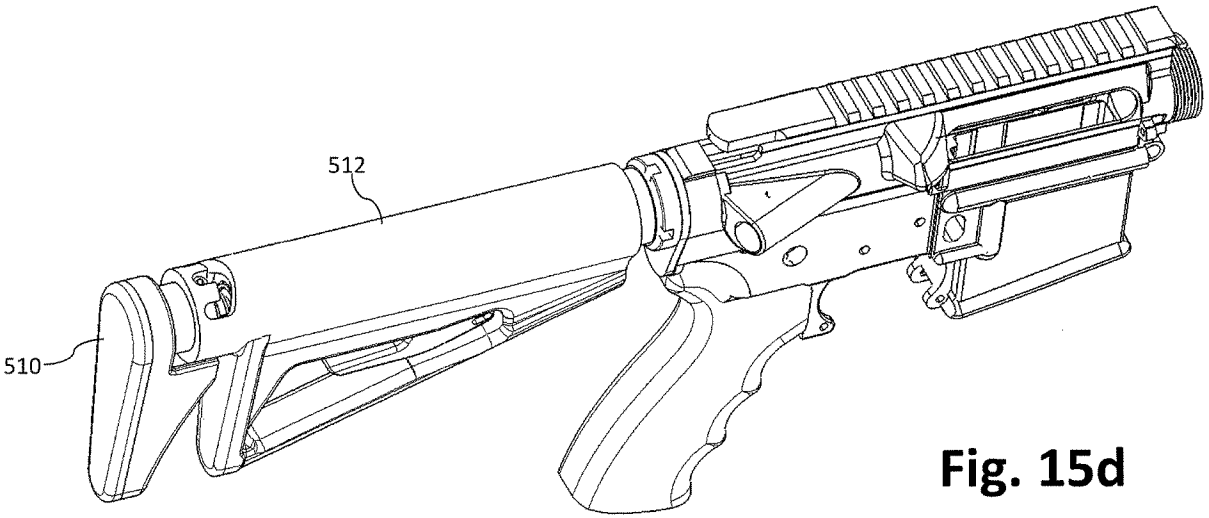
FIG. 15*d* illustrates a rear perspective view of the firearm of FIG. 15*b* in a default upright position.
Figure 15F:
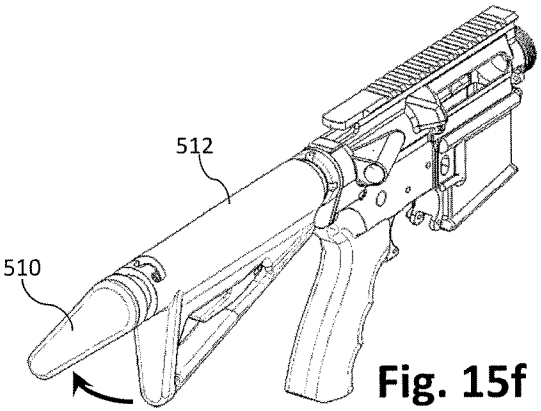
FIG. 15*f* illustrates a rear perspective view of the firearm of FIG. 15*b* in a second axially rotated position.
Figure 15E:
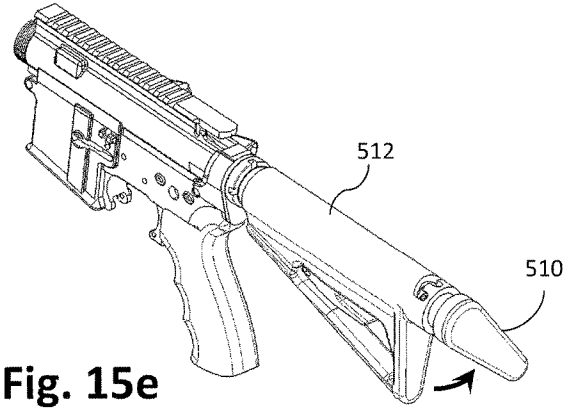
FIG. 15*e* illustrates a rear perspective view of the firearm of FIG. 15*b* in a first axially rotated position.

FIG. 15*b* illustrates a side view of the RMBF device 1500 coupled with firearm 1502, while FIG. 15*c* illustrates a cross-sectional side view thereof. FIGS. 15*d* through 15*f* illustrate a rear perspective view of the firearm of FIG. 15*b* in a default upright position, a first axially rotated position, and a second axially rotated position, respectively.

Figure 15G:
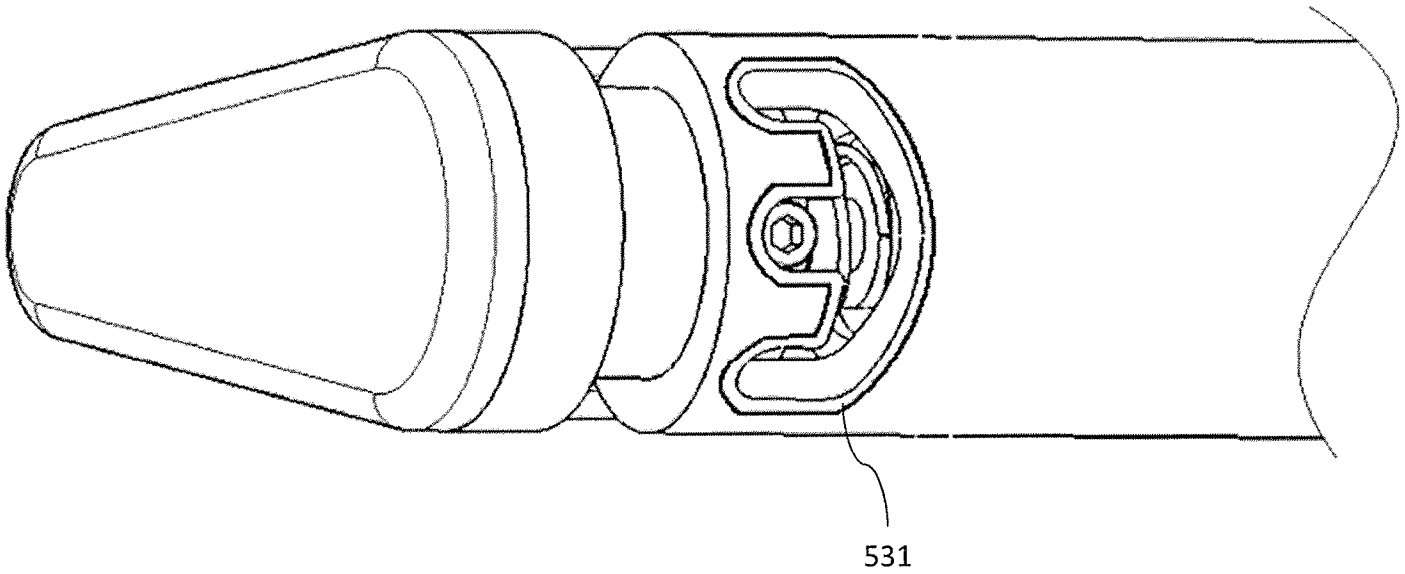
FIG. 15*g* illustrates a rear perspective view of the RMBF device mechanism according to the second aspect of the present invention with added high abrasion resistance liner to the angle selection grooves and angle selection guide

The buttstock is usually made out of light material preferably a thermoset polymer, however, it may be made out of wood, light metal or metal alloys or any other material that may be machined, cast, stamped or formed by any other process known to those skilled in the art. However, utilizing lighter materials may compromise the wear resistance of the RMBF mechanism or its components, therefore, if the material selected to make the RMBF embodiment does not have a reasonably high wear resistance, it is desirable that the angle selection grooves 310 and angle selection guide 312 portion fully or partially of the RMBF embodiment be made up of a high wear resistance material, examples of such material are steel and steel alloys, aluminum and aluminum alloys, most metal and alloys thereof, ceramics, high density polymers etc. and any material that has an abrasion resistance that is higher than that of the material used to make the rest of the RMBF mechanism. FIG. 15*g* illustrates a liner 531 that has a higher abrasion resistance than the abrasion resistance of the rest of the RMBF material, such material is being used to provide the angle selection grooves and angle selection guide with higher abrasion resistance than that of the rest of the RBMF construction material. Such a liner 531 may be attached to the RMBF permanently or temporarily by forming the rest of the RMBF material around it, one example may be injection molding or casting the RMBF structure to surround the liner and hold it in place, or by securing the liner into a preformed groove using glue, braze, or press fitting or any mechanical or chemical joining method used by those skilled in the art.

In certain aspects, it may be useful to retrofit existing firearms to facilitate adjustment and/or rotation of the buttstock. To accomplish this, a RMBF adapter mechanism may be employed. Indeed, a RMBF adapter mechanism may facilitate customized adjustment and/or rotation of a particular firearm component, accessory, or portion thereof. For example, an operator may wish to adjust only a portion of the distal end of the firearm buttstock, or to employ a specific buttstock accessory (e.g., a padded recoil apparatus or mount). To provide universal application, such a RMBF adapter mechanism may be configured to couple with firearms of various brands and/or styles using an adapter coupling. As will be discussed below, and illustrated in the various figures, a RMBF adapter mechanism may be positioned between the firearm and the component to be rotated and/or reduce the felt recoil. The RMBF adapter mechanism may comprise substantially the same main components as the prior examples, which perform substantially the same functions; however, the RMBF adapter mechanism utilizes a different firearm attachment means.

Figure 16B:
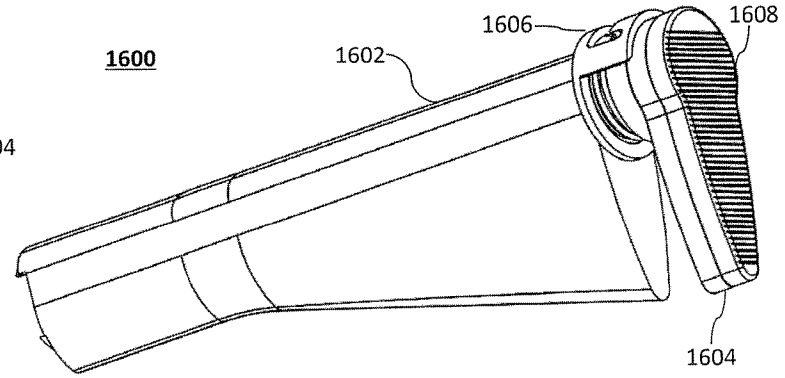
FIG. 16*b* illustrates a rear perspective view of the buttstock of FIG. 16*a*.
Figure 16A:
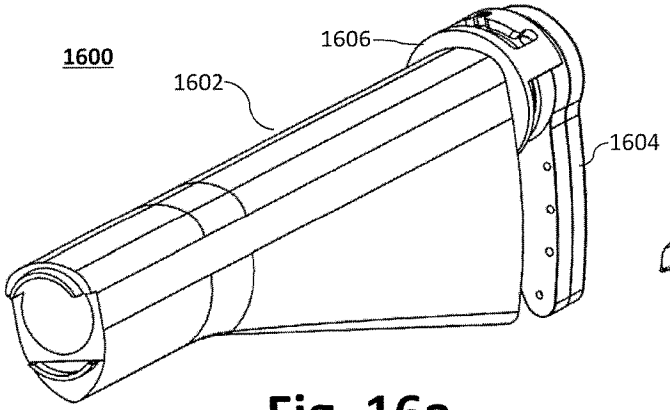
FIG. 16*a* illustrates a front perspective view of a buttstock having a RMBF adapter mechanism according to a first aspect of the present invention.
Figure 16C:
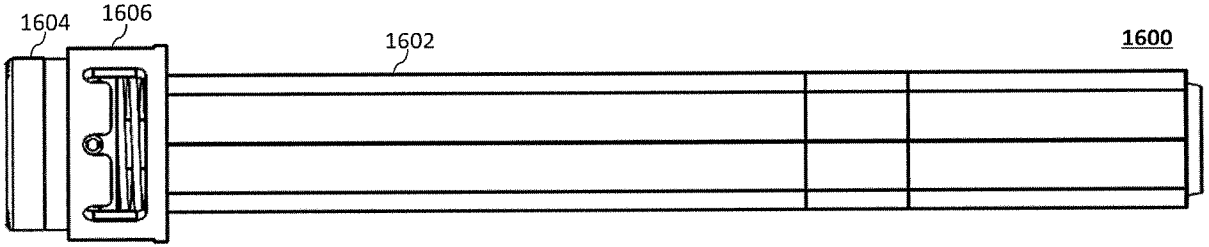
FIG. 16*c* illustrates a top plan view of the buttstock of FIG. 16*a*.
Figure 16D:
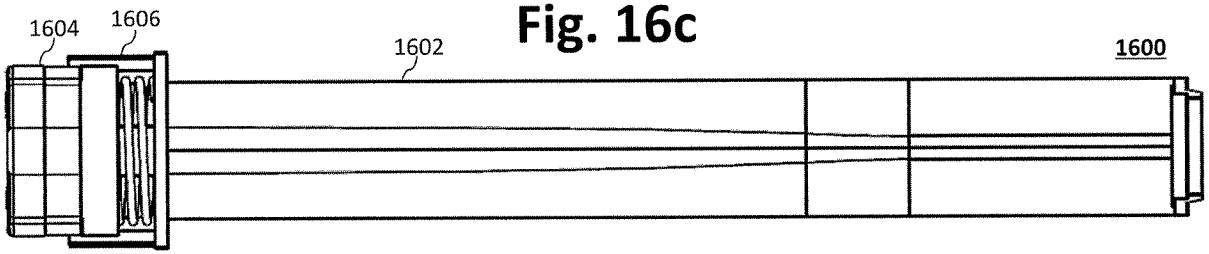
FIG. 16*d* illustrates a bottom plan view of the buttstock of FIG. 16*a*.
Figure 16E:
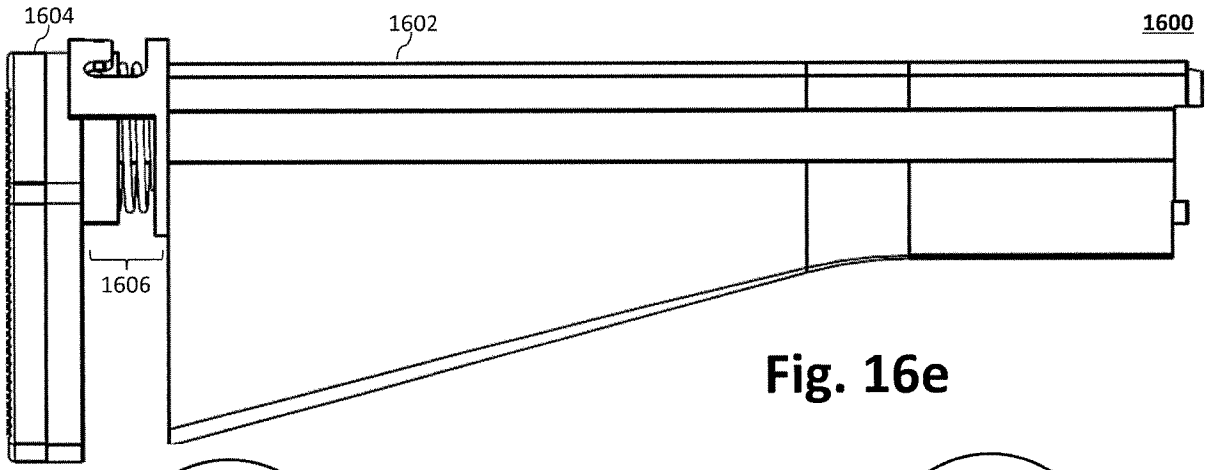
FIG. 16*e* illustrates a side view of the buttstock of FIG. 16*a*.
Figure 16G:
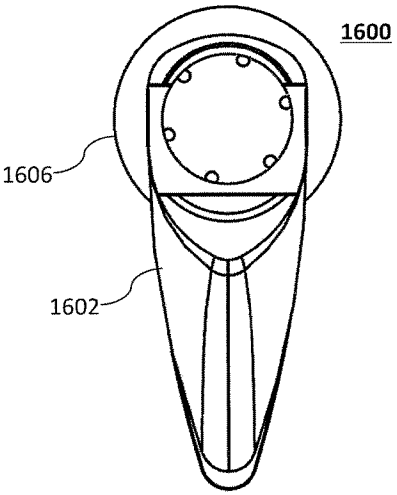
FIG. 16*g* illustrates a front view of the buttstock of FIG. 16*a*.
Figure 16F:
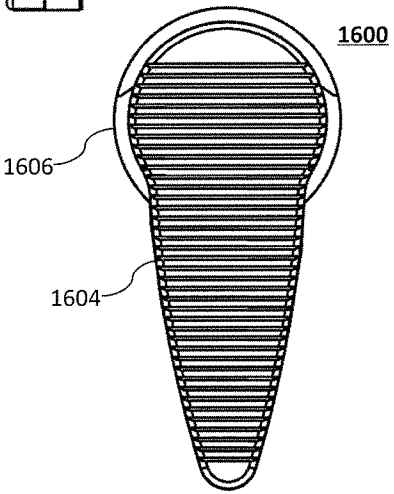
FIG. 16*f* illustrates a rear view of the buttstock of FIG. 16*a*.

FIG. 16*a* illustrates a front perspective view of a first buttstock 1600 having a RMBF adapter mechanism 1606, while FIG. 16*b* illustrates a rear perspective view. As illustrated, the first buttstock 1600 may comprise a fixed buttstock portion 1602 (or other fixed firearm portion or surface), a movable buttstock portion 1604, and a RMBF adapter mechanism 1606 disposed therebetween, wherein the movable buttstock portion 1604 is configured to rotate between one of a plurality of positions. The movable buttstock portion 1604 may be further configured with a user contact portion 1608 that abuts the user during operation. The user contact portion 1608 may be a gripping material (e.g., rubber, or plastic), and may further be padded to further absorb recoil. In certain aspects, as illustrated, the surface of the user contact portion 1608 may be textured to increase friction when applied to a body or other object, thereby increasing gripping. FIGS. 16*c* through 16*g* illustrate a top plan view, a bottom plan view, a side view, a rear view, and a front view of the first buttstock 1600, respectively.

Figure 17A:
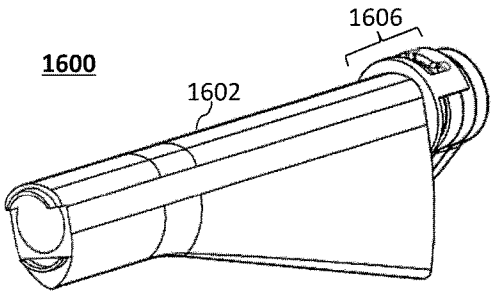
FIGS. 17*a* and 17*b* illustrate the buttstock of FIG. 16*a* in a first axially rotated position.
Figure 17C:
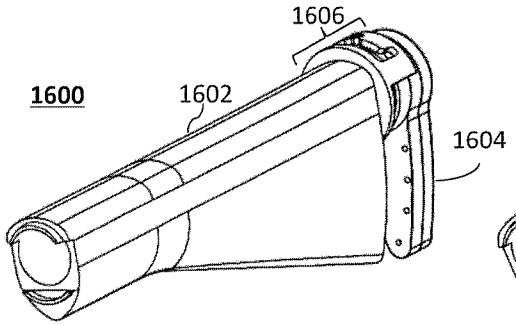
FIGS. 17*c* and 17*d* illustrate the buttstock of FIG. 16*a* in a default upright position.
Figure 17E:
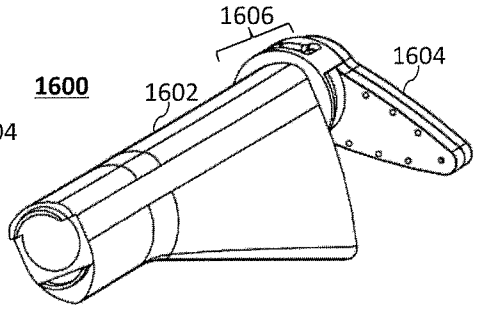
FIGS. 17*e* and 17*f* illustrate the buttstock of FIG. 16*a* in a second axially rotated position.
Figure 17B:
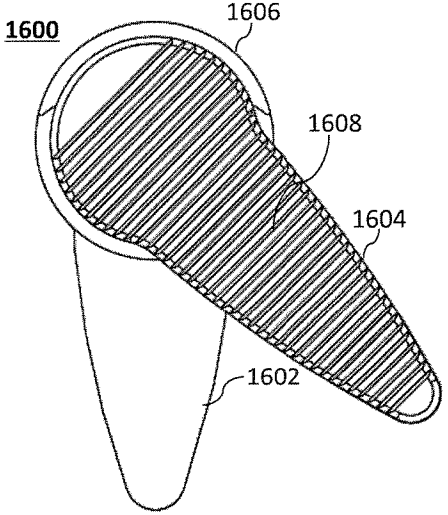
Figure 17D:
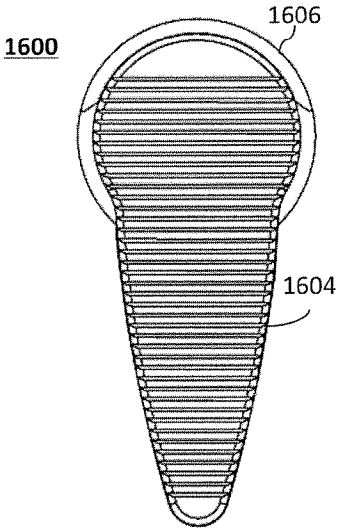
Figure 17F:
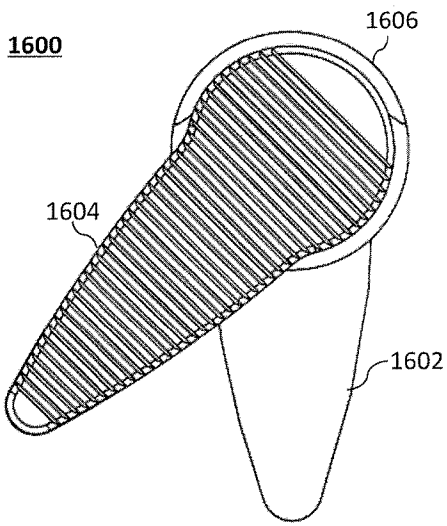

As discussed above with regard to the other configurations, the RMBF adapter mechanism 1606 may also be configured to compress, thereby countering some or all felt recoil. Indeed, the RMBF adapter mechanism 1606 can perform both the functions of impact mitigation and buttstock rotation when attached to any part of the firearm, so long as one side of the embodiment is attached to a fixed firearm portion (e.g., firearm body, fixed buttstock portion 1602, etc.), whereas, the other side of the embodiment is attached to the buttstock or part of the buttstock that contacts the firearm operator's body (e.g., the movable buttstock portion 1604, the entire buttstock, etc.). As illustrated in FIGS. 17*a* through 17*f*, the RMBF adapter mechanism 1606 enables the movable buttstock portion 1604 to switch between a default upright position (FIGS. 17*c* and 17*d*), a first axially rotated position (FIGS. 17*a* and 17*b*), and/or a second axially rotated position (FIGS. 17*e* and 17*f*).

Figure 18A:
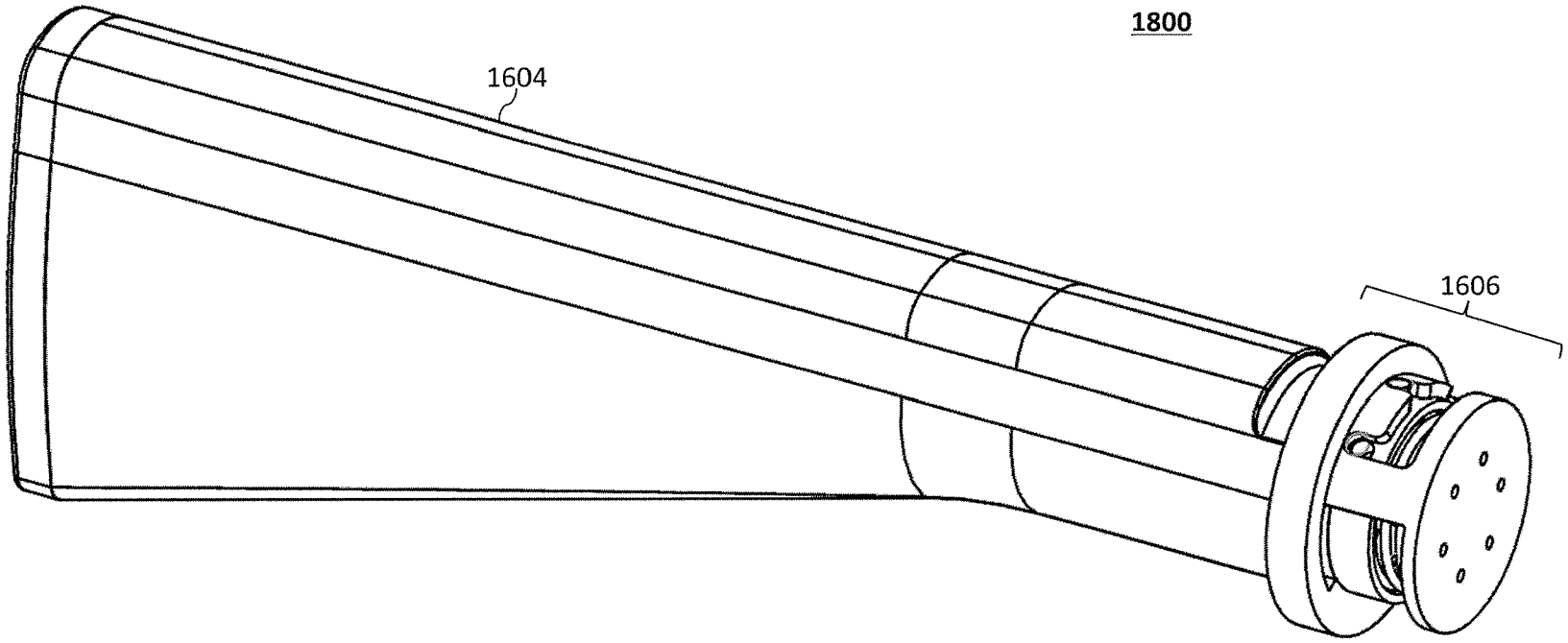
FIG. 18*a* illustrates a perspective view of a buttstock having a RMBF adapter mechanism according to a second aspect of the present invention.
Figure 18B:
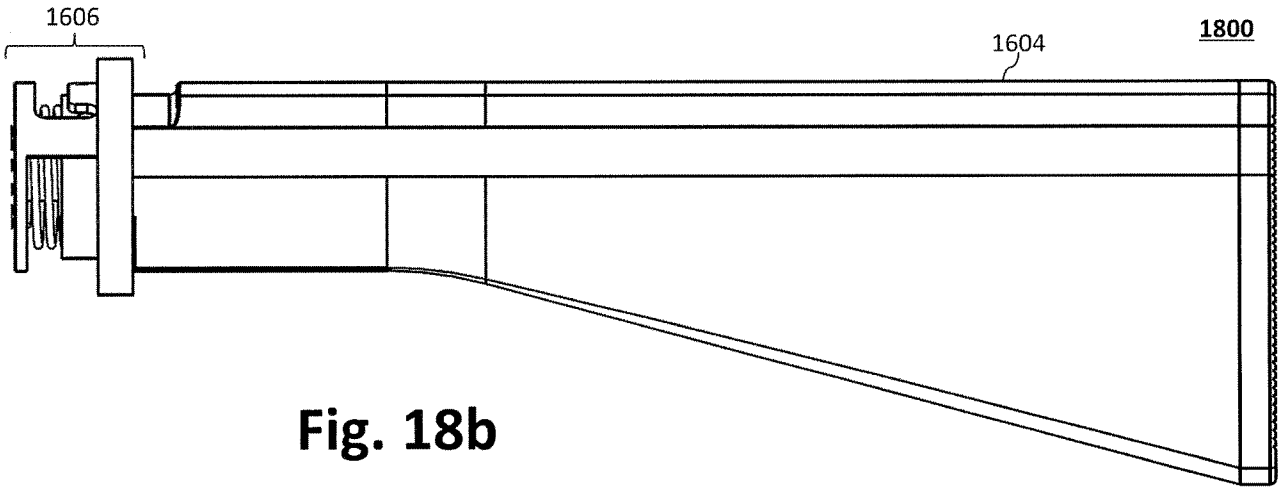
FIG. 18*b* illustrates a side view of the buttstock of FIG. 18*a*.
Figure 18D:
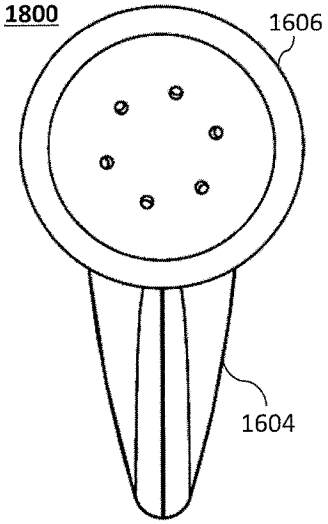
FIG. 18*d* illustrates a front view of the buttstock of FIG. 18*a*.
Figure 18C:
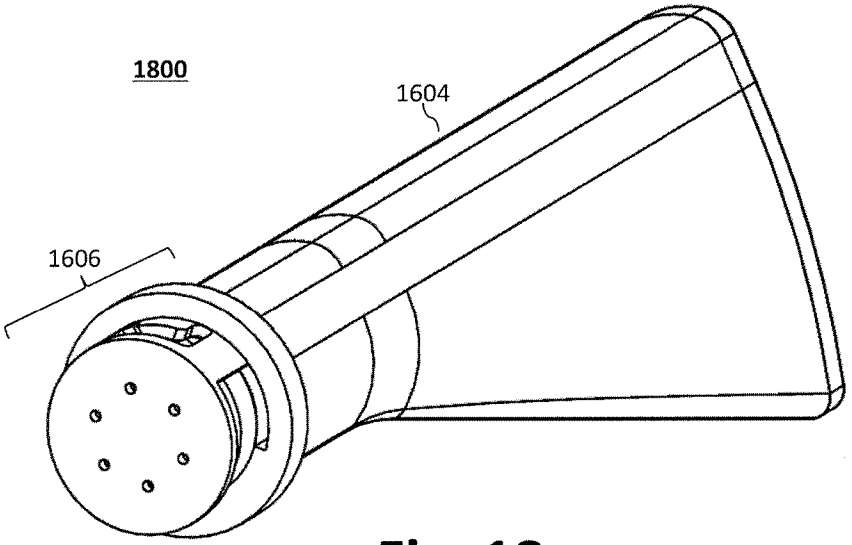
FIG. 18*c* illustrates a front perspective view of the buttstock of FIG. 18*a*.
Figure 19A:
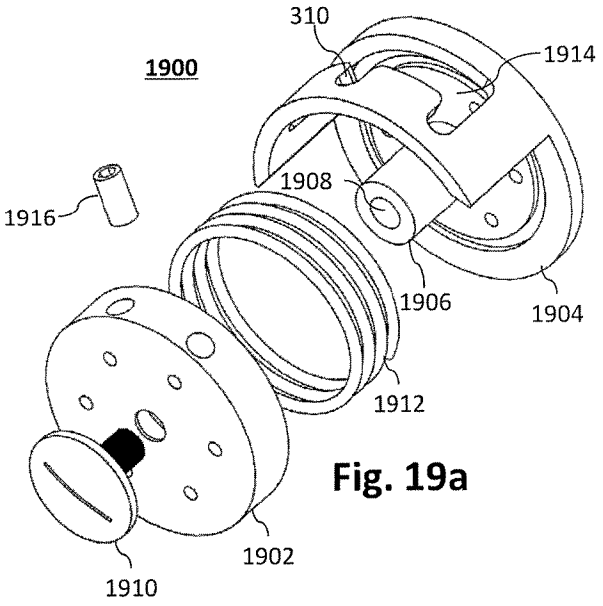
FIG. 19*a* illustrates an assembly view of a first example RMBF adapter mechanism.
Figure 19B:
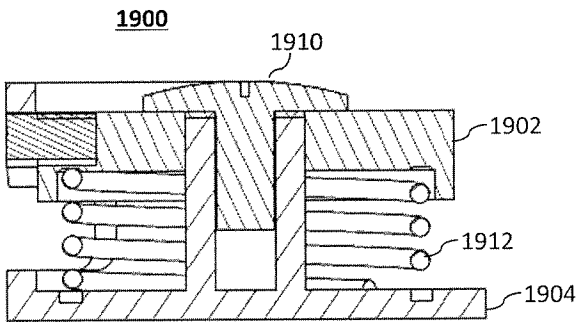
FIG. 19*b* illustrates a cross-sectional side view of the RMBF adapter mechanism of FIG. 19*a*.
Figure 19C:
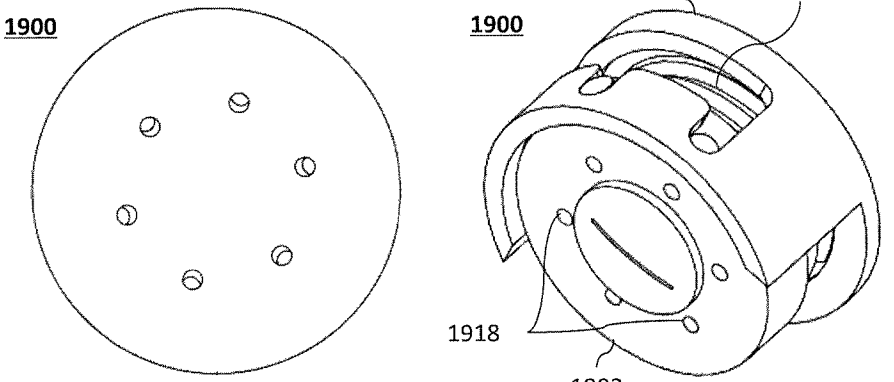
FIG. 19*c* illustrates a top view of the RMBF adapter mechanism of FIG. 19*a*.
Figure 19D:
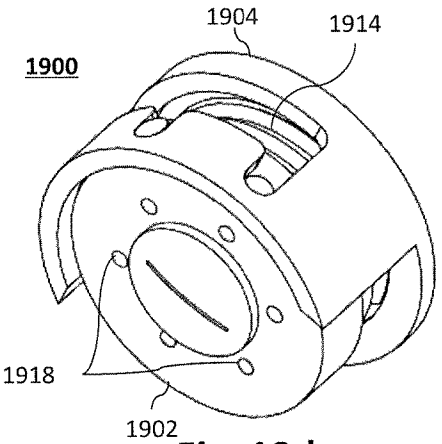
FIG. 19*d* illustrates a rear perspective view of the RMBF adapter mechanism of FIG. 19*a*.
Figure 19E:
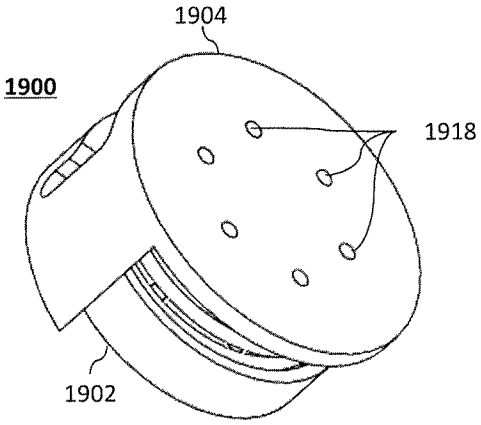
FIG. 19*e* illustrates a front perspective view of the RMBF adapter mechanism of FIG. 19*a*.
Figure 21B:
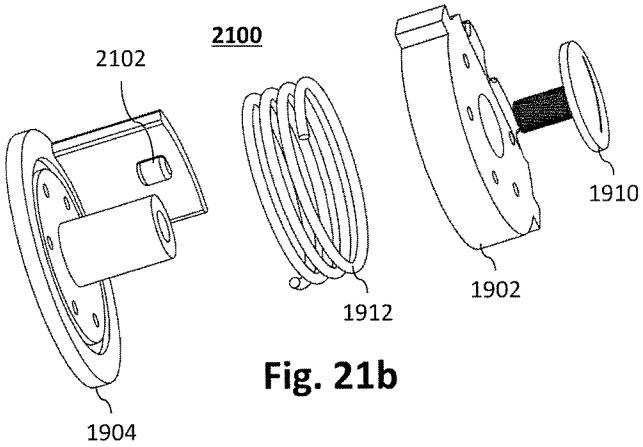
FIG. 21*b* illustrates a second assembly view of the third RMBF adapter mechanism of FIG. 21*a*.
Figure 21A:
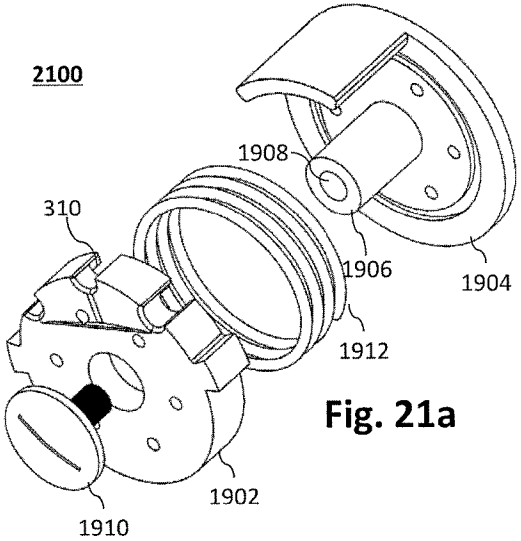
FIG. 21*a* illustrates an assembly view of a third example RMBF adapter mechanism.
Figure 21E:
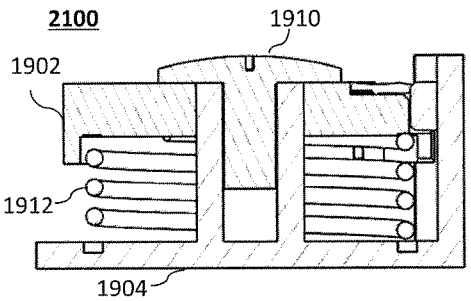
FIG. 21*e* illustrates a cross-sectional side view of the third example RMBF adapter mechanism of FIG. 21*a*.
Figure 21D:
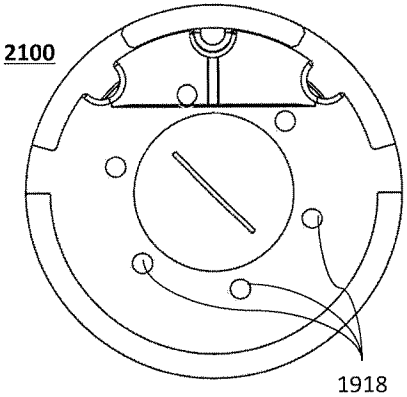
FIG. 21*d* illustrates a rear view of the third example RMBF adapter mechanism of FIG. 21*a*.
Figure 21C:
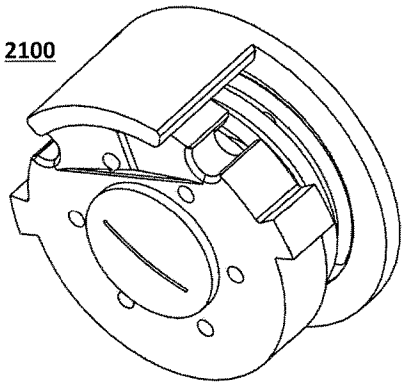
FIG. 21*c* illustrates a rear perspective view of the third example RMBF adapter mechanism of FIG. 21*a*.

Turning now to FIGS. 18*a* through 18*d*, a buttstock 1800 having a RMBF adapter mechanism is illustrated according to a second aspect of the present invention. As illustrated, the buttstock 1800 may employ only a movable buttstock portion 1604 and a RMBF adapter mechanism 1606, wherein the RMBF adapter mechanism 1606 couples the movable buttstock portion 1604 directly to the firearm, thereby obviating the need for a fixed buttstock portion. FIGS. 18*b* through 18*d* illustrate a side view, a front perspective view, and a front view of the buttstock 1800.

The RMBF adapter mechanism 1606 may be configured in one of a multiple arrangements. To provide an overview, the RMBF adapter mechanism 1606 may be illustrated by the following examples. These examples are provided to aid in the understanding of the invention and are merely representative of the work that contributes to the teaching of the present novel article and are not to be restricted by the examples that follow. As will be appreciated from the figures, the various RMBF adapter mechanisms share a number of correspondingly numbered components, which will generally be described only in the first instance, and therefore, will not be described in connection with each example variation of the RMBF adapter mechanism.

Example 1

Turning to FIGS. 19*a* through 19*e*, a first example RMBF adapter mechanism 1900 may comprise a first housing 1902 (e.g., an upper housing), a second housing 1904 (e.g., a lower housing), a helical spring 1912 disposed therebetween, and a screw 1910 (or bolt, or the like) configured to secure the first housing 1902 to the second housing 1904. As illustrated, the first housing 1902 and the second housing 1904 may be generally shaped like cups, that is, a circular planar surface having a cylindrical wall (or portion thereof) at the circumference of the circular planar surface.

When assembled, the open side of the first housing 1902 faces the open end of the second housing 1904. One of the housings, the first housing 1902 is illustrated, may be sized such that the outside diameter of the cylindrical wall is about equal to, or slightly less than, the inside diameter of the other housing's cylindrical wall (e.g., the second housing 1904). This configuration enables the housings to move telescopically relative to one another. The two housings may be slidably coupled to one another by a post 1906 that extends from the center of the second housing 1904's circular planar surface and penetrates the circular planar surface (or base) of the first housing 1902. The post 1906 further acts as an axis of rotation for the housings to rotate relative to one another. In order to limit the telescopic travel of the two housings relative to one another, the post may have a threaded hole 1908 sized to receive a screw 1910 or other securing device to function as a telescopic travel limitation barrier. As illustrated, the screw 1910 may have a screw head that is larger than the post 1906 and the hole provided at the center of the first housing 1902's base, thus functioning as a barrier that limits the telescopic travel of the housings.

In another example, in lieu of the post 1906, a shoulder bolt may be inserted through the hole of the first housing 1902's base, which threads into the base of the second housing 1904 (e.g., where the post 1906 would have been provided). In such an arrangement, the unthreaded body of the shoulder bolt would operate as the axis of rotation of the two housings and the head of the shoulder bolt would function as the telescopic travel limitation barrier.

Regardless of the telescopic travel limitation barrier employed, a helical spring 1912 may be sized, shaped, and inserted between the first housing 1902 and the second housing 1904 in the cavity defined between the post 1906 and the inside diameter of the first housing 1902 (i.e., the smaller of the two housings), the helical spring 1912 making contact with the inside surface of the base of said first housing 1902 and the inside surface of the base of said second housing 1904. The helical spring 1912 should be strong enough to hold the two housings in the fully extended position, while also providing recoil absorption, but should be capable of being compressed (overcome) by the operator so as to adjust the axial angle position. For example, the helical spring 1912 may have an outside diameter that is approximately the same size as the inside diameter of the first housing. For example, in one embodiment, helical spring 1912's diameter may range from about 0.5" to 1.58", more preferably about 1.530". The helical spring 1912's inside diameter can range from the outside diameter of the post/axis of rotation or in the current embodiment from (e.g., about 0.459" to 1.37"–the kerf of the spring), more preferably about 1.530".

One or both of the first housing 1902 and the second housing 1904 may have portions of their cylindrical side walls removed in order to allow clearance for attachment of the buttstock (or parts of the buttstock) or firearm body, while also reducing weight and material cost. For example, a cutout in the side wall of the housing with the larger inside diameter functions as an angle selection guide 1914, and a pin 1916 (or a bolt) affixed to the outside diameter of the first housing 1902's cylindrical wall limits the axial rotation of the two housings relative to one another.

The base of the first housing 1902 and the base of the second housing 1904 may have a plurality of holes 1918. The plurality of holes 1918 may be used to attach the RMBF adapter mechanism 1900 to the fixed buttstock portion 1602 (or the firearm), the movable buttstock portion 1604, or another component of a firearm. In certain aspects, the plurality of holes 1918 may be threaded and configure to receive a threaded screw (e.g., a machine screw).

To change the axial angle position, a force may be applied to the first housing 1902, thereby causing the helical spring 1912 to compress. Once enough force has been applied to the first housing 1902, the pin 1916 disengages from a current angle selection groove 310 of the angle selection guide 1914, thereby enabling free axial rotation. Once a desired axial angle position has been selected via the angle selection guide 1914, the force may be released from the first housing 1902, thereby allowing the pin 1916 to reengage the angle selection guide 1914 at a desired angle selection groove 310, thus securing the first housing 1902 in desired axial angle position with regard to the second housing 1904.

The number of angle selection grooves 310 governs the number of axial angle positions that may be selected/secured. For example, the second housing 1904 illustrates an angle selection guide 1914 having three angle selection grooves 310 (e.g., 0°, 45° clockwise, and 45° counterclockwise). Accordingly, the RMBF adapter mechanism 1900 of FIGS. 19*a* through 19*e* would have three axial angle positions that may be selected during free rotation. However, one of skill in the art would recognize that the number of angle selection grooves 310 may be increased, or decreased, to achieve a desired number of available axial angle positions.

Example 2

FIGS. 20*a* through 20*e* illustrate a second example RMBF adapter mechanism 2000, which may comprise a first housing 1902, a second housing 1904, a helical spring 1912 disposed therebetween, and a screw 1910 configured to secure the first housing 1902 to the second housing 1904. Rather than providing an angle guide selector 1914 cutout from the second housing 1904 (i.e., a housing with a larger outside diameter) as illustrated with regard to FIGS. 19*a* through 19*e*, the angle guide selector 1914 cutout may be placed on the housing with the smaller outside diameter (e.g., the second housing 1904). As illustrated, this arrangement would require additional cuts on the base of the housing with the larger outside diameter to allow the telescopic relative motion between housings to take place; the guide pin 1916 in this arrangement may be supported in two places which facilitates a better support to the guide pin 1916.

Example 3

Figure 22B:
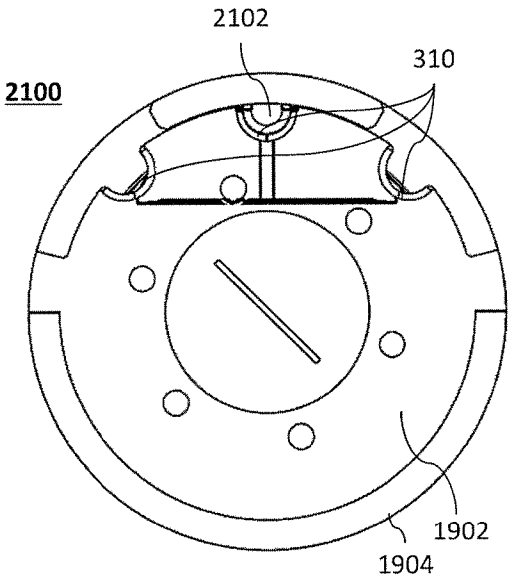
FIG. 22*b* illustrates a rear perspective view of the third example RMBF adapter mechanism of FIG. 21*a* in a default upright position.
Figure 22C:
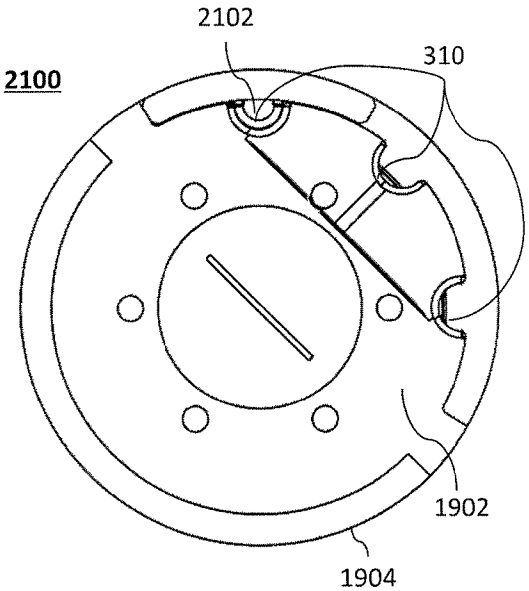
FIG. 22*c* illustrates a rear perspective view of the third example RMBF adapter mechanism of FIG. 21*a* in a second axially rotated position.
Figure 22A:
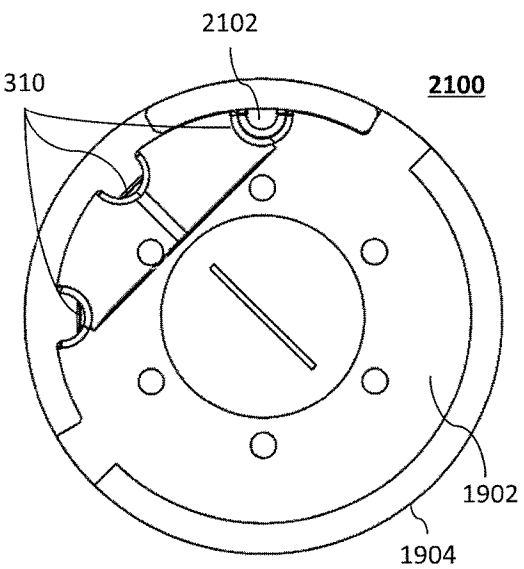
FIG. 22*a* illustrates a rear perspective view of the third example RMBF adapter mechanism of FIG. 21*a* in a first axially rotated position.
Figure 23A:
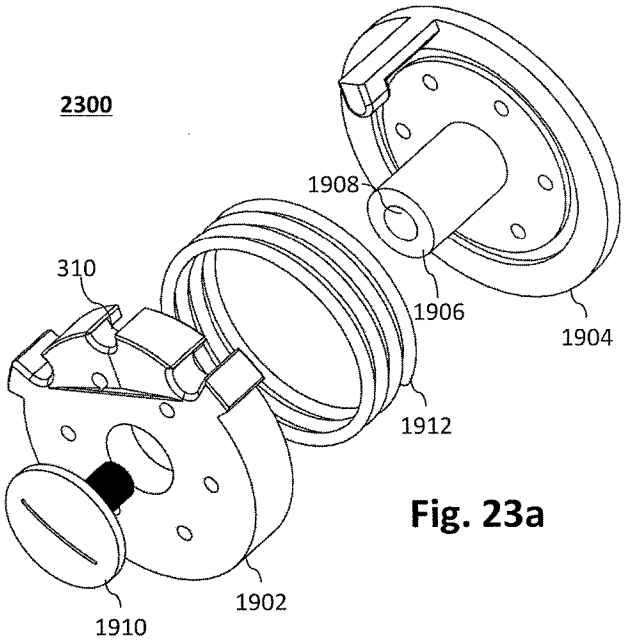
FIG. 23*a* illustrates an assembly view of a fourth example RMBF adapter mechanism.
Figure 23B:
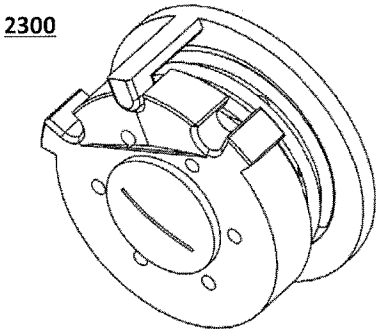
FIG. 23*b* illustrates a rear perspective view of the fourth example RMBF adapter mechanism of FIG. 23*a*.
Figure 23C:
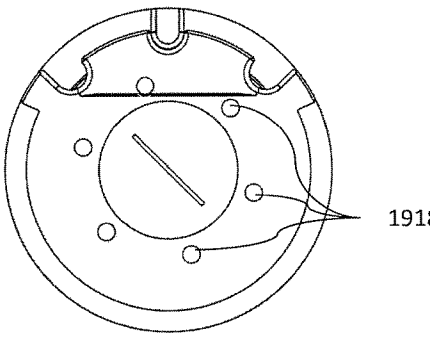
FIG. 23*c* illustrates a top view of the fourth example RMBF adapter mechanism of FIG. 23*a*.
Figure 23D:
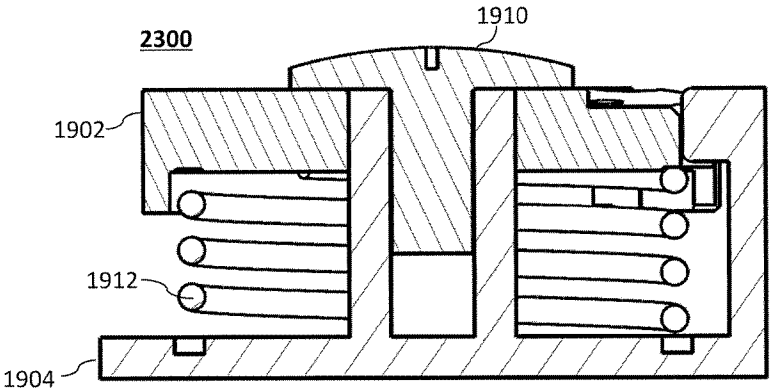
FIG. 23*d* illustrates a rear perspective view of the fourth example RMBF adapter mechanism of FIG. 23*a*.

FIGS. 21*a* through 21*e* illustrate a third example RMBF adapter mechanism 2100, which may comprise a first housing 1902, a second housing 1904, a helical spring 1912 disposed therebetween, and a screw 1910 configured to secure the first housing 1902 to the second housing 1904. Rather than providing a guide pin 1916, a notch 2102 may be formed on the second housing 1904 that is configured to engage one of a plurality of angle selection grooves 310 positioned on the first housing 1902. FIGS. 22*a* through 22*c* illustrate a rear perspective view of the third RMBF adapter mechanism 2100 in a default upright position, a default upright position, and a second axially rotated position, respectively.

Example 4

FIGS. 23*a* through 23*e* illustrate a fourth example RMBF adapter mechanism 2300, which may comprise a first housing 1902, a second housing 1904, a helical spring 1912 disposed therebetween, and a screw 1910 configured to secure the first housing 1902 to the second housing 1904. As illustrated, the notch 2102 may be formed on a narrower portion of the second housing 1904 that is configured to engage one of a plurality of angle selection grooves 310 positioned on the first housing 1902. Such a design would reduce material cost and lighten weight.

Example 5

FIGS. 24*a* through 24*i* illustrate a buttstock 2400 having a RMBF adapter mechanism 2500 according to another aspect of the present invention. In certain situations, it may be advantageous to have a substantially sealed RMBF adapter mechanism to prevent penetration of the internal mechanism by unwanted material and/or fluid. Such a configuration also provides for a greater field of rotation. In fact, as will be discussed, the RMBF adapter mechanism 2500 according to this aspect can facilitate a full rotation (360°) in either direction (i.e., clockwise or counterclockwise).

Figure 24E:
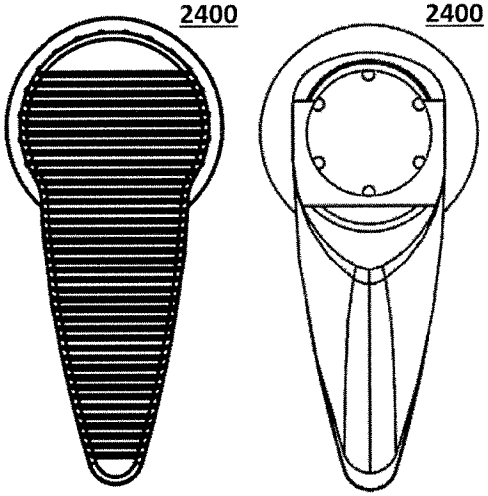
FIG. 24*e* illustrates a rear view of the buttstock of FIG. 24*a*.
Figure 24G:
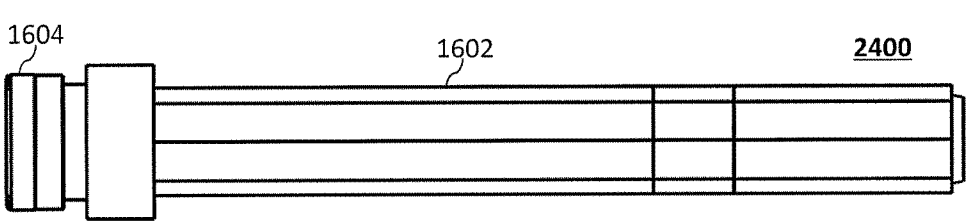
FIG. 24*g* illustrates a top plan view of the buttstock of FIG. 24*a*.
Figure 24H:
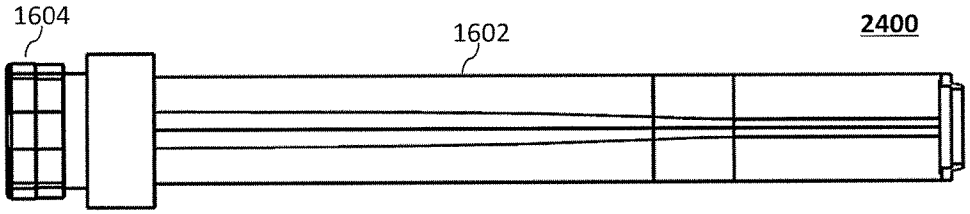
FIG. 24*h* illustrates a bottom plan view of the buttstock of FIG. 24*a*.
Figure 24F:
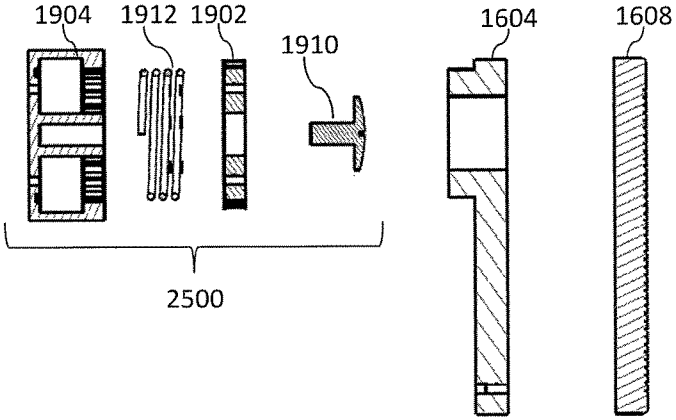
FIG. 24*f* illustrates a front view of the buttstock of FIG. 24*a*.
Figure 24I:
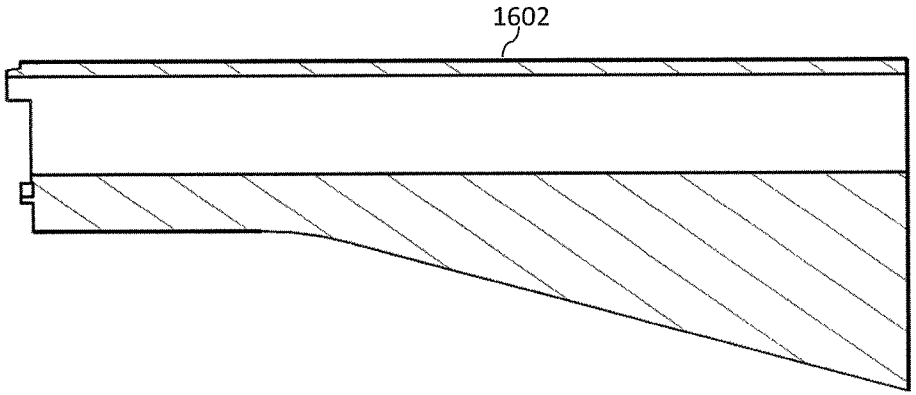
FIG. 24*i* illustrates a cross-sectional assembly side view of the buttstock of FIG. 24*a*.

FIG. 24*a* illustrates a front perspective view of a buttstock 2400 having a RMBF adapter mechanism 2500 that is substantially sealed, while FIG. 16*b* illustrates a second front perspective view. As with the first buttstock 1600 of FIG. 16*a*, buttstock 2400 may comprise a fixed buttstock portion 1602, and movable buttstock portion 1604, however a RMBF adapter mechanism disposed therebetween, wherein the movable buttstock portion 1604 is configured to rotate between a plurality of positions. However, the RMBF adapter mechanism 2500 of FIG. 24*a* is substantially sealed. FIGS. 24*c* through 24*h* illustrate a first side view, a second side view, a rear view, a front view, top plan view, and a bottom plan view of the buttstock 2400, respectively. FIG. 24*i* illustrates a cross-sectional side assembly view of the buttstock 2400 and RMBF adapter mechanism 2500.

Turning now to FIGS. 25*a* through 25*d*, a fifth example RMBF adapter mechanism 2500, which may be substantially sealed when assembled, generally comprises a first housing 1902 that resembles a cogged disk, a second housing 1904, a helical spring 1912 disposed therebetween, and a screw 1910 configured to secure the first housing 1902 to the second housing 1904.

As with the prior examples, the first housing 1902 may be sized such that the outside diameter is about equal to, or slightly less than, the inside diameter of the other housing (e.g., the second housing 1904). This configuration enables the housings to move telescopically relative to one another. A plurality of cogs 2502 (e.g., male components) positioned along the outer circumferential edge of the first housing 1902 are sized and shaped to correspond with, and engage, a plurality of gullets 2504 (e.g., female components) configured along the inner circumferential edge of the second housing 1904. While the first housing 1902 is illustrated and described as being male, with the plurality of cogs 2502 being male, the opposite arrangement may be employed. That is, the first housing 1902's plurality of cogs 2502 may be replaced with a plurality of gullets 2504 configured to engage a plurality of cogs 2502 positioned on the inner circumferential edge of the second housing 1904.

Figure 25B:
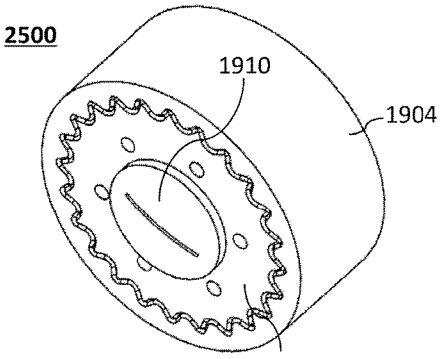
FIG. 25*b* illustrates a rear perspective view of the fifth example RMBF adapter mechanism of FIG. 25*a*.
Figure 25E:
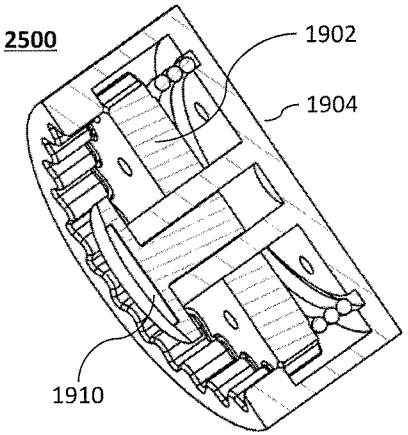
FIG. 25*e* illustrates a cross-sectional side view of the fifth example RMBF adapter mechanism of FIG. 25*a* in a compressed position.
Figure 25A:
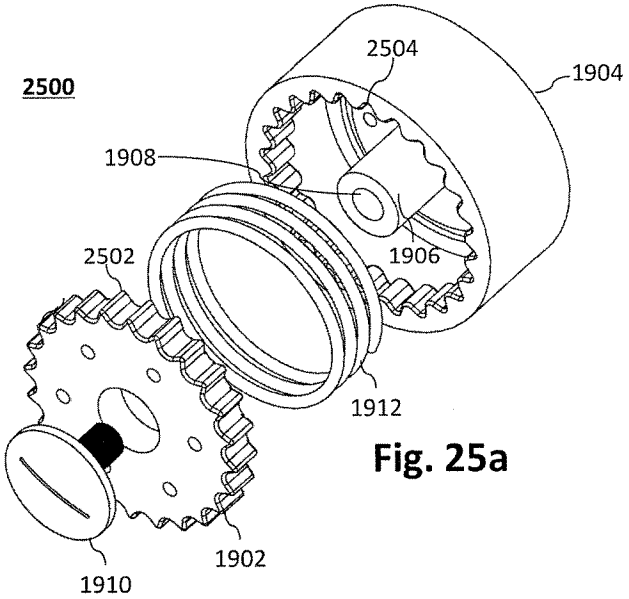
FIG. 25*a* illustrates an assembly view of a fifth example RMBF adapter mechanism.
Figure 25D:
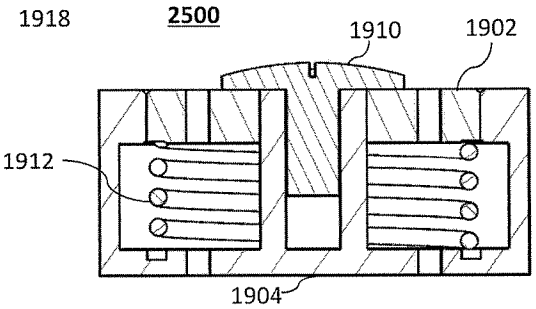
FIG. 25*d* illustrates a cross-sectional side view of the fifth example RMBF adapter mechanism of FIG. 25*a* in an extended position.
Figure 25C:
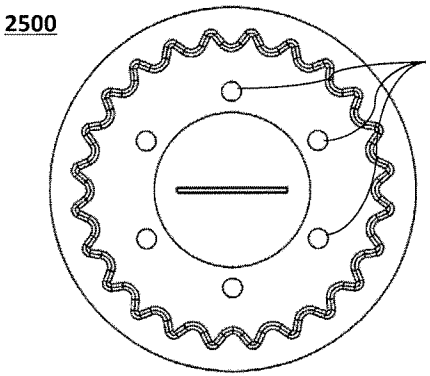
FIG. 25*c* illustrates a top plan view of the fifth example RMBF adapter mechanism of FIG. 25*a*.
Figure 26A:
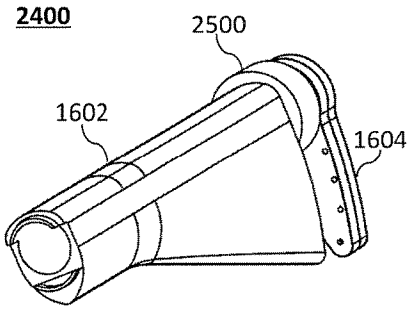
FIGS. 26*a* through 26*l* illustrate front perspective views of the buttstock of FIG. 24*a* in various axial angle positions.
Figure 26B:
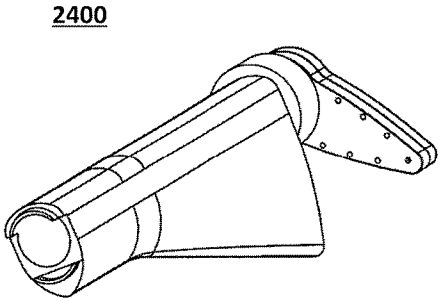
Figure 26C:
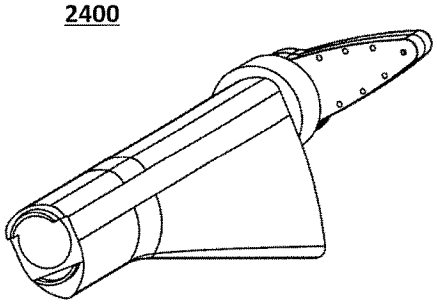
Figure 26D:
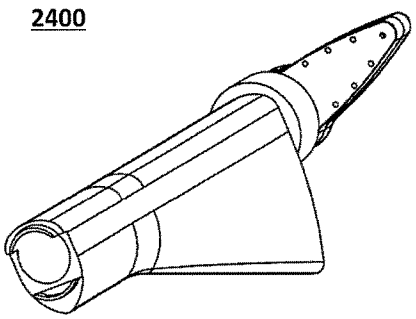
Figure 26E:
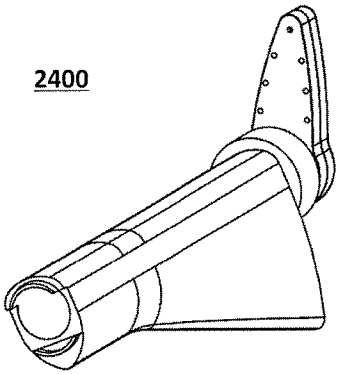
Figure 26F:
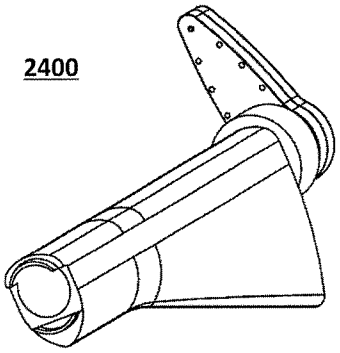
Figure 26G:
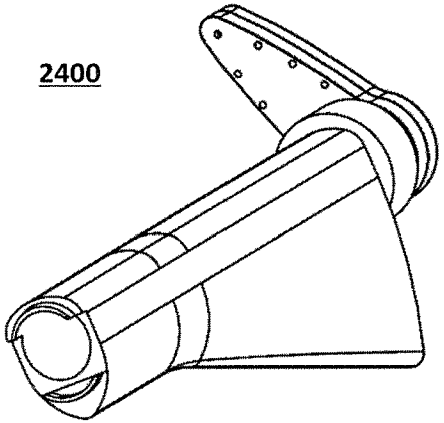
Figure 26H:
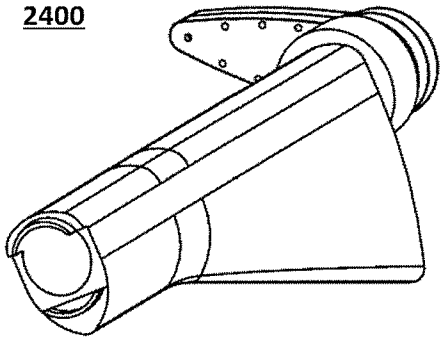
Figure 26I:
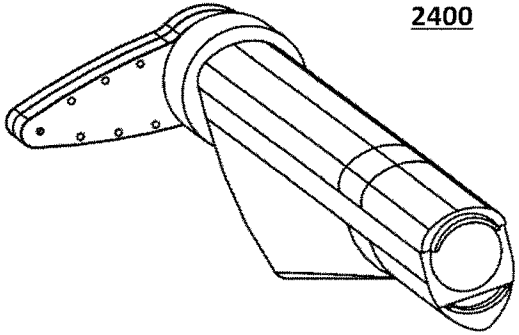
Figure 26J:
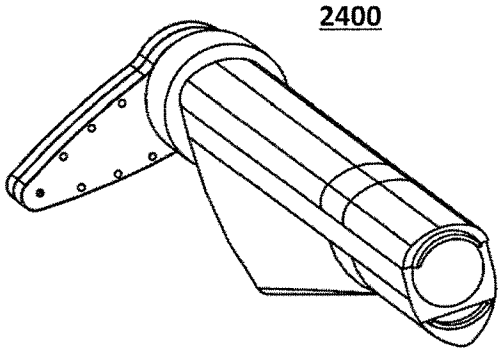
Figure 26K:
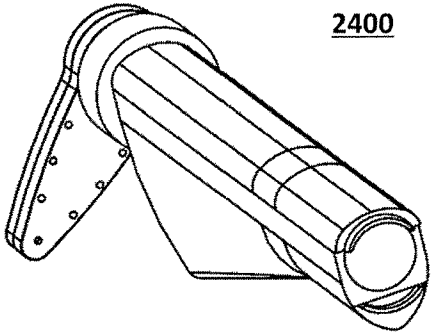
Figure 26L:
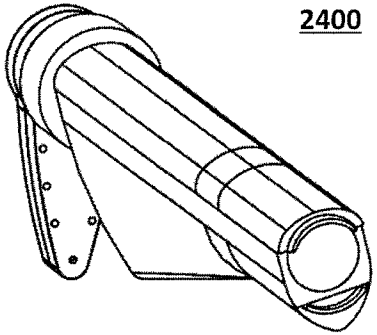

The two housings may be slidably coupled to one another by a post 1906 that extends from the center of the second housing 1904 and penetrates the center of the first housing 1902. The post 1906 also acts as an axis of rotation for the housings relative to one another. In order to limit the telescopic travel of the two housings relative to one another, the post may have a threaded hole 1908 sized to receive a screw 1910. As illustrated, the screw 1910 has a screw head that is larger than the post 1906 and the hole provided at the center of the first housing 1902's base, thus functioning as a barrier that limiting the telescopic travel of the housings. To change the axial angle position, a force may be applied to the first housing 1902, thereby causing the helical spring 1912 to compress. Once enough force has been applied to the first housing 1902, as illustrated in FIG. 25*e*, the plurality of cogs 2502 disengage the plurality of gullets 2504, thereby enabling free axial rotation. Once a desired axial angle position has been selected, the force may be released from the first housing 1902, thereby allowing the plurality of cogs 2502 to reengage the plurality of gullets 2504 and securing the first housing 1902 in desired axial angle position with regard to the second housing 1904. In order to assist in the engagement between the cogs and gullets, a chamfer is machined on the periphery of both gullets and cogs, these chamfers will help align the Cogs and gullets, which will result in a quicker and smoother angle selection.

The number of cogs 2502 and gullets 2504 governs the number of axial angle positions that may be selected/secured. For example, the first housing 1902 illustrates 24 evenly distributed cogs 2502 (and the second housing 1904, 24 evenly distributed gullets 2504). Accordingly, the RMBF adapter mechanism 2500 of FIGS. 25*a* through 25*e* would have 24 axial angle positions that may be selected during a full rotation (360°). However, one of skill in the art would recognize that the number of cogs 2502 (and gullets 2504) may be increased, or decreased, to achieve a desired number of available axial angle positions. While it is preferably to employ the same number of cogs 2502 and gullets 2504 to increase contact area between the first housing 1902 and the second housing 1904, thus reducing unwanted movement, the number of cogs 2502 and gullets 2504 need not be the same. For example, the first housing 1902 may employ fewer (e.g., one-half, or another fraction) evenly distributed cogs 2502, while the second housing 1904 may retain, for example, the illustrated 24 evenly distributed gullets 2504. In such an example, every other gullet 2504 would engage a cog 2502.

FIGS. 26*a* through 26*l* illustrate front perspective views of the buttstock 2400 in various axial angle positions. Specifically, FIGS. 26*a* through 26*l* illustrate clockwise axial angle positions of 0° (e.g., a default upright position), 45°, 90°, 105°, 150°, 195° (i.e., 165° counterclockwise), 210° (i.e., 150° counterclockwise), 240° (i.e., 120° counterclockwise), 270° (i.e., 90° counterclockwise), 285° (i.e., 75° counterclockwise), 315° (i.e., 45° counterclockwise), and 345° (i.e., 15° counterclockwise).

Example 6

Turning now to FIGS. 27*a* through 27*d*, a sixth example RMBF adapter mechanism 2700, which may also be substantially sealed when assembled, generally comprises a second housing 1904 having a plurality of pins 2702 perpendicularly disposed on the inner surface of the second housing 1904's cylindrical wall, a first housing 1902 having a plurality of gullets 2704 configured along the outer surface of the first housing 1902's cylindrical wall, a helical spring 1912 disposed therebetween, and a screw 1910 configured to secure the first housing 1902 to the second housing 1904.

As with the prior examples, the first housing 1902 may be sized such that the outside diameter is about equal to, or slightly less than, the inside diameter of the other housing (e.g., the second housing 1904). This configuration enables the housings to move telescopically relative to one another. A plurality of pins 2702 (e.g., male components), which may be perpendicularly disposed on the inner surface of the second housing 1904's cylindrical wall, are sized and shaped to correspond with, and engage, a plurality of gullets 2704 (e.g., female components) configured along the outer surface of the first housing 1902's cylindrical wall. While the first housing 1902 is illustrated and described as being female, with the plurality of gullets 2704 being female, the opposite arrangement may be employed. That is, the first housing 1902's plurality of gullets 2704 may be replaced with a plurality of pins 2702 configured to engage a plurality of gullets 2704 positioned on the outer circumferential edge of the second housing 1904.

The two housings may be slidably coupled to one another by a post 1906 that extends from the center of the second housing 1904 and penetrates the center of the first housing 1902. The post 1906 also acts as an axis of rotation for the housings relative to one another. In order to limit the telescopic travel of the two housings relative to one another, the post may have a threaded hole 1908 sized to receive a screw 1910. As illustrated, the screw 1910 has a screw head that is larger than the post 1906 and the hole provided at the center of the first housing 1902's base, thus functioning as a barrier that limiting the telescopic travel of the housings. To change the axial angle position, a force may be applied to the first housing 1902, thereby causing the helical spring 1912 to compress. Once enough force has been applied to the first housing 1902, the plurality of pins 2702 disengage the plurality of gullets 2704, thereby enabling free axial rotation. Once a desired axial angle position has been selected, the force may be released from the first housing 1902, thereby allowing the plurality of pins 2702 to reengage the plurality of gullets 2704 and securing the first housing 1902 in desired axial angle position with regard to the second housing 1904. In order to assist in the engagement between the pins and gullets, a chamfer is machined on the periphery of both gullets and pins; these chamfers will help align the pins and gullets, which will result in a quicker and smoother angle selection.

The number of pins 2702 and gullets 2704 governs the number of axial angle positions that may be selected/secured. For example, the first housing 1902 illustrates eight evenly distributed gullets 2704 (and the second housing 1904, four evenly distributed pins 2702). Accordingly, the RMBF adapter mechanism 2700 of FIGS. 27*a* through 27*d* would have eight axial angle positions that may be selected during a full rotation (360°). However, one of skill in the art would recognize that the number of pins 2702 (and gullets 2704) may be increased, or decreased, to achieve a desired number of available axial angle positions. While it is preferably to employ the same number of pins 2702 and gullets 2704 to increase contact area between the first housing 1902 and the second housing 1904, thus reducing unwanted movement, the number of pins 2702 and gullets 2704 need not be the same. For example, the first housing 1902 may employ a greater number (e.g., double, or another multiplier) of evenly distributed gullets 2704, while the second housing 1904 may retain, for example, the illustrated four evenly distributed pins 2702.

Figure 27A:
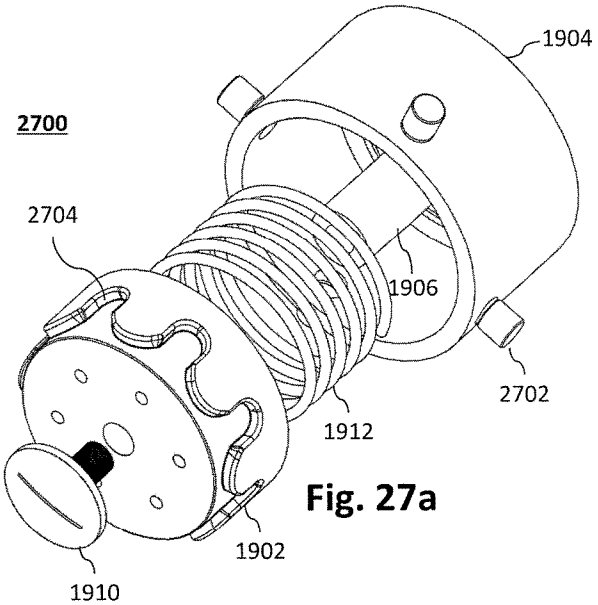
FIG. 27*a* illustrates an assembly view of a sixth example RMBF adapter mechanism.
Figure 27B:
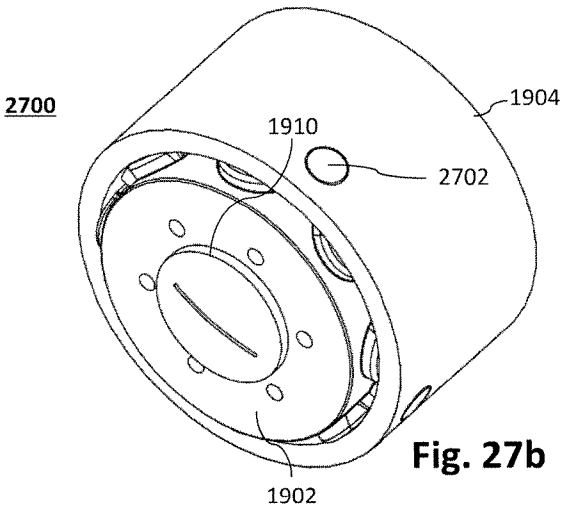
FIG. 27*b* illustrates a rear perspective view of the sixth example RMBF adapter mechanism of FIG. 27*a*.
Figure 27C:
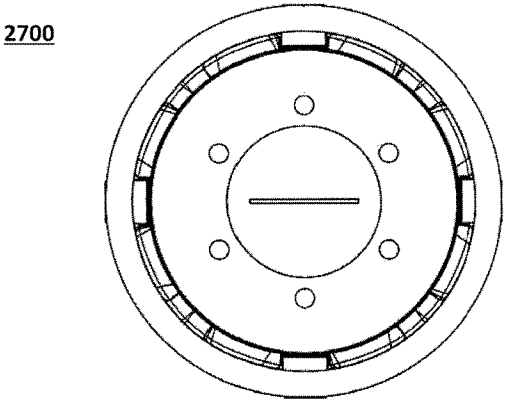
FIG. 27*c* illustrates a top plan view of the sixth example RMBF adapter mechanism of FIG. 27*a*.
Figure 27D:
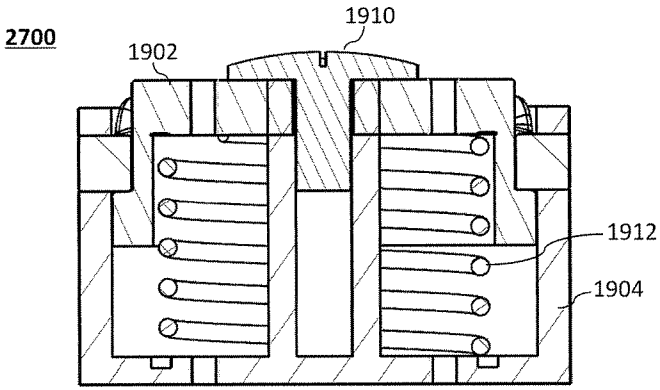
FIG. 27*d* illustrates a cross-sectional side view of the sixth example RMBF adapter mechanism of FIG. 27*a* in an extended position.

RMBF adapter mechanism 2700 provides a number of advantages. First, it shifts the load (recoil and spring decompression when cycling the firearm) from the screw 1910 (e.g., a main screw) to a number of a plurality of pins 2702, which could be, for example, four pins (as illustrated in FIG. 27*a*), or eight pins (as illustrated in FIG. 28*a*). As a result, any issues that may arise from the screw 1910 loosening up and leading to the system malfunction are mitigated. In certain situations, the screw 1910 will loosen up during weapon cycling, however, this is a not an issue. In fact, RMBF adapter mechanism 2700 will still function even if the screw 1910 is removed. Finally, a built-in redundancy is provided. That is, multiple pins 2702 do the work of angle positioning, travel limitation, and load bearing. The system will still operate even if all but one of the pins 2702 are sheared, and even if the screw 1910 loosens up or is sheared. Redundancy is desirable; it leads to system reliability.

Example 7

Turning now to FIGS. 28*a* through 28*d*, a seventh example RMBF adapter mechanism 2800, which may also be substantially sealed when assembled, generally comprises a first housing 1902 having a plurality of pins 2702 perpendicularly disposed on the outer surface of the first housing 1902's cylindrical wall, a second housing 1904, a helical spring 1912 disposed therebetween, and a screw 1910 configured to secure the first housing 1902 to the second housing 1904. The RMBF adapter mechanism 2800 is a variation of the RMBF adapter mechanism 2700 having eight pins 2702, instead of four pins 2702. While eight and four are illustrated, other numbers are possible (e.g., 2 to 24).

Example 8

Turning now to FIGS. 29*a* through 29*e*, an eighth example RMBF adapter mechanism 2900 generally comprises a first housing 2708 having a plurality of pins 2702 perpendicularly disposed on the outer surface of the first housing 2708's cylindrical wall, a second housing 2706, a third housing 2710, a helical spring 1912 disposed between the second housing 2706 and the third housing 2710, and a screw 1910 configured to secure the first housing 1902 to the third housing 2710. RMBF adapter mechanism 2900 allows full access (360° degrees), and no access limitation from the outside diameter of the second housing 2706 (which is vertically movable), to attach the buttstock (or part of the weapon) to either face of RMBF adapter mechanism 2900. This concept moves the first housing 2708, which operates as an angle positioning mechanism and travel limitation barrier, out of the way and buries it inside the unit where it causes less interference with attachment or other parts of the firearm. RMBF adapter mechanism 2900 provides less redundancy than the RMBF adapter mechanism 2800, but increased reliability over certain other RMBF adapter mechanisms (e.g., adapter mechanisms 1900, 2000, 2100, 2300, 2500). Further, the screw 1910 does all the load bearing; however, this concept has built in redundancy in case a pin 2702 shears. In fact, one pin 2702 can still do the work of angle positioning and travel limitation.

When the RMBF is installed on high power firearms utilization of a spring with a higher spring constant is desirable, however, in such instances collapsing the spring in order to rotate the buttstock becomes very difficult especially while holding the firearm against the shoulder in a shooting position. For this reason the inventor has designed a few solutions to address this issue as will be demonstrated in examples 9-12.

Example 9

Turning to FIGS. 30*a* through 30*d* illustrate a modified design of the first example RMBF, adapter mechanism 3000, which may comprise a first housing 1902, a second housing 1904, a variable rate helical spring 3012 disposed there between, and a screw 1910 configured to secure the first housing 1902 to the second housing 1904, an angle guide selector 1914 cutout from the second housing 1904, and a pin 1916. As illustrated, this arrangement utilizes a variable rate spring. The variable rate spring in this example is configured such that it would require a reasonable amount of force (similar to the previous examples discussed examples 1 through 9) to collapse the spring in order to enable rotation of the first housing. However, collapsing the spring beyond the range to enable rotation of the first housing, requires larger amount of force, such a larger amount of force is desirable when firing high power ammunition. Therefore, the variable rate spring is configured to allow the firearm operator to collapse and rotate the stock utilizing reasonable force (similar to the previously illustrated examples), and collapsing the spring beyond the range needed to rotate the spring requires substantial force due to the higher spring rate, such a feature is desirable when firing high powered ammunition.

Example 10

Turning to FIGS. 31*a* through 31*d* illustrate a modified design of the first example RMBF, adapter mechanism 3100, which may comprise a first housing 1902, a dividing plate 3102, a first helical spring with constant spring rate 1912 disposed there between, a second housing 3104, a second spring 3103 disposed between the dividing plate and the second housing and a Bolt 3105 configured to secure the first housing 1902 to the second housing 3104. The bolt 3105 also acts as a rotation axis for 1902 to rotate clockwise and counter clock wise guided by the pin 1916 and the cut out geometry 1914. The dividing plate 3102 divides the space between the first housing 1902 and second housing 3104 into two regions, one is occupied by the first helical spring 1912 and the second region is occupied by the second spring 3103. The bolt 3105 acts as an axial axes allowing the dividing plate 3102 to move axially between the first spring and second spring.

The first spring 1912 has a spring constant similar to that of example 1, and the second spring 3013 has a spring constant larger than that of the first spring. When the firearm operator applies pressure to collapse the RMBF in order to rotate the buttstock, the first spring 1912 will collapse and allow the first housing to rotate, the rotation is guided by the interaction between the pin 1916 and the cutout geometry 1914, once the desired position is attained, the operator relaxes pressure on the buttstock and the first housing 1902 is positioned in the new desired position. During this whole process the second spring which has a much higher spring constant than the first spring, may not collapse or may collapse slightly, in either case it will not interfere with the function of the RMBF to allow rotation of the buttstock. The second spring 3103 which has a higher spring constant than the first spring, the first spring will absorb and dissipate some of the recoil energy especially when firing heavy caliper ammunition using the firearm such that the recoil energy may be too large to be absorbed partially or fully by the first spring, In such instances when the first spring is completely collapsed and is unable to absorb any more energy, the excess energy will be transmitted to the second spring which in turn collapses absorbing more of the recoil energy, the balance of recoil energy let will be transmitted to the firearm operator at the point of contact between the buttstock and firearm operator. Therefore, absence of the second spring would have resulted in more of the recoil energy transmitted to the firearm operator.

Example 11

Turning to FIGS. 32*a* through 32*d* illustrate a modified design of the eleventh example RMBF adapter, mechanism 3200, which may comprise a first housing 1902, a dividing plate 3102, a first helical spring 1912 disposed there between, a second housing 3104, a second spring 3201 disposed between the dividing plate and the second housing, and a third spring 3202 that is disposed between the second housing and the dividing plate, the third spring is fixed to the second housing and is designed (when the mechanism is in the expanded position) to have an overall length that is shorter than the distance between the dividing plate and the second housing, this distance is set by the second spring which contacts at one end the second housing and at the other end the dividing plate. The third spring is larger in diameter than the second spring in this layout the springs are concentric to each other. The second spring 3201 has a spring constant that is smaller in value than that of the first spring, the third spring has a spring constant that is larger than the spring constant for either first or second springs. Bolt 3105 is configured to secure the first housing 1902 to the second housing 3104. Bolt 3105 also acts as a rotation axis for the first housing 1902 to rotate clockwise or counter clock wise guided by the pin 1916 and the cut out geometry 1914. The dividing plate 3102 divides the space between the first housing 1902 and second housing 3104 into two regions, one is occupied by the first helical spring 1912 and the second region is occupied by the second spring 3201 and the third spring 3202. Bolt 3105 acts as an axial axes allowing the dividing plate 3102 to move axially between the first spring and second spring and the third spring. The second dividing plate may contact the third spring when enough force is applied to the RMBF mechanism such that it results in the collapse of the second spring and allows the dividing plate to contact the third spring.

The first spring has a spring constant similar to that of example 10, the second spring has a spring constant smaller than that of the first spring, the third spring has a spring constant that is larger than either first or second springs. When the firearm operator applies pressure to collapse the RMBF in order to rotate the buttstock, the second spring will collapse firstly, since it has a spring constant smaller than that of the first spring, the second spring will continue to collapse and the divining plate will travel axially until it makes contact with the third spring. Once contact between dividing plate and third spring occurs, continued pressure on the RMBF will collapse the first spring which will allow the first housing to rotate, the rotation is guided by the interaction between the pin 1916 and the cutout geometry 1914, once the desired position is attained, the operator relaxes pressure on the buttstock and the first housing is positioned in the new desired position. During this whole process the second spring (which has a spring constant smaller than that of the first) is in the fully or partially collapsed condition, however, the third spring which has a spring constant larger than either first or second spring may not collapse or may collapse slightly, in either case it will not interfere with the function of the RMBF to allow rotation of the buttstock.

When a firearm with the said RMBF attached to it is fired, the second spring which has a spring constant smaller than that of the first spring will act first to absorb and dissipate some of the recoil energy, depending on the caliper of the ammunition being used and the recoil delivered by such ammunition, the second spring might absorb enough recoil energy that neither the first spring, nor the third springs are involved in absorbing and dissipating excessive recoil energy. However, when high powered ammunition is fired and results in the collapse of the second spring, the second spring collapse may not be enough to absorb and dissipate the recoil energy, in such instances the first spring will collapse and absorb and dissipate the excessive recoil energy, in some instances when very high caliper rounds are fired the collapse of both first and second spring might be insufficient to absorb the recoil energy, in such instances the third spring will collapse and it will absorb recoil energy that both first and second spring were unable to absorb and dissipate. The advantage that this configuration provides is that this mechanism adapts to different levels of recoil energy, low (only the second spring is affected), while the second spring which has two functions (buttstock rotation and recoil energy mitigation) is not affected which will result in a more stable position of the buttstock (chances of inadvertent buttstock rotation are eliminated, operator will not need to worry about such an mishap), medium, in this instance both the second and first springs are affected and collapse either fully or partially, and high in this instance all three springs are affected and collapse totally or partially to absorb the recoil energy.

Example 12

Turning to FIGS. 33*a* through 33*d* illustrate a modified design of the twelfth example RMBF that utilizes three springs, adapter mechanism 3300, which may comprise a first housing 1902, a dividing plate 3102, a first helical spring 1912 disposed there between, a second dividing plate 3301 and a second spring 3103 disposed between the first and second dividing plates, and a second housing 3303, a third spring 3302 disposed between the second dividing plate and the second housing. The two dividing plates divide the space between the first and the second housing into three distinct regions, three springs are each disposed within the three regions. The first spring 1912 has a spring constant similar to that of the first spring in example 11, the second spring 3103 has a spring constant similar to that of the second spring in example 10, The third spring 3302 has a spring constant that is smaller in value than either first or second springs. Bolt 3304 is configured to secure the first housing 1902 to the second housing 3303. The bolt 3304 also acts as a rotation axis for 1902 to rotate clockwise and counter clock wise guided by the pin 1916 and the cut out geometry 1914. The dividing plates 3102 and 3301, divide the space between the first housing 1902 and second housing 3303 into three regions, one is occupied by the first helical spring 1912 and the second region is occupied by the second spring 3103, the third region is occupied by the third spring 3302. The bolt 3304 acts as an axial axes allowing the dividing plate 3102 to move axially between the first spring and second spring, it also allows the second dividing plate 3301 to move axially between the second spring and the third spring.

The first spring 1912 has a spring constant similar to that of example 10, and the second spring 3103 has a spring constant larger in value than that of the first spring and is similar to the second spring in example 10, the third spring 3302 has a spring constant that is smaller in value than either first or second springs. When the firearm operator applies pressure to collapse the RMBF in order to rotate the buttstock, the third spring 3302 will collapse firstly since it has a spring constant smaller than that of the first spring, the third spring will continue to collapse and the second dividing plate 3301 will travel axially until the third spring is completely or almost completely collapsed (this depends on the actual value of the spring constant compared to the that of the first and seconds springs). Once the spring is fully collapsed and/or no more compression of the third spring is possible, continued pressure will collapse the first spring 1912 which will allow the first housing 3303 to rotate, the rotation is guided by the interaction between the pin 1916 and the cutout geometry 1914, once the desired position is attained, the operator relaxes pressure on the buttstock and the first housing will be positioned in the new desired position. During this whole process, the third spring 3302 which has a spring constant smaller than that of the first spring is in the fully or partially collapsed condition, however, the second spring 3103 which has a spring constant larger than either first or third springs may not collapse or may collapse slightly, in either case it will not interfere with the function of the RMBF to allow rotation of the buttstock. When the firearm operator fires a round, the third spring 3302 which has a spring constant smaller than that of the first spring 1912 will collapse first to absorb and dissipate some of the recoil energy, depending on the caliper of the ammunition being used, the third spring 3302 might absorb enough recoil energy that neither the first spring 1912, nor the second springs 3103 are involved in absorbing and dissipating excessive recoil energy. However, when high powered ammunition is fired and results in the collapse of the third spring, the collapse of the third spring 3302 may not be enough to absorb and dissipate the recoil energy, in such instances the first spring 1912 will collapse and absorb and dissipate the excessive recoil energy, in some instances when very high caliper rounds are fired the collapse of both first 1912 and third spring 3302 might not be sufficient to absorb the recoil energy, in such instances the second spring 3103 will collapse and it will absorb recoil energy that both first and third springs were unable to absorb and dissipate.

The advantage that this configuration provides is similar to that of example 11, in that this mechanism adapts to different levels of recoil energy, however, example 11 has an advantage over example 12, in that example 11 requires less space than example 12 while performing almost the same function, however, example 12 has an advantage over example 11 in that the third spring in example 11 requires fastening of the third spring to the second housing, whereas, in example 12 there is no such requirement and each spring occupies a separate region within the divided space between the two housings, each spring in this instance is supported by a divider plate and a housing or two divider plates.

Example 13

Turning to FIGS. 34*a* through 34*d* illustrate a modified design of the thirteenth example RMBF that utilizes two springs and a polymer buffer, adapter mechanism 3400, which may comprise a first housing 1902, a dividing plate 3102, a first helical spring 1912 disposed there between, a second dividing plate 3401 and a second helical spring 3103 disposed between the first and second dividing plates, and a second housing 3403, a polymer buffer 3402 disposed between the second dividing plate and the second housing. The two dividing plates divide the space between the first and the second housing, two springs and a polymer buffer are each disposed within the three spaces. The first spring 1912 has a spring constant similar to that of the first spring in example 10, the second spring 3013 has a spring constant similar to that of the second spring in example 10, the polymer buffer 3402 may be made of elastic material or a Visco Elastic Material (VEM) or a material that combines properties of both elastic and VEM. Bolt 3304 is configured to secure the first housing 1902 to the second housing 3403. The bolt 3304 also acts as a rotation axis for the first housing 1902 to rotate clockwise and counter clock wise guided by the pin 1916 and the cut out geometry 1914. The dividing plates 3102 and 3401, divide the space between the first housing 1902 and second housing 3403 into three regions, one is occupied by the first helical spring 1912 and the second region is occupied by the second spring 3103, the third region is occupied by the polymer buffer 3402. The bolt 3304 acts as an axial axes allowing the dividing plate 3102 to move between the first spring and second spring, it also allows the second dividing plate 3401 to move between the second spring 3013 and the polymer buffer 3402.

The first helical spring 1912 has a spring constant similar to that of example 10, and the second spring 3013 has a spring constant larger in value than that of the first spring and is similar to the second spring in example 10, the polymer buffer 3402 may be made of an elastic or VEM material. The second housing 3403 consists of a cup at one end with tapered sides and is open on the other end, the tapered sides of the cup encapsulate the polymer buffer 3402 which has mating male taper on its outside diameter, the two tapers (that of the inside walls of the cup and that of the polymer buffer outside diameter), match each other and when assembled together form a complete fit.

Use of a polymer buffer 3402 which may be made up of Visco Elastic material (VEM) this materials mostly belongs to the family of Urethane or latex materials. When VEM material is used in the RMBF it performs two functions, once the recoil energy hits the VEM, the VEM will start to collapse and will transmit the energy in all directions away from the source of the recoil energy, the energy will be transmitted both axially and radially, the radial component will be transmitted into the walls of the RMFB that are encapsulating the VEM, however, the encapsulating walls are made up of a material with a high modulus of elasticity (preferably Steel or steel alloy or Aluminum or Aluminum alloy), therefore, the walls will experience a minor deflection and most of this energy will be dissipated into the RMBF walls as heat, the recoil energy, therefore, will be reduced by the amount of energy dissipated radially by the VEM, which will contribute to the reduction of the felt recoil. Remaining axial component of the recoil energy will cause the VEM to deform in the axial direction, any energy not used up in the VEM deformation will be transmitted through the rest of the RMBF body where it will act on the spring or springs and cause them to compress axially, the balance of recoil energy ((recoil energy—energy dissipated in VEM compression (both radial and axial components)—energy dissipated in the spring or springs deflection)) will be transmitted through the butt stock and onto the point of contact with the body of the firearm bearer.

The aforementioned VEM absorbs the recoil energy and dissipates it axially and radially, however, most of the examples of this material available commercially have a slow recovery (time it takes to restore its original physical dimensions), the recovery rate is usually longer than 0.5 seconds, such a property will render this material non-ideal for a fast rate of recoil experienced when firing an automatic weapon, however, for weapons that are not fired at a high rate (examples are sniper rifles and most shotguns and most semi-automatic carbines), the slow recovery time of the VEM will not be an issue since rounds are usually fired with a longer span in between (longer than 0.5 seconds) which is ample time to allow recovery of the VEM, and the VEM incorporated in the assembly of the RMBF will perform dissipate energy radially and axially. Until a Visco Elastic material with very short recovery rate (less than 0.5 seconds) becomes available, firearms that shoot at a high rate will utilize a Micro Cellular material, these polymers mostly belong to the polyurethane family, such materials when used in the RMBF invention will absorb the recoil energy, and will transmit the balance of recoil energy, mostly in the axial direction, and a very small component in the radial direction, the Micro cellular material has a very short recovery rate it can range from 0.01-0.5 seconds, which makes it ideal for full automatic firearms, and in this instance performs a function very close to that of a helical spring.

The reason for utilizing a tapered cup as illustrated in FIG. 34*d* in the second housing 3403 (detail 3405) is to provide preferential movement or expansion of the polymer when the force acting on it and causing it to compress is removed to further improve the polymer recovery.

When the firearm operator applies pressure to collapse the RMBF in order to rotate the buttstock, the polymer buffer 3402 will collapse until the force needed to collapse it any further exceeds the force needed to collapse the first spring 1912, at this point the continued pressure onto the RMBF will lead to the collapse of the first spring 1912 which will allow the first housing 1902 to rotate, the rotation is guided by the interaction between the pin 1916 and the cutout geometry 1914, once the desired position is attained, the operator relaxes pressure on the buttstock and the first housing is positioned in the new desired position. During this whole process the polymer buffer 3402 is being compressed. The second spring 3103 which has a spring constant larger than the first spring may not collapse or may collapse slightly, in either case it will not interfere with the function of the RMBF to allow rotation of the buttstock.

When a round is fired the polymer buffer 3402 which may be made up of a purely elastic material or a purely VEM or may be somewhere in between VEM and pure elastic, is subjected to the recoil energy, depending on its properties as a VEM or as an elastic material, the latter will compress just like a helical spring and in doing so will absorb some of the energy during its compression and will transmit mostly in the axial direction the balance to the rest of the recoil energy to the springs within the RMBF. Whereas, a pure VEM will absorb some of the recoil energy and will dissipate some of it due to the collapse of the VEM, some recoil energy is dissipated as heat, while the balance of the recoil energy will be transmitted both axially and diametrically into the body of the RMBF, specifically, the part that is encapsulating the VEM. Energy transmitted to the side walls of the RMBF will cause a slight deflection of the RMBF walls, whereas, the major portion of this energy will be transformed into heat. The balance of recoil energy, which has been reduced by the energy dissipated in the VEM and reduced by the amount of energy dissipated in the side walls of the RMBF, is transmitted to the first spring 1912 which will deflect first since it has a lower value spring constant than the second spring 3103, if such amount of energy completely collapses the first spring 1912, the balance of energy left will be transmitted to the second spring 3103. The second spring will absorb and dissipate the some or all the energy transmitted to it, any energy left after the second spring is completely collapsed will be transmitted onto the point of contact between the firearm operator and the point of contact with the firearm Example 14

Turning to FIGS. 35*a* through 35*d* illustrate a modified design of the fourteenth example RMBF that utilizes two springs and a polymer buffer, adapter mechanism 3500, which may comprise a first housing 3501, a dividing plate 3502, a polymer buffer 3402 disposed there between, a second dividing plate 3502 and a second spring 1912 disposed between the first and second dividing plates, and a second housing 3303, a second spring 3103 disposed between the second dividing plate and the second housing. The two dividing plates divide the space between the first and the second housing into three distinct spaces, two springs and a polymer buffer are each disposed within the three spaces. The first spring 1912 has a spring constant similar to that of the first spring in example 10, the second spring 3103 has a spring constant similar to that of the second spring in example 10, polymer buffer 3402 is similar to that of example 13. Bolt 3304 is configured to secure the first housing 3501 to the second housing 3303. The bolt 3304 also acts as a rotation axis for 3501 to rotate clockwise and counter clock wise guided by the pin 1916 and the cut out geometry 1914. The dividing plates 3502 and 3102, divide the space between the first housing 3501 and second housing 3303 into three regions, the first region is occupied by the polymer buffer 3402, the second region is occupied by the first helical spring 1912 and the third region is occupied by the second spring 3103. The bolt 3304 acts as an axial axes allowing the dividing plate 3502 to move axially between the polymer buffer and the first spring, it also allows the second dividing plate 3102 to move axially between the first and second springs.

The components of mechanism 3500 function similarly to those of mechanism 3400, the main difference is in this example the first housing encapsulates the polymer buffer 3402 and its inside walls 3405 are tapered to match the sides of the polymer buffer, whereas, in example 13, the second housing encapsulated the polymer buffer and had the tapered inside walls to match the sides of the polymer buffer. The main reason for this arrangement is the energy dissipated within the VEM is mostly transformed into heat in addition to the energy transmitted and dissipated into the sides of the RMBF it too is mostly transformed into heat. The intention of the inventor in this arrangement is to dissipate this heat away from the body of the firearm where it may affect the function of the firearm, and into the buttstock, either arrangement depends on the preference of the firearm operator and the prevailing conditions under which the firearm is being used.

Example 15

Turning to FIGS. 36*a* through 36*d*, a fifteenth example RMBF adapter mechanism 3600 may comprise a first housing 1902, a second housing 3601, a helical spring 3602 disposed there between, and a screw 1910 (or bolt, or the like) configured to secure the first housing 1902 to the second housing 3601. As illustrated, the first housing 1902 and the second housing 3601 may be generally shaped like cups, that is, a circular planar surface having a cylindrical wall (or portion thereof) at the circumference of the circular planar surface.

This RMBF mechanism is identical to mechanism 1900 of example 1, the only difference is that this example has a protruding ledge from the second housing such that this ledge along with the first housing completely encloses the spring, therefore, isolating the spring from the surroundings which is desirable to keep the operator gear or clothing from getting caught by the spring while handling or using a firearm with an RMBF mechanism installed on it.

Referring to FIGS. 37*a* through 37*d*, FIGS. 38*a* through 38*d*, and FIGS. 39*a* through 39*d*, illustrate a sliding buttstock 3701 attached to firearm 1000, a RMBF mechanism of example 15 (3600) of this invention is attached to the end of the sliding buttstock 3701, attached to the first housing of the RMBF is the floating part of the buttstock 1604. FIG. 37*a* illustrates a rear perspective view of the sliding buttstock with RMBF mechanism and a floating buttstock, the floating butt stock is in the default upright position. FIG. 37*b* illustrates a side view of the firearm with the sliding buttstock and RMBF of example 15 and floating buttstock, for clarity FIG. 37*c* and FIG. 37*d* are the front back and front views of the current configuration of firearm, sliding buttstock, RMBF and rotating buttstock embodiments.

FIG. 38*a* illustrates a rear perspective view of the sliding buttstock 3701 with RMBF mechanism 3600 and a floating buttstock 1604, the floating butt stock is in the second axial position. FIG. 38*b* illustrates a side view of the firearm with the sliding buttstock and RMBF 3600 and floating buttstock 1604, for clarity FIG. 38*c* and FIG. 38*d* are the front back and front views of the current configuration.

FIG. 39*a* illustrates a rear perspective view of the firearm 1000 with sliding buttstock 37001 with RMBF mechanism 3600 and a floating buttstock 1601, the floating butt stock is in the first axial position. FIG. 39*b* illustrates a side view of the firearm 1000 with the sliding buttstock 3701 and RMBF 3600 and floating buttstock 1604, for clarity FIG. 39*c* and FIG. 39*d* are the front back and front views of the current configuration.

FIG. 40*a* through 40*f*, illustrate the firearm 1000 with the sliding buttstock 3701 to which the RMBF 3600 is attached, a floating buttstock 1604 is attached to the other end of the RMBF, the floating buttstock is at the default upright position. FIG. 40*a* illustrates the sliding butt stock in a fully extended position, FIG. 40*b* is a back view of the said configuration.

FIG. 40*c* illustrates a side view of the firearm 1000 with sliding buttstock 3701 and RMBF 3600 and floating buttstock 1604, the sliding butt stock 2701 is in the partially extended position. FIG. 40*d* is a back view of the said configuration.

FIG. 40*e* illustrates a side view of the firearm 1000 with sliding buttstock 3701 and RMBF 3600 and floating buttstock 1604, the sliding butt stock 2701 is in the fully collapsed. FIG. 40*f* is a back view of the said configuration.

Example 16

Turning to FIGS. 41*a* through 41*d*, a sixteenth example RMBF adapter mechanism 4100. FIG. 41*a* illustrates an assembly view of the sixteenth example RMBF adapter mechanism with a modified first housing 4101 comprising three holes 4102*a, b* and *c* to accept one two or three guide pins 1916. FIGS. 41*b*, 41*c* and 41*d* illustrate a rear perspective view, a top view and a cross-sectional side view respectively of the RMBF adapter mechanism of FIG. 41*a*. This embodiment encompasses a slight modification of the adapter mechanism 3600. The said modification comprises the addition of one or two guide pins 1916 and the matching holes (4102*a, b* and *c*) are added to the first housing to attach the said added pins. The rest of the embodiment is similar in design and structure to the adapter mechanism 3600. This embodiment may comprise a first housing 4101, the housing 4101 may comprise two or three holes 4102, that maybe threaded or simply machined to receive one or two or three guide pins 1916, a second housing 3601, a helical spring 3602 disposed there between, and a screw 1910 (or bolt, or the like) configured to secure the first housing 1902 to the second housing 3601. As illustrated in FIG. 41*a*, this embodiment may comprise one or two or three guide pins that may be attached to the first housing and fit into the holes 4102, the first housing may have one or two or three holes 4102, the holes are configured such that the first hole is positioned perpendicular to the axis of rotation of the first housing, the second and third holes are placed in the same plane as the first hole however, they are offset 45° to the right and 45° to the left of the first hole, these holes are illustrated on FIG. 41*a*, first hole 4102*a*, second hole 4102*b* and third hole 4102*c*. Attachment of the guide pin into the hole maybe accomplished by any means used to temporary or permanently attach two metals, the guide pins 1916 maybe threaded or welded or simply press fit into the holes 4102. As illustrated, the first housing 1902 and the second housing 3601 may be generally shaped like cups, that is, a circular planar surface having a cylindrical wall (or portion thereof) at the circumference of the circular planar surface.

In some instances firearm users do not want to utilize the butt stock angle selection aspect of this invention and are only interested in the recoil mitigation aspect of this invention, in such instances this RMBF maybe be configured to function as a recoil mitigation mechanism only. This is accomplished by attaching three guide pins 1916 to the first housing 4101, each guide pin is attached in a corresponding hole 4102 (all three holes a, b and c will be fit with guide pins), the pins will be in contact with the selection grooves 301 and will prevent the first housing from rotating, but will allow it to move in the axial direction only. This may also be accomplished by attaching two pins 1916 into two holes 4102*a* and 4102*c*, in this instance the two holes offset 45° to the right and to the left of hole 4102*b* will only will be used, this will accomplish the same goal as utilizing three guide pins.

In other instances the firearm user may only want to utilize two angular position selection along with the recoil mitigation aspect of this invention. For example an operator might only want to use the default upright position and the first axial position and does not want to use the second axial position and does not want to RMBF mechanism to inadvertently rotate the buttstock to the second axial position, in such an instance, only two guide pins 1916 and only two holes 4102*a* and 4102*b* will be utilized, the pins are secured in the said holes, the RMBF in this instance will allow only selection of two positions, the default upright position and the first axial position, this limitation in position selection will not affect the recoil mitigation aspect of the RMBF mechanism. In another instance the firearm operator may only want to utilize two angular selection along with the recoil mitigation aspect of the invention, but in this instance the operator wants to utilize the default upright position and the second axial position. Similar to the previous instance two holes two pins are used, the holes in this instance are 4102*a* and 4102*c*. Attaching pins into these holes will limit the angular selection to the second axial position and the default axial position.

Turning to FIGS. 42*a* through 42*c*, these figures illustrate a sliding buttstock 3701 attached to firearm 1000, and a RMBF mechanism of example 16 (4100) of this invention which is attached to the end of the sliding buttstock 3701, attached to the first housing of the RMBF is the floating part of the buttstock 1604. FIG. 42*a* is a top view of the aforementioned firearm 1000, sliding stock 3017, RMBF 4100 and floating butt stock 1604, in this example the RMBF 4100 is configured to provide only recoil mitigation function and no buttstock rotation function. This is accomplished through attaching three pins 1916 to the first housing. FIG. 42C illustrates a detailed view of the RMBF 4100 with the three pins 1916 attached to the holes 4102*a, b* and *c* in the first housing. FIG. 42*b* illustrates the back view of the aforementioned configuration, the floating buttstock is locked in the default upright position.

Turning to FIGS. 42*d* through 42*f*, these figures illustrate a sliding buttstock 3701 attached to firearm 1000 and a RMBF mechanism of example 16 (4100) of this invention which is attached to the end of the sliding buttstock 3701, attached to the first housing of the RMBF is the floating part of the buttstock 1604. FIG. 42*d* is a top view of the aforementioned firearm 1000, sliding stock 3017, RMBF 4100 and floating butt stock 1604, in this example the RMBF 4100 is configured to allow selection of only two buttstock positions (the default upright position and the first axial position) and provide recoil mitigation function. This is accomplished through attaching two pins 1916 to the first housing. FIG. 24*f* illustrate a detailed view of the RMBF 4100 with the two pins 1916 attached in holes 4102 in the first housing 4101 of RMBF mechanism 4100, the pins are attached to holes 4102*a* and *c* (for more illustration, please refer to FIG. 41*a*). FIG. 42*e* illustrates the back view of the aforementioned configuration, the floating butt stock is positioned in the first axial position, the floating buttstock in this example can be located in two positions only, the default upright position and the first axial position.

Turning to FIGS. 42*g* through 42*i*, these figures illustrate a sliding buttstock 3701 attached to firearm 1000, and a RMBF mechanism of example 16 (4100) of this invention which is attached to the end of the sliding buttstock 3701, attached to the first housing of the RMBF is the floating part of the buttstock 1604. FIG. 42*d* is a top view of the aforementioned firearm 1000, sliding stock 3017, RMBF 4100 and floating butt stock 1604. In this example the RMBF 4100 is configured to allow selection of only two buttstock positions (the default upright position and the second axial position) and provide recoil mitigation function. This is accomplished by attaching two pins 1916 to the first housing. FIG. 24*i* illustrates a detailed view of the RMBF 4100 with the two pins 1916 attached to holes in the first housing 4101 of RMBF mechanism 4100, the pins are attached into holes 4102*a* and *b* (for more illustration, please refer to FIG. 41*a*). FIG. 42*h* illustrates the back view of the aforementioned configuration, the floating butt stock is positioned in the second axial position, the floating buttstock in this example can be located in two positions only, the default upright position and the second axial position.

The foregoing description and accompanying figures illustrate the principles, preferred embodiments, and modes of operation of the invention. However, the invention should not be construed as being limited to the particular embodiments discussed above. Additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the invention as defined by the following claims.

All documents cited herein, including journal articles or abstracts, published or corresponding U.S. or foreign patent applications, issued or foreign patents, or any other documents are each entirely incorporated by reference herein, including all data, tables, figures, and text presented in the cited documents.

What is claimed:

1. A recoil mitigation and buttstock floating (RMBF) device for a firearm, the RMBF device comprising:

a tube component configured to attach to a firearm;

a bracket for mounting a buttstock (i) that can axially slide up and down the tube component and (ii) that can axially rotate around the tube component;

a first locking member affixed to the tube component;

a second locking member affixed to the bracket component; and an expansive component that creates a biasing force to axially slide the bracket down the tube component and mate the first and second locking members, thereby locking the bracket at a first radial angle relative to the tube component;

wherein a shooter may compress the expansive component to slide the bracket up the tube component, thereby unmating the first and second locking members such that:

the bracket may be rotated radially relative to the tube component, and the shooter may stop compressing the expansive component to allow the expansive component's biasing force to slide the bracket down the tube component and mate the first and second locking members in a different configuration, thereby locking the bracket at a second radial angle to the tube component;

wherein the first and second radial angles are different angles; and wherein when the tube component is connected to a firearm and the bracket is connected to a buttstock, a shooter may pull the firearm onto his shoulder to compress the expansive component.

2. The RMBF device of claim 1, wherein the tube component comprises an open end and a closed end, wherein the open end comprises a connecting component to secure it to a firearm.

3. The RMBF device of claim 2, wherein the RMBF device further comprises a recoil spring and a recoil buffer weight, wherein the recoil spring is positioned inside of the tube component and applies a force upon the closed end and the recoil buffer weight.

4. The RMBF device of claim 3, wherein the recoil spring provides impact mitigation.

5. The RMBF device of claim 1, further comprising a buttstock, wherein the buttstock is attached to the bracket.

6. The RMBF device of claim 1, wherein the bracket comprises an annular ring at a first end of the bracket, the annular ring coupling the bracket to the tube component, thereby securing the bracket to the tube component.

7. The RMBF device of claim 5, wherein an annular ring is slideably and axially coupled to the tube component.

8. The RMBF device of claim 1, wherein:

the bracket comprises a bolt hole on a second end of the bracket;

the tube component comprises a bolt hole in the center of a closed end of the tube; and a first bolt engages the bracket's bolt hole and the tube component's bolt hole to secure the components together and define the axis of rotation around the first bolt.

9. The RMBF device of claim 1, wherein the expansive component is a helical spring.

10. The RMBF device of claim 1, wherein the RMBF device further comprises:

a second bolt connected to the bracket; and an extension of the tube component that comprises a cutout that is shaped to receive the second bolt;

wherein the cutout has several grooves such that, at rest, the expansive component pushes the second bolt into one of said grooves locking the rotation of the bracket relative to the tube component.

11. The RMBF device of claim 10, wherein compressive force can be applied to the RMBF device to compress the expansive component thereby freeing the bolt from the grooves, such that the bracket can be rotated around the tube, or a first bolt, and such that the second bolt can engage a different groove when the compressive force is removed.

12. The RMBF device of claim 1, wherein the expansive component is a helical spring.

13. The RMBF device of claim 12, wherein the RMBF device further comprises:

a second bolt connected to the bracket; and an extension of the tube component that comprises a cutout that is shaped to receive the second bolt;

wherein the cutout has several grooves such that, at rest, the expansive component pushes the second bolt into one of said grooves locking the rotation of the bracket around the tube component; and wherein compressive force can be applied to the RMBF device to compress the expansive component thereby freeing the second bolt from the grooves, such that the bracket can be rotated around the tube and such that the bolt can engage a different groove when the compressive force is removed.

14. A method of using an RMBF device for a firearm, comprising:

providing an apparatus with the following components:

a tube component configured to attach to a firearm;

a bracket for mounting a buttstock;

an expansive component;

wherein the bracket is coupled to the tube component and configured to rotate relative to a longitudinal axis of the tube component, thereby defining an axis of rotation;

wherein a position of the bracket relative to the tube component can be locked at one of a plurality of axial angles;

wherein the expansive component applies expansive force between the tube component and the bracket down axis of rotation; and wherein a shooter holding the firearm against his shoulder in a shooting position can pull the firearm into his shoulder, unlocking the bracket relative to the tube component and change to a different axial angle; and rotating the bracket relative to the tube component.

15. The method of claim 14, further comprising locking the bracket relative to the tube component.

16. A method of manufacturing an RMBF for a firearm, comprising:

attaching a bracket for mounting a buttstock to a tube component configured to attach to a firearm;

wherein the bracket is adapted to couple to the tube component and configured to rotate relative to a longitudinal axis of the tube component, thereby defining an axis of rotation;

wherein when connected, a position of the bracket relative to the tube component can be locked at one of a plurality of axial angles, such that the plurality of axial angles comprises a plurality of angles that allow the buttstock to engage with a shooter's shoulder when firing the firearm where the firearm is at different angles about an axis of rotation relative to the shooter giving the shooter control over the angle of the firearm; and wherein when a buttstock is mounted on a buttstock and the tube component is mated to a firearm, a shooter holding the firearm against his shoulder in a shooting position can pull the firearm into his shoulder, unlocking the bracket relative to the tube component and change to a different axial angle.

17. The method of claim 16, wherein an expansive component exerts force on the tube component and the bracket such that the expansive component applies expansive force to push the bracket away from the tube component down axis of rotation.

* * * * *